US011117718B2

(12) United States Patent
Chapman

(10) Patent No.: US 11,117,718 B2
(45) Date of Patent: Sep. 14, 2021

(54) MULTIPLE SEAL SPOUTS WITH U/J-SHAPE SEAL SPOUT BAG HOLDER AND HORSE SHOE FRAME WITH U/J-SHAPE HOOKS SEAL SPOUT BAG HOLDER

(71) Applicant: Deone Lashawne Chapman, Fredericksburg, VA (US)

(72) Inventor: Deone Lashawne Chapman, Fredericksburg, VA (US)

( * ) Notice: Subject to any disclaimer, the term of this patent is extended or adjusted under 35 U.S.C. 154(b) by 66 days.

(21) Appl. No.: 16/013,929

(22) Filed: Jun. 27, 2018

(65) Prior Publication Data

US 2018/0370695 A1 Dec. 27, 2018

Related U.S. Application Data

(60) Provisional application No. 62/532,375, filed on Jul. 14, 2017, provisional application No. 62/522,682, filed on Jun. 20, 2017, provisional application No. 62/514,878, filed on Jun. 4, 2017.

(51) Int. Cl.

| | |
|---|---|
| ***B65D 47/14*** | (2006.01) |
| ***B65D 47/28*** | (2006.01) |
| ***B65D 55/16*** | (2006.01) |
| ***B65D 53/02*** | (2006.01) |
| ***B65D 5/74*** | (2006.01) |
| ***B65D 75/58*** | (2006.01) |
| ***B65D 47/26*** | (2006.01) |

(52) U.S. Cl.

CPC ..... *B65D 47/14* (2013.01); *B65D 5/746* (2013.01); *B65D 47/286* (2013.01); *B65D 53/02* (2013.01); *B65D 55/16* (2013.01); *B65D 75/5877* (2013.01); *B65D 2251/20* (2013.01); *B65D 2547/066* (2013.01)

(58) Field of Classification Search

CPC . B65D 5/74; B65D 5/72; B65D 5/746; B65D 47/14; B65D 47/286; B65D 53/02; B65D 55/16; B65D 75/5877; B65D 2251/20; B65D 2547/066; B65D 2547/063; B65D 47/26

See application file for complete search history.

(56) References Cited

U.S. PATENT DOCUMENTS 1,508,878 A * 9/1924 Evalenko ..... B65D 5/72 229/125.11
1,752,352 A * 4/1930 Schmidt ..... B65D 5/746 222/89

(Continued)

FOREIGN PATENT DOCUMENTS

WO WO-9715524 A1 * 5/1997 ..... B65D 5/746

*Primary Examiner* — Christopher R Harmon

(57) ABSTRACT

Multiple seal spouts is provided. The multiple seal spout include an outer frame, inner frame flange, a template, a seal and sliding door on all version. The seal spout will have multiple fasteners to secure seal spouts to bag, container or flat surface. The multiple seal spout are releasable attachable to bag, container or any flat surface. The seal spout can be used to pour or dispense product. The present invention further invention includes a u/j-shape seal spout bag holder bracket that may be screwed to wall to hold bag with attached seal spout. The present invention may include an option horse shoe frame with u/j hooks seal spout holder that will hold bag with attached seal spout.

9 Claims, 55 Drawing Sheets

(56) References Cited

U.S. PATENT DOCUMENTS

| | | | | | |
|---|---|---|---|---|---|
| 3,250,436 | A | * | 5/1966 | Kurtz | B65D 5/744<br>222/153.07 |
| 4,318,497 | A | * | 3/1982 | Friedrich | B67B 7/26<br>222/105 |
| 4,572,408 | A | * | 2/1986 | Kupersmit | B65D 5/746<br>222/153.14 |
| 4,852,764 | A | * | 8/1989 | Stone | B65D 5/746<br>220/315 |

* cited by examiner

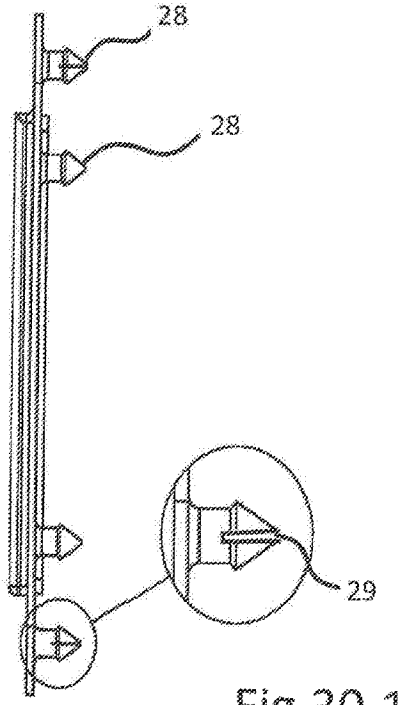
Fig.30
Fig.30-1
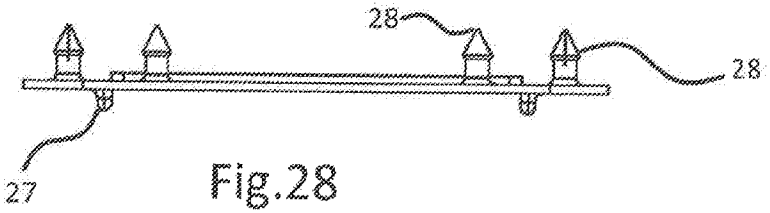
Fig.28
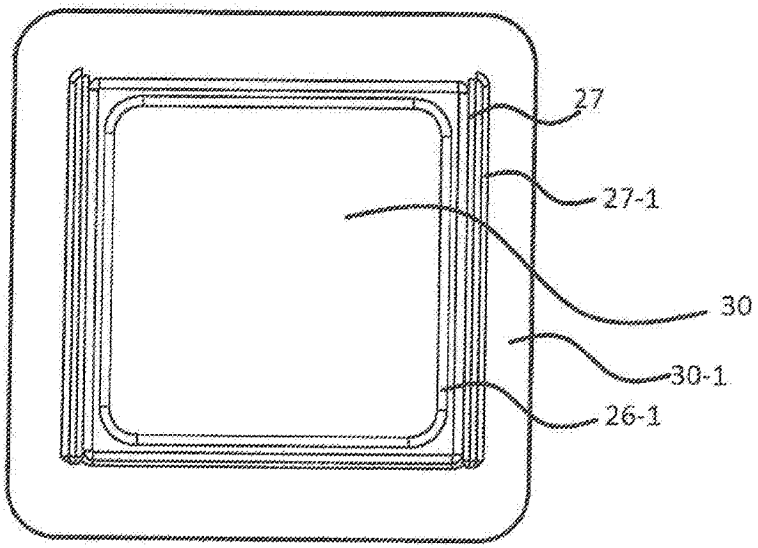
Fig.29

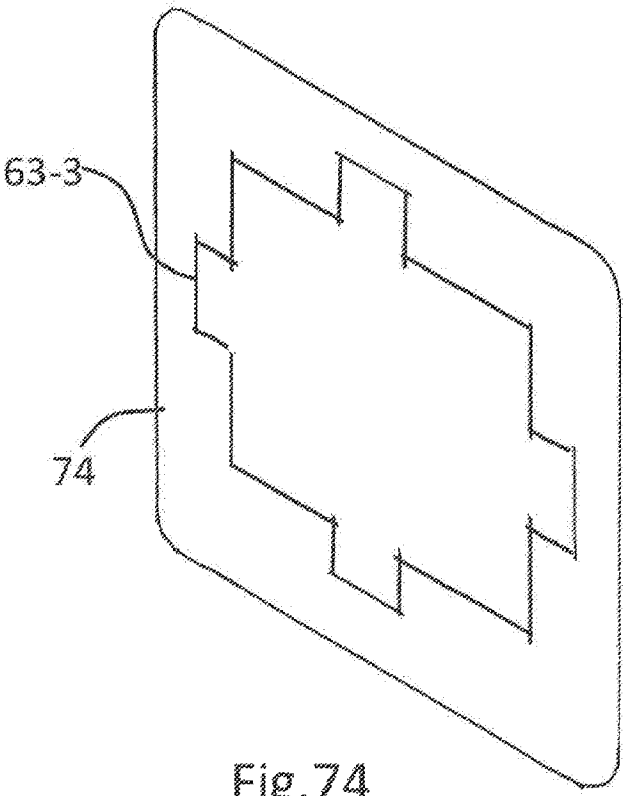
Fig.74
Fig.74-1
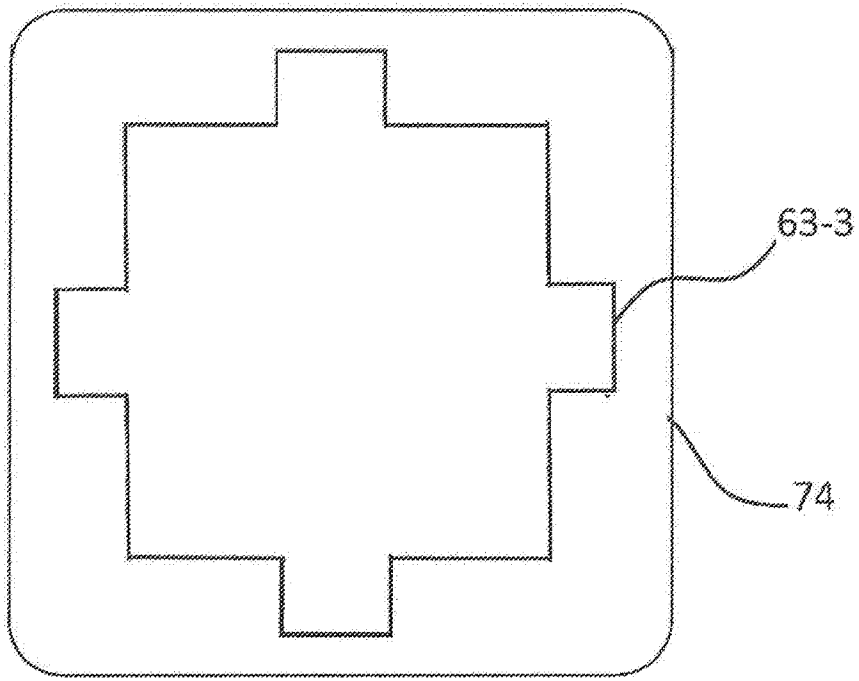
Fig.73

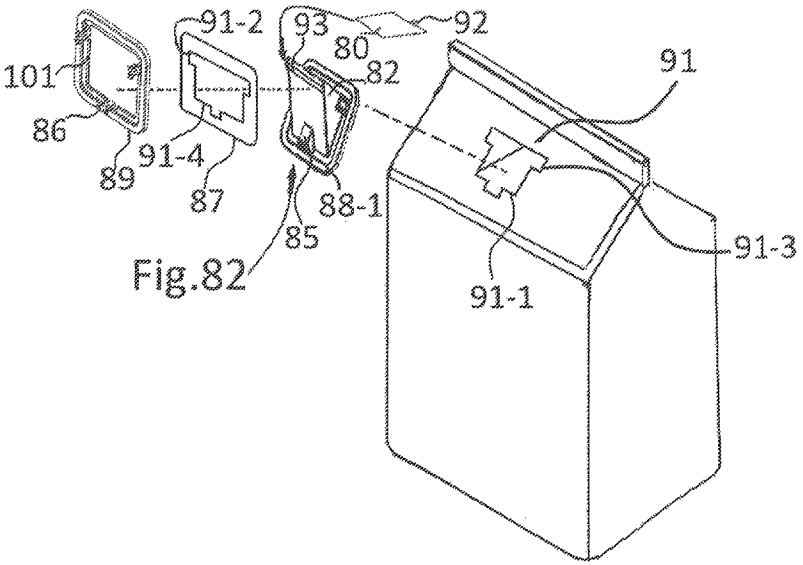
Fig.82
Fig.82-1
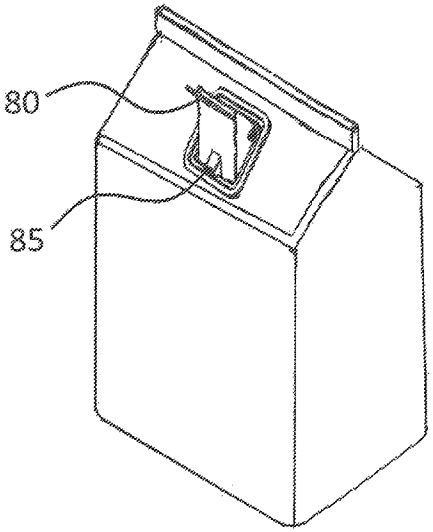
Fig.83
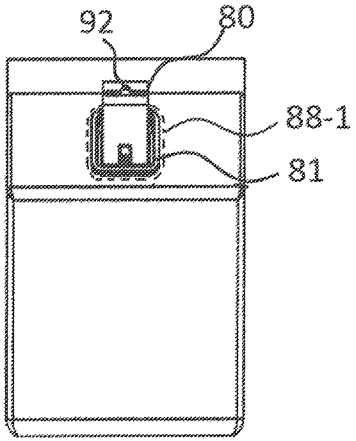
Fig.79
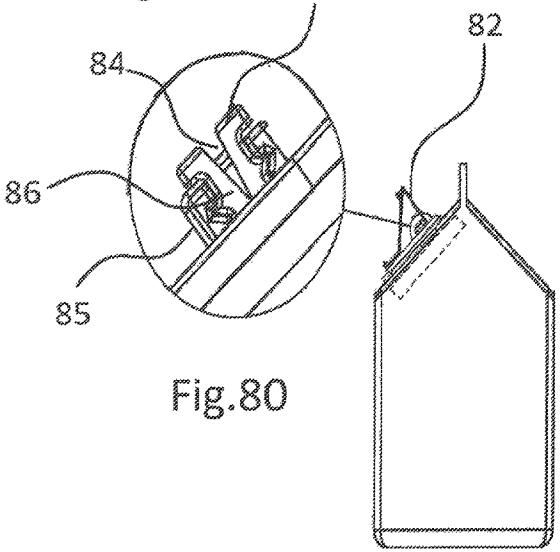
Fig.80
Fig.81

115-1
115-2
115
111
110
113
119
124
114
123
121
122
112
108
109

116

107

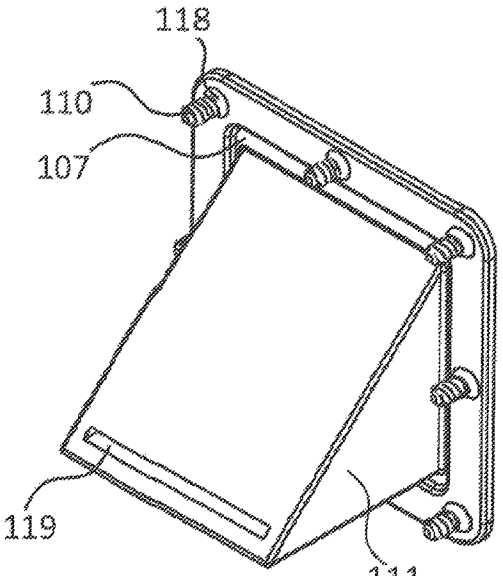
Fig.107
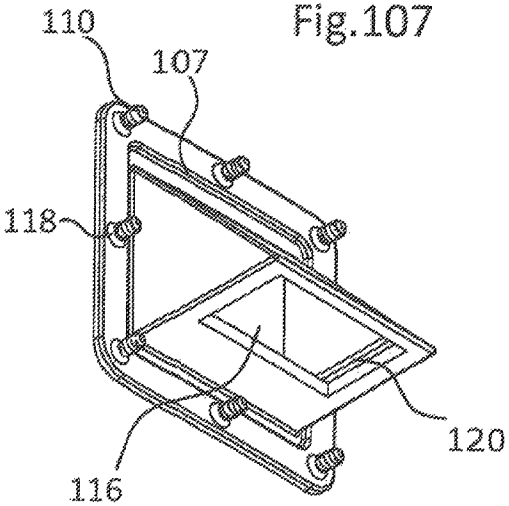
Fig.108
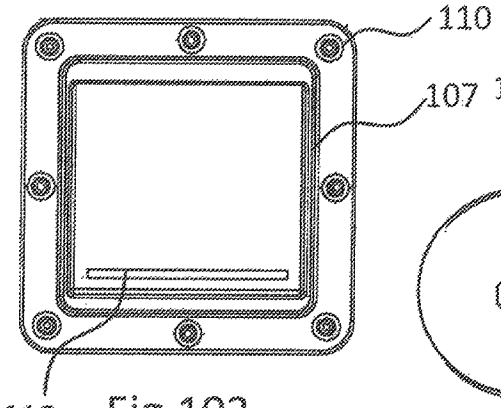
Fig.103
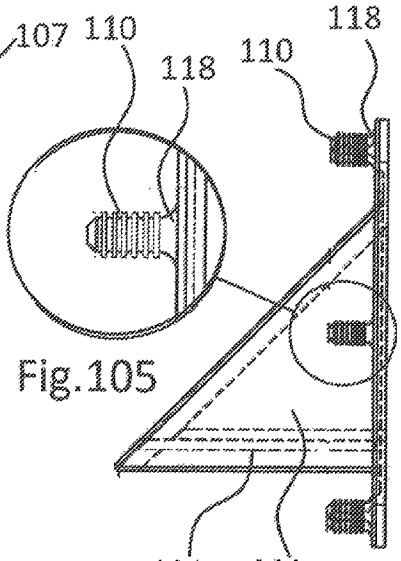
Fig.105
Fig.106
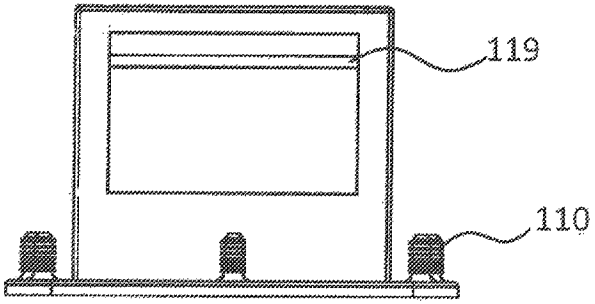
Fig.104

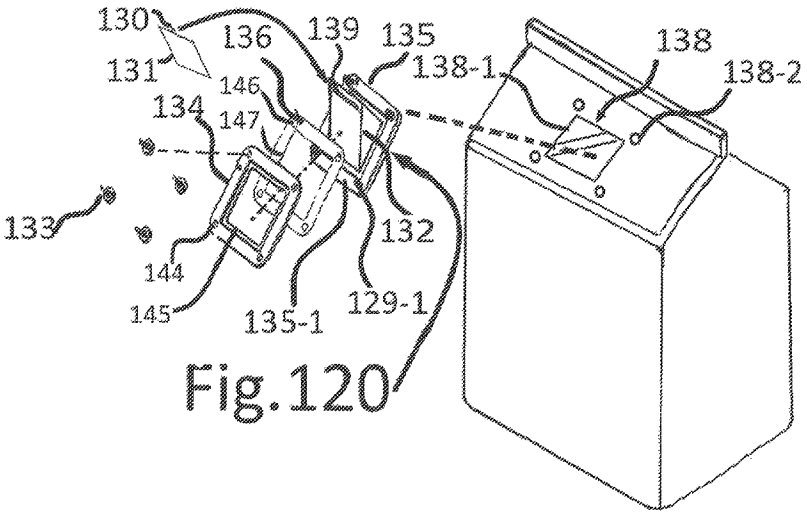
Fig.120-1
Fig.120
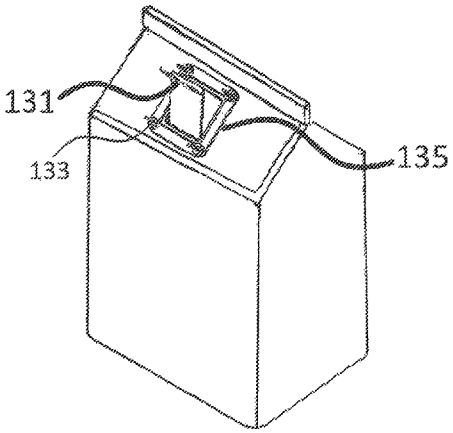
Fig.121
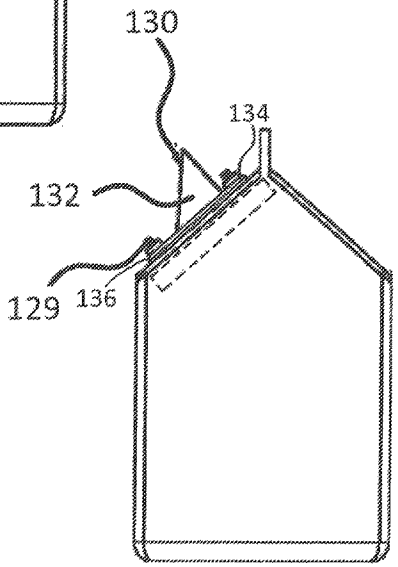
Fig.119
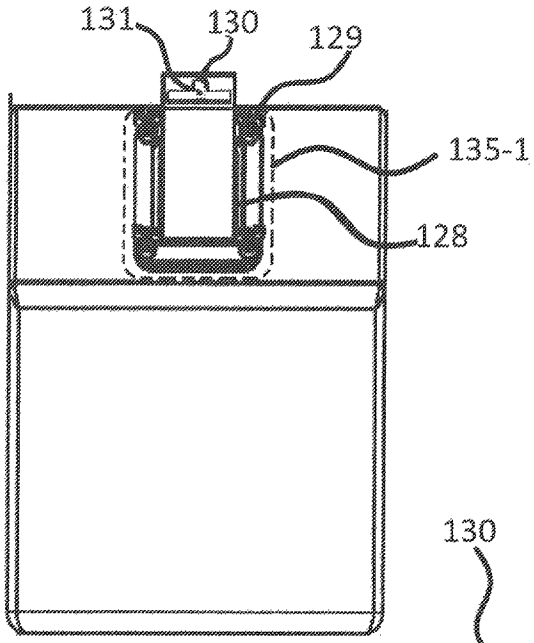
Fig.118

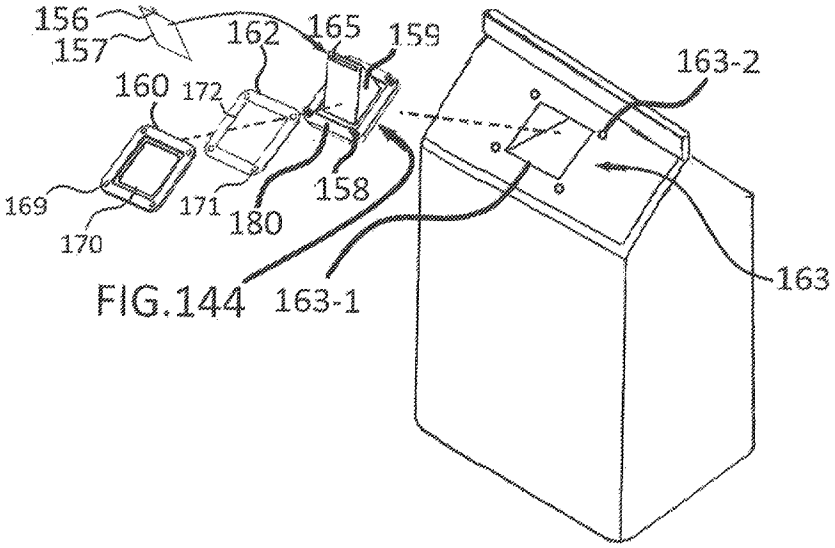
FIG.144
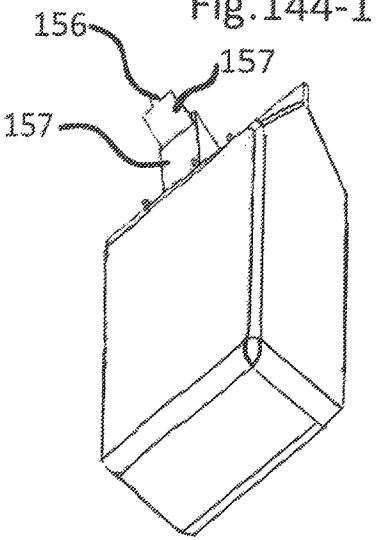
Fig.144-1
Fig.145
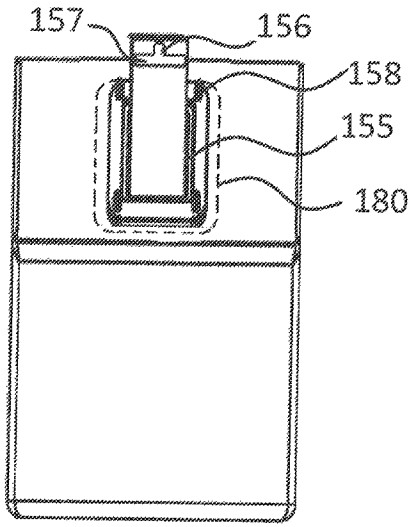
Fig.142
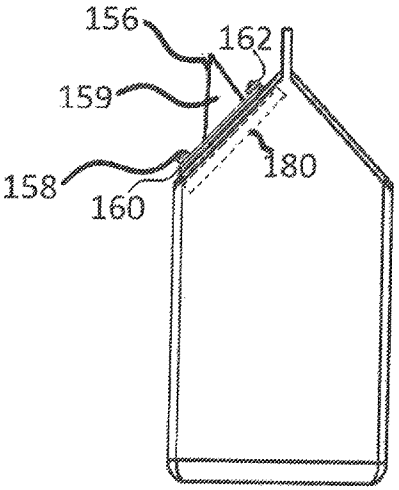
Fig.143

157
180
180-1
180-2
182
184
186
188
190
196
200
202
202-2
202-3
204
204-1
207
226

MULTIPLE SEAL SPOUTS WITH U/J-SHAPE SEAL SPOUT BAG HOLDER AND HORSE SHOE FRAME WITH U/J-SHAPE HOOKS SEAL SPOUT BAG HOLDER

CROSS-REFERENCE TO RELATED APPLICATION

This application claims the benefit of priority of U.S. provisional application Nos. 62/514,878, filed Jun. 4, 2017, 62/522,682, filed Jun. 20, 2017 and 62/532,375 filed Jul. 14, 2017 the contents of which are herein incorporated by reference.

FIELD OF THE INVENTION

The present invention relates to bag seals, container seals, surface seals that contain product and, more particularly, to multiple seal spouts.

A resealable access point is any physical item on a bag or container that will maintain freshness of a product and give consumer accessibility to the product. Resealable access points have been used on bags and containers for quite some time. Most of the seals on bags and containers don't operate well because the seal is flimsy. The end user is constantly trying to line up seal and eventually the seal become fatigued and fails. Some bags and containers don't even come with resealable access point on them; therefore, the consumer must spend more money to maintain the product freshness by buying a container or bag that can be resealed after use. Some seals are ergonomically displeasing to the hands when trying to open or close the seal and most seals either are used to maintaining freshness or to access to product. Therefore there is a need for improvement on product bags/containers that have resealable seals and bags/containers that don't have resealable seals. This product will allow the end user to keep product in original bag/container to maintain freshness, prevent mildewing of product or product becoming tainted.

BACKGROUND OF INVENTION

Problem Solved

It is hard to find bag or container that has a proper seal and a way to access product without making a mess or hurting back when trying to pour product. Most bags and containers don't have a resealable access point therefore the product loses its freshness. The end user has to open the bag or container and have to worry about either something getting into product or product spilling out and product not holding its freshness. These seal spouts will keep products fresh and will allow the end user to access the products without all the mess and possible injury for those that have back problems or other issues. These seal spouts will help dog owners who buy large bags of food with no access point, restaurant owners who buy big bulk of ingredients that have no access point, cat owners who buys large or small bags of food, bird lovers who buy large bags of bird seeds, . . . etc. Now they can add resealable access point by using seal spouts. These seal spouts will cut down on cost by allowing the end user to use the bag or container without having to buy or purchase a separate container with a dispensing/pouring apparatus. The seal spouts will be used for any type of bags, bags with re-sealable access point on containers, and or flat surfaces that contain product. The purpose is to be able to access product in a convenient way without the mess and to keep product fresh and safe from anything getting into bag or container. The end user will install the seal spouts on bag, container or flat surface to pour or dispense product. The end user will follow a template provided to them to cut out holes on bag or container. The end user will then squeeze flexible outer frame through template cutout holes on container, bag or flat surface. Once the end user has the outer frame in bag according to what type of fasteners are used on outer frame, the end user will align outer frame according to template cutout holes. The end user will then place the seal over top of fasteners and bag, container or flat surface material. Last the end user will use the inner frame flange to sandwich seal, bag/container material against outer frame flange to create re-sealable access point. These devices will also provide bags or container manufactures with a simple secure re-sealable access point for their products. Note all seal spouts version may have the option to be releasably attached to bags, containers or flat surface using only outer frame with spout components which include sliding doors. The outer frame may be attached and secured outside the bag, container or flat surface using only food safe double-sided adhesion/tape. The adhesion/double sided tape can be reusable up to a certain amount of time when putting outer frame with sliding door on another bag, container or flat surface. As can be seen, there is need for multiple seal spouts.

BRIEF DESCRIPTION OF THE DRAWINGS

Version 1 Multiple Seal Spout Figures

SUMMARY OF INVENTION

Figures 1, 2, 3, 4:
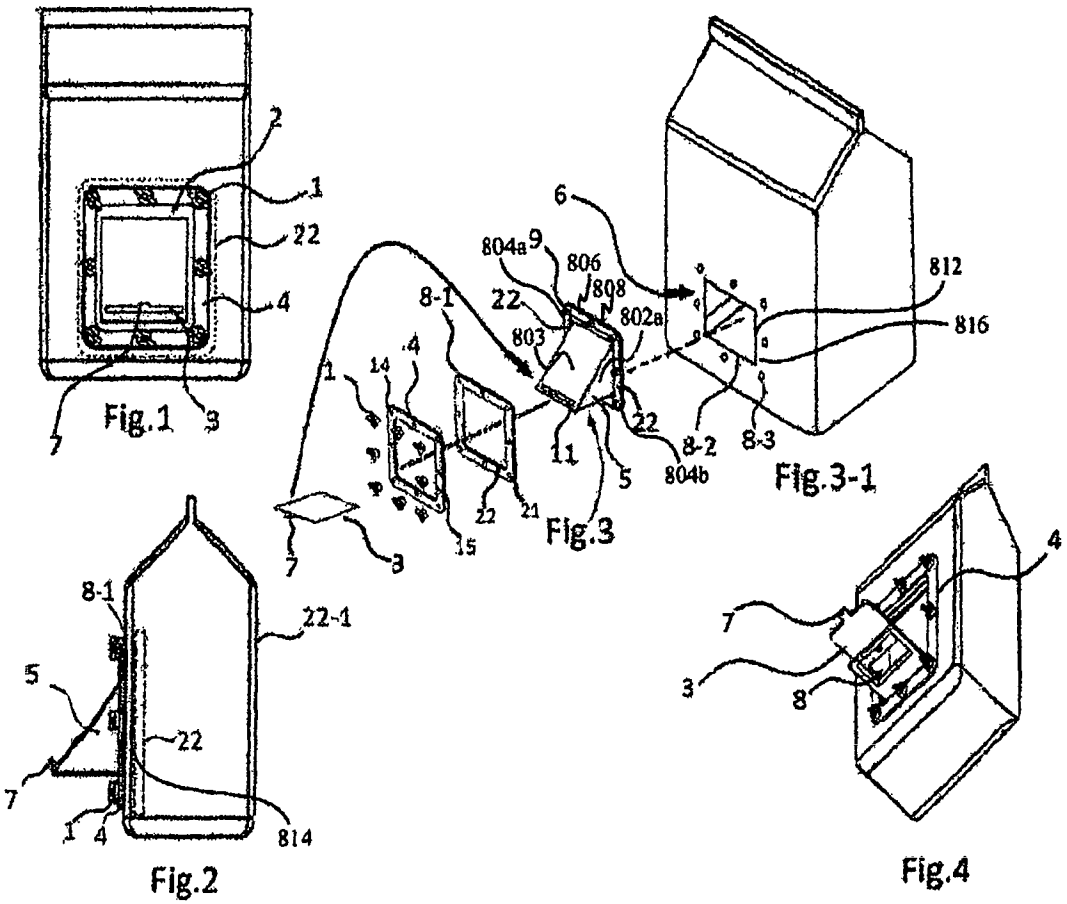
FIG. 1 Front view of protruding seal spout attached to bag
FIG. 2 Side view of protruding seal spout attached to bag
FIG. 3 Exploded view of protruding seal spout outer frame with attached thread studs and components FIG. 3-1 Perspective view bag with template holes and cutout holes FIG. 4 Front perspective view of protruding seal spout with sliding door open FIG. 5 Front view of protruding seal spout with attached threaded studs FIG. 6 Bottom view of protruding seal spout with attached threaded studs FIG. 7 Side view of protruding seal spout with attached studs FIG. 8 Perspective view of protruding seal spout with attached studs FIG. 9 Perspective view of protruding seal spout with attached studs showing spout hole FIG. 10 Front view of protruding seal spout inner frame flange FIG. 11 Side view of protruding seal spout inner frame flange FIG. 12 Perspective view of protruding seal spout inner frame flange FIG. 13 Back perspective of view protruding seal spout inner frame flange FIG. 14 Front view of protruding seal spout sliding door FIG. 15 Side view of protruding seal spout sliding door showing optional taper bottom and top seal FIG. 16 Back view or protruding seal spout sliding door FIG. 17 Perspective view of protruding seal spout sliding door FIG. 18 From view of protruding seal spout wing nut FIG. 19 Top view of protruding seal spout wing nut FIG. 20 Side view of protruding seal spout wing nut FIG. 21 Top perspective view of protruding seal spout wing nut FIG. 22 Bottom perspective view of protruding seal spout wing nut FIG. 23 Front view of protruding seal spout seal/template Version 2 Multiple Seal Spout Figures FIG. 24 Front view of sliding door seal spout on bag with tamper seal FIG. 24-1 Front view of sliding door seal spout outer frame showing tamper seal FIG. 25 Side view of sliding door seal spout on bag FIG. 26 Front view of sliding door outer frame flange with no sliding door attached to bag FIG. 27 Exploded perspective view sliding outer frame with components FIG. 27-1 Perspective view of open bag showing components FIG. 28 Bottom view of sliding door seal spout outer frame with attached male snaps FIG. 29 Front view of sliding door seal spout outer frame with attached male snaps FIG. 30 Side view of sliding door seal spout outer frame with attached male snaps FIG. 30-1 Side view of male snap fastener FIG. 31 Front view of sliding door seal spout inner frame flange FIG. 32 Side view of sliding door seal spout inner frame flange FIG. 33 Front view of sliding door seal spout seal FIG. 34 Side view of sliding door seal spout seal FIG. 35 Front view of sliding door seal spout sliding door FIG. 36 Side view of sliding door seal spout siding door Version 3 Multiple Seal Spout Figures FIG. 37 Bottom view of protruding seal spout attached to bag showing bottom of bag FIG. 38 Front view of protruding seal spout attached to bag FIG. 39 Side view of protruding seal spout attached to bag FIG. 40 Perspective exploded view of protruding seal spout with components FIG. 40-1 Perspective front view of bag with template and cut out holes FIG. 41 Perspective view of protruding seal spout with sliding door open FIG. 42 Front view of protruding seal spout outer frame with attached male snap fasteners FIG. 43 Side view of protruding seal spout outer frame with attached male snap fasteners FIG. 43-1 Side view male snap fasteners FIG. 44 Bottom view of protruding seal spout outer frame with attached male snap fasteners FIG. 45 Back view of protruding seal spout outer frame with attached male snap fasteners FIG. 46 Perspective view of protruding seal spout outer frame with attached male snap fasteners FIG. 47 Perspective view of protruding spout outer frame with male attached snap fasteners FIG. 48 Front view of protruding seal spout with attached male snap fasteners inner frame flange FIG. 49 Side view of protruding seal spout with attached male snap fasteners inner frame flange FIG. 50 Perspective view of protruding seal spot with attached male snap fasteners inner frame flange FIG. 51 Front view of protruding seal spout with attached male snap fasteners seal FIG. 52 Side view of protruding seal spout with attached male snap fasteners seal FIG. 53 Perspective view of protruding seal spout with attached male snap fasteners seal FIG. 54 Front view of protruding seal spout with attached male snap fastener sliding door FIG. 55 Side view of protruding seal spout with attached male snap fasteners sliding door FIG. 56 Back view of protruding seal spout with attached male snap fasteners sliding door FIG. 57 Perspective view of protruding seal spout with attached male snap fasteners sliding door Version 4 Multiple Seal Spouts FIG. 58 Front view of protruding seal spout attached to bag FIG. 59 Side view of inverted male clip connected inside female clip FIG. 60 Side view of protruding seal spout with outer frame with components attached to bag FIG. 61 Perspective exploded view of protruding seal spout with clips on bag FIG. 61-1 Perspective view of bag with template and cut out holes FIG. 62 Perspective view of protruding seal spout with sliding door open FIG. 63 Front view of protruding seal spout outer frame with attached female clips FIG. 64 Bottom view of protruding seal spout outer frame with attached female clips FIG. 65 Side view of protruding seal spout outer frame with attached female clips FIG. 66 Perspective view of protruding seal spout with attached female clips showing spout hole FIG. 67 Perspective view of protruding seal spout with attached female clips FIG. 68 Front view of protruding seal spout inner frame flange with attached inverted male clips FIG. 69 Side view of protruding seal spout inner frame flange with attached inverted male clips FIG. 70 Side view inverted male clip FIG. 71 Back perspective view of protruding seal spout inner frame with attached inverted male clips FIG. 72 Front perspective view protruding seal spout inner frame with attached inverted male clips FIG. 73 Front view of protruding spout with clips seal FIG. 74 Perspective view of protruding seal spout with clips seal FIG. 74-1 Side view of protruding seal spout with clips seal FIG. 75 Front view of protruding spout seal with clips sliding door FIG. 76 Side view of protruding seal spout with clips sliding door FIG. 77 Back view of protruding seal spout with clips sliding door FIG. 78 Perspective view of protruding seal spout with clip sliding door Version 5 Multiple Seal Spouts FIG. 79 Front view of reverse protruding seal spout attached to bag FIG. 80 Side view of reverse protruding seal spout inverted male clip connect inside female flip FIG. 81 Side view of reverse protruding seal spout attached to bag FIG. 82 Perspective explode view of reverse protruding seal spout outer frame with components FIG. 82-1 Perspective view of bag with template and cutout holes FIG. 83 Perspective view of reverse protruding seal spout attached to bag FIG. 84 Top view of reverse protruding seal spout outer frame with attached female clips FIG. 85 Front view of reverse protruding seal spout outer frame with attached female clips FIG. 86 Side view of reverse protruding seal spout outer frame with attached female clips FIG. 86-1 Side view of attached female clip on outer frame FIG. 87 Perspective top view of reverse protruding seal spout outer frame with attached female clips spout hole FIG. 88 Perspective view of reverse protruding seal spout outer frame with attached female clips FIG. 89 Front view of reverse protruding seal spout frame flange with inverted attached male clips FIG. 90 Side view of reverse protruding seal spout with inverted attached male clips FIG. 90-1 Side view of reverse protruding seal spout with inverted attached male clips FIG. 91 Front perspective view of reverse protruding seal spout with attached inverted male clips FIG. 92 Perspective view of reverse protruding seal spout with attached inverted male clips FIG. 93 Front view of reverse protruding seal spout with clips seal FIG. 93-1 Side view of reverse protruding seal spout with clips seal FIG. 94 Perspective view of reverse protruding seal spout with clips seal FIG. 95 Front view of reverse protruding seal spout with clips sliding door FIG. 96 Side view of reverse protruding seal spout with clips sliding door FIG. 97 Back view of reverse protruding seal spout with clips sliding door FIG. 98 Perspective view of reverse protruding seal spout with clip sliding door Version 6 Multiple Seal Spout FIG. 99 Front view of protruding seal spout attached to bag FIG. 100 Side view of protruding seal spout attached to bag FIG. 101 Exploded perspective view of protruding seal spout outer frame with components FIG. 101-1 Perspective view of bag with template and cut out holes FIG. 102 Perspective view of protruding seal spout attached to bag showing spout hole FIG. 103 Front view of protruding seal spout outer frame with attached studded flanges FIG. 104 Bottom view of protruding seal spout outer frame with attached studded flanges FIG. 105 Side view of protruding seal spout studded flanges attach to outer frame FIG. 106 Side view of protruding seal spout outer frame with attached studded flanges FIG. 107 Perspective view of protruding seal spout with outer frame with attached studded flanges FIG. 108 Perspective view of protruding seal spout outer frame with attached studded flanges showing spout hole FIG. 109 Front view of protruding seal spout inner frame flange FIG. 110 Side view of protruding seal spout inner frame flange FIG. 111 Front perspective view of protruding seal spout inner frame flange FIG. 112 Back perspective view of protruding seal spout inner frame flange FIG. 113 Front view of protruding seal spout with studded flanges seal FIG. 114 Front view of protruding seal spout with studded flanges sliding door FIG. 115 Side view of protruding seal spout with studded flanges sliding door FIG. 116 Back view of protruding seal spout with studded flanges sliding door FIG. 117 Perspective view of protruding seal spout with studded flanges sliding door Version 7 Multiple Seal Spouts FIG. 118 Front view of reverse protruding seal spout attached to bag FIG. 119 Side view of reverse protruding seal spout attached to bag FIG. 120 Exploded perspective view of reverse protruding seal spout outer frame with components FIG. 120-1 Perspective view of bag with template and cutout holes FIG. 121 Perspective view of reverse protruding seal spout attached to bag FIG. 122 Top view of reverse protruding seal spout outer frame with attached threaded studs FIG. 123 Front view of reverse protruding seal spout outer frame with attached threaded studs FIG. 124 Side view of reverse protruding seal spout outer frame with attached threaded studs FIG. 125 Perspective view of reverse protruding seal spout outer frame with attached threaded studs showing spout hole FIG. 126 Perspective view of reverse protruding seal spout outer frame with attached threaded studs FIG. 127 Front view of reverse protruding seal spout inner frame flange FIG. 128 Side view of reverse protruding seal spout inner frame flange FIG. 129 Front perspective view of reverse protruding seal spout inner frame flange FIG. 130 Back perspective view of reverse protruding seal spout inner frame flange FIG. 131 Front view of reverse protruding seal spout seal FIG. 132 Side view of reverse protruding seal spout seal FIG. 133 Perspective view of reverse protruding seal spout seal FIG. 134 Front view of reverse protruding seal spout sliding door FIG. 135 Side view of reverse protruding seal spout sliding door FIG. 136 Back view of reverse protruding seal spout sliding door FIG. 137 Perspective view of reverse protruding seal spout sliding door FIG. 138 Top view of reverse protruding seal spout wing nut FIG. 139 Front view of reverse protruding seal spout wing nut FIG. 140 Side view of reverse protruding seal spout wing nut FIG. 141 Perspective view of reverse protruding seal spout wing nut Version 8 Multiple Seal Spouts FIG. 142 Front view of reverse protruding seal spout attached to bag FIG. 143 Side view of reverse protruding seal spout attached to bag FIG. 144 Exploded perspective view of reverse protruding spout outer frame with components FIG. 144-1 Perspective view of bag with template and cut out holes FIG. 145 Perspective of reverse protruding seal spout attached to bag FIG. 145 Front view of reverse providing seal spout outer frame with attached studded flanges FIG. 147 Bottom view of reverse protruding seal spout outer frame with attached studded flanges FIG. 148 Side view of reverse protruding seal spout outer frame with attached studded flanges FIG. 149 Perspective view of reverse protruding seal spout outer frame with attached studded flanges showing spout hole FIG. 150 Perspective view of reverse protruding seal spout outer frame with attached studded flanges FIG. 151 Front view of reverse protruding seal spout inner frame flange FIG. 152 Side view of reverse protruding seal inner frame flange FIG. 153 Perspective view of reverse protruding seal spout inner frame flange FIG. 154 Front view of reverse protruding seal spout seal FIG. 155 Front view of reverse protruding seal spout sliding door FIG. 156 Side view of reverse protruding seal spout sliding door FIG. 156-1 Back view of reverse protruding seal spout sliding door FIG. 157 Perspective view of reverse protruding seal spout sliding door FIG. 158 Bottom view of the alternative seal spout with attached studded flanges FIG. 159 Bottom view of alternative seal spout with attached studded flanges connected to bag with spout open FIG. 160 Side section view of alternative seal spout outer frame with attached studded flanges FIG. 160-1 Front view of alternative seal spout inner frame flange FIG. 160-2 Bottom view of bag showing template and cut out holes FIG. 160-3 Front view of alternative seal FIG. 161 Exploded front view of alternate seal spout outer frame with components FIG. 162 Front view of bag with alternative seal spout attached to bottom of bag FIG. 163 Back view of alternative seal spout sliding door with attached handle FIG. 164 Side view of alternative seal spout sliding door with attached handle FIG. 165 Front view of alternative seal spout outer frame showing alternative sliding door base FIG. 166 Side sectional view of alternative seal spout outer frame, showing sliding door in track FIG. 167 Side view of alternative seal spout outer frame with sliding base FIG. 168 Front view of u/j-shape bracket seal spout bag holder FIG. 169 Side view of u/j-shape bracket seal spout bag holder FIG. 170 Front view of u/j-shape bracket seal spout bag holder with seal spout attached to bag FIG. 171 Front view of u/j-shape bracket seal spout bag holder with alternative seal spout attached to bag FIG. 172 Bottom view of u/j-shape frame with u/j hooks bracket seal spout bag holder FIG. 172-1 Front view of horse shoe shape frame with u/j hooks seal spout holder FIG. 172-2 Bottom view of horse shoe shape frame with u/j hook seal spout holder FIG. 172-3 Side view of horse shoe shape frame with u/j hooks seal spout holder FIG. 172-4 Front view of horse shoe shape frame with u/j hooks seal spout holder with bag inside holder with alternative and protruding seal spout attached to bag FIG. 173 Perspective view of the u/j-shape bracket seal spout bag holder screwed to wall, holding bag with attached seal spout and end user dispensing food FIG. 174 Perspective view of seal spout attached to bag on table with end user dispensing product in bowl FIG. 175 Perspective view of the u/j-shape bracket seal spout bag holder screwed to wall, holding bag with attached alternative seal spout and end user dispensing product into bowl FIG. 176 Perspective view of reverse protruding seal spout attached to bag with end user pouring product FIG. 177 Exploded side view of seal spout showing outer frame with attached studded flanges, seal, inner frame with partial hole views. The depiction of how a seal spout will attached to bag, container or flat surface.

Most bag/container reseal-able access point's seals differ from the seal spouts because they are permanently attached to the bag or container and don't provide ergonomics. The seal spouts will allow you to disassemble them and put it onto another bag, container or any flat surface that is meant to contain product. The multiple spout seal versatility will be used to contain freshness and dispense or pour product without a mess. These products will save the end user money by being able to keep product in bag or container without purchasing another container or bag with a lid or reseal-able access point. The bag or container that comes with seal is general thrown away or does not come with a seal or spout to access product easily without a mess that provide ergonomics. The bags with no access point are immediately thrown away, which will cause more waste. Using the seal spout as a re-sealable access point will cut down on so many bags being thrown away so fast and will reduce plastic containers/bags that eventually end up as waste. The seal spouts will help out with the green movement by cutting down on waste. The seal spouts can be switch from bag to bag or container to container by simply releasably detaching and sterilizing/cleaning if it is a different product before attaching it to another bag, container or flat surface with or without no re-sealable access point/seal. Note this seal spouts can also be used in a manufacturing aspect and provide the end user with a more ergonomic seal, pouring, or dispensing apparatus. A person or end user will use the seal spouts to maintain freshness and access product in a more convenient way with ergonomics. The seal spout will give the end user a better seal with less mess and stress on body. The end user will pull sliding door outward to have product dispense or push sliding door inward to close and seal spout. The seal spouts will also save time, money and be less strain on your back than bags/containers with or without reseal-able access points. The seal spouts will save you time and give you the option, not to have to lift and open bag or container. The end user will simply attached seal spout and sit it upright to access product at their convenience without lifting bag or container; therefore, saving your back. The seal spouts will save you money, by actually utilizing the bag or container the product came in opposed to buying a container or bag with a resealable access point. Even if the end user buys a bag or container it will not have the feature of sitting it upright to dispense product without moving or lifting bag or container; therefore, making it more ergonomically better for body. The end user can seat bag in the u/j-shape seal spout bag holder opposed to sitting it on table and to allow for extra space. The ender may also use the optional horse shoe frame u/j hook seal, spout holder to seat bag into and dispense product. Last if the end user prefers to pour the product, they can simply turn the bag the in reverse and pour product. Note these seal spouts can make bags and container manufactures products more efficient to use and can be cheaply manufactured on bags and containers. The seal spout can produce other products with added electronics/mechanical functions and computer functions that will allow for automatic dispensing into bowls, tanks, etc. The seal spouts can be put onto bags, containers or flat surfaces which contain rice, dog food, coffee, cat food, bird food, flour, corn mill, seasoning, beans, rice, fertilizer, cat litter, driveway salt, seeds, pellets, charcoal wood chips, candy, soap powder, . . . etc. The seal spouts will be used to easily dispense or pour product and maintain freshness.

DETAIL DESCRIPTION OF THE INVENTION

Version 1 Seal Spout

Figure 8:
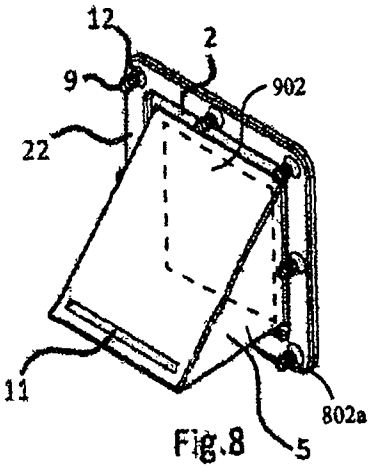
Figure 9:
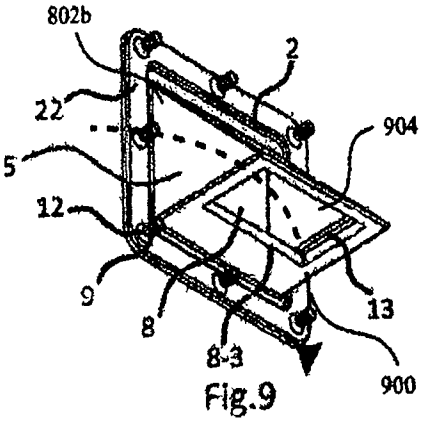

Reference to FIG. 3, the reusable seal spout assembly of the present invention comprises a spout 5, a plurality of fasteners 9, an inner frame flange 4, a sliding door 3 and, optionally, a template/seal 8-1. The spout 5 further comprises an outer flange 22, two side walls 802*a* and 802*b* (FIGS. 3 and 8) spaced apart from each other and extending away from two side edges 804*a* and 804*b* (FIG. 3) of a frontal face 806 (FIG. 3) of the outer flange 22 and a top wall 803 (FIG. 3) extending away from a top edge 808 (FIG. 3) disposed between the two side edges 804*a* and 804*b* of the frontal face 806 (FIG. 3) of the outer flange 22. The top wall 803 (FIG. 3) and the two side walls 802*a* and 802*b* together define a passageway 900 (FIG. 9) extending between an inlet 902 (FIG. 8) opening at the outer flange 22 and an outlet 904 (FIG. 9) opening away from the inlet 902 (FIG. 9). The plurality of fasteners 9 project out from the frontal face 806 of the outer flange 22. The sliding door 3 is slidingly mounted through a slot 11 (FIG. 3) disposed at the top wall 803 of the spout 5. The sliding door 3 is operable to slide inside the passageway 900 to any selected position between a first position in which the sliding door completely blocks the passageway 900 and a second position in which the sliding door 3 completely opens the passageway 900. The spout 5 can be releasably attached to a bag or container after making a cut out hole 8-2 (FIG. 3-1) in the container or bag. The cut out hole 8-2 made in the bag 22-1 (FIG. 2) is geometrically shaped to correspond to the shape of the outer flange 22 and the size of the cut out hole 8-2 is made equal to or less than an inside area of the outer flange 22 as illustrated in FIG. 3-1. The reusable seal spout assembly of the present invention is assembled to hold the perimeter section 812 (FIG. 3-1) of the cut out hole 8-2 tightly between the frontal face 806 of the outer flange 22 positioned facing an inner side 814 (FIG. 2) of the perimeter section 812 and the inner frame flange 4 positioned on the exterior side 816 of the perimeter section 812 which receives the fasteners 9. After being attached to the bag 22-1, the snout S enables controlled release of a product from inside the bag through the passageway 900.

Figure 16:
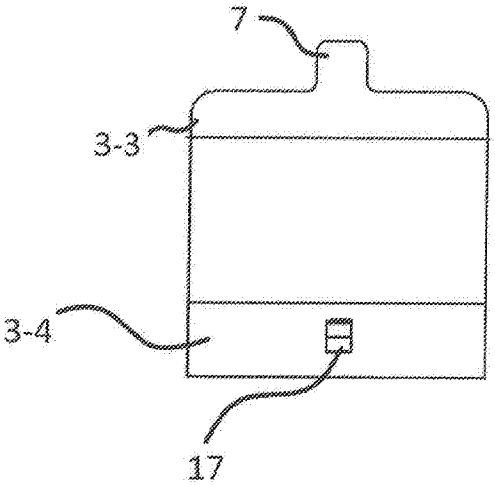
Figure 17:
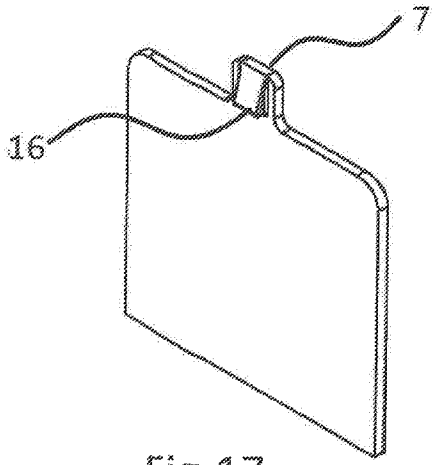
Figure 14:
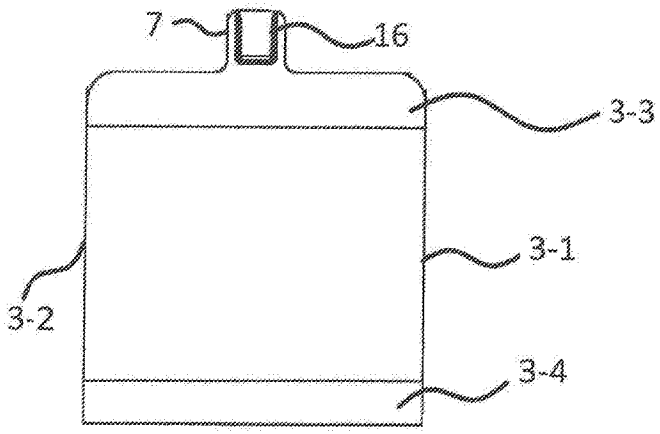
Figure 23:
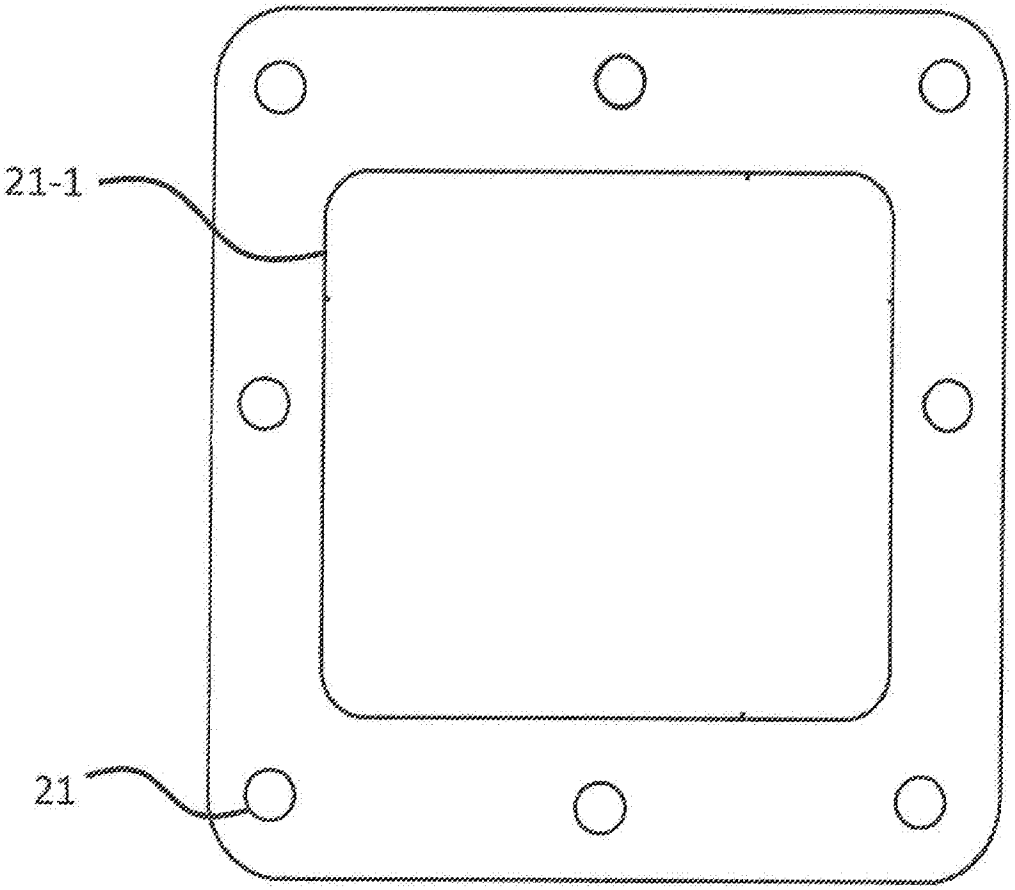
Figure 178:
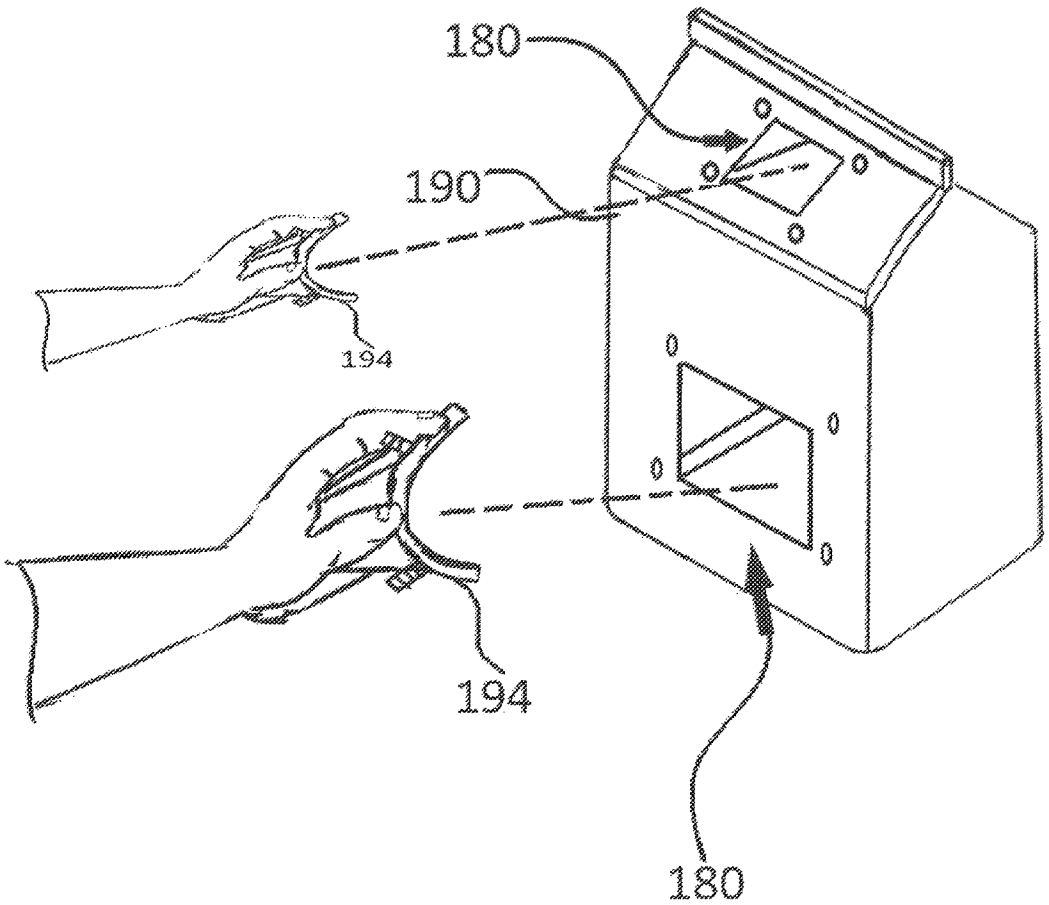
FIG. 178 Perspective view of seal spout outer frame being squeezed to be place inside top FIG. 180 Side view of screw/bolt nut stud seal spout FIG. 181 Exploded view of screw/bolt nut stud seal spout FIG. 182 Perspective view of bag with cut out template holes FIG. 183 Perspective view of bag screw/bolt nut stud seal spout attached to bag FIG. 184 Top view of screw/bolt nut stud seal spout outer frame FIG. 185 Side view of screw/bolt nut stud seal spout outer frame FIG. 186 Bottom view of screw/bolt nut stud seal spout outer frame FIG. 187 Perspective view of screw/bolt nut stud seal spout outer frame FIG. 188 Back view of screw/bolt nut stud seal spout outer frame showing opening for screw/bolt FIG. 189 Front view of screw/bolt nut stud seal spout outer frame showing recessed holes on outer flange FIG. 190 Front view of screw/bolt nut stud seal spout inner flange FIG. 191 Perspective of view of screw/bolt nut stud seal spout inner flange FIG. 192 Side view of screw/bolt nut stud seal spout inner flange FIG. 193 Front view of screw/belt nut stud seal spout seal FIG. 194 Perspective view of screw/bolt nut stud seal spout seal FIG. 195 Side view of screw/bolt nut stud seal spout seal FIG. 196 Front view of screw/bolt nut stud seal spout sliding door FIG. 197 Back view of screw/bolt nut stud seal spout sliding door FIG. 198 Side view of screw/bolt nut stud seal spout sliding door FIG. 199 Perspective view of screw/bolt nut stud seal spout sliding door FIG. 200 Exploded view of screw/bolt nut stud seal spout showing all components with partial view of outer frame flange, inner flange and seal FIG. 201 Exploded view of alternative screw/bolt nut stud seal spout showing all components with partial view of outer frame flange, inner flange and seal FIG. 202 Explode view of screw/bolt nut stud showing all component with outer frame installed inside bag with threaded stud protruding out of bag

If the user decides to put the version 1 protruding seal spout on a bag (FIG. 3-1), the consumer will have two choices. The recommend choice will be to place bag on flat surface and chose an area on the lower bottom of bag and use the template/seal (FIG. 23) to cut out holes on bag if the bag has no access point. The other chose will be to open the bag if it has a re-sealable access to point to place protruding seal spout outer frame (FIG. 8) inside bag after template holes are cut out. The template holes 6 may be marked and cut out on bottom of bag to dispense most of product by gravity. The end user may use the Version 1 seal spout that will be releasable attachable to bag, container or flat surface by using the seal spout template (FIG. 23) to mark holes. The template/seal (FIG. 23) will be the first steps on tracing template holes 6 on bag (FIG. 3-1) container or flat surface to attach outer frame protruding seal spout (FIG. 3) with attached threaded studs 9 to bag (FIG. 3-1) or container. Once the bag spout cut out holes 8-2 and bag threaded stud holes are marked the end user can use a box cutter or something of the nature to cut along lines of marked areas and remove bag material for cut out holes. The end user will place the protruding seal spout outer frame inside the bag spout cut-out hole 8-2 by squeezing the flexible protruding seal spout outer frame (FIG. 3) with attached threaded studs 9 and placing it through bag spout cut out hole 8-2. FIG. 178 depicts the end user squeezing the seal spout to place it inside of bag 190 cut out holes 180. The end user will then un-squeeze protruding seal spout outer frame (FIG. 3) with attached threaded studs 9 and it will return back to its original form inside bag. The end user will then manipulate the protruding seal spout outer frame (FIG. 3) with attached threaded studs 9 to make sure there is not any product around or on top of outer flange 22. The end user will then make sure the bag spout cut out hole 8-2 are disposed evenly around protruding seal spout outer frame (FIG. 3) with attached threaded studs 9 spout 5. The end will then begin mating the threaded studs 9 on outer flange 22 of the protruding seal spout outer frame (FIG. 3) through the bag cut out stud holes 8-3 and make sure bag, container or flat surface material is flush around the threaded studs 9 base and spout 5. Now that the bag material is laying flush against the outer flange 22 the end user will then place template/seal 8-1 which may double as a seal over threaded studs 9. The holes 21 on the template/seal 8-1 will mate with threaded studs 9 on outer flange 22 and center hole 22 of template/seal 8-1 and dispose flush around spout 5. The template/seal 8-1 is now laying flush against bag material. The end user will now place the inner frame flange 4 over the spout 5. The inner frame flange 4 center hole 15 will dispose around spout 5 of protruding seal spout outer frame (FIG. 3) with attached threaded studs 9 and then the holes on inner frame flange 4 will mate with threaded studs 9 on outer flange 22 of protruding seal spout outer frame (FIG. 3). The inner frame flange 4 is now laying flush against the seal/template 8-1. Now the seal/template 8-1, bag material, container material or flat surface material is between the outer flange 22 with threaded studs 9 and inner frame flange 4 the end user will now screw wing nuts 1 on threaded studs 9. The end user may loosely screw the wing nuts 1 onto all of the threaded studs 9. The end user will then tighten up the wing nuts 1 diametrically applying pressure to the inner frame flange 4 causing the bag material, template/seal 8-1 to be sandwich together tightly between the outer flange 22 with threaded studs 9 and inner frame flange 4 to make a tight seal. The end user will install the sliding door 3 last by sliding into protruding seal spout outer frame (FIG. 3) spout 5 slot 11. As the sliding door (FIG. 14) mate with slot 11, the left edge 3-2 and right edge 3-1 of sliding door (FIG. 14) will mate with right and left tracks 13 within protruding seal spout outer frame (FIG. 9) spout 5. The end user can now turn the bag (FIG. 4) right side up and pull the sliding door 3 open to dispense product or close to stop dispensing product. Looking at (FIG. 174) the bag 190 with attached protruding seal spout 194 can be placed on a table 218 or looking at (FIG. 173) the bag 190 can be seated into seal spout bag holder 192 to dispense product 222 into bowl 216 or any container. Looking at (FIG. 176), the ender user can also pour product out product by simply turning the bag 190 in reverse, once the level of the product is low in bag 190 and can't be no long dispensed or if it is the end user preference. The sliding door (FIG. 16) may have a door stop 17 to help prevent the sliding door (FIG. 17) from sliding out of slot completely when end user pulls opens sliding door (FIG. 17) to dispense product. The sliding door (FIG. 14) may also have a raised handle 16 to help the ender open door ergonomically.

Version 2 Seal Spout

Figures 1, 24, 25, 26, 27:
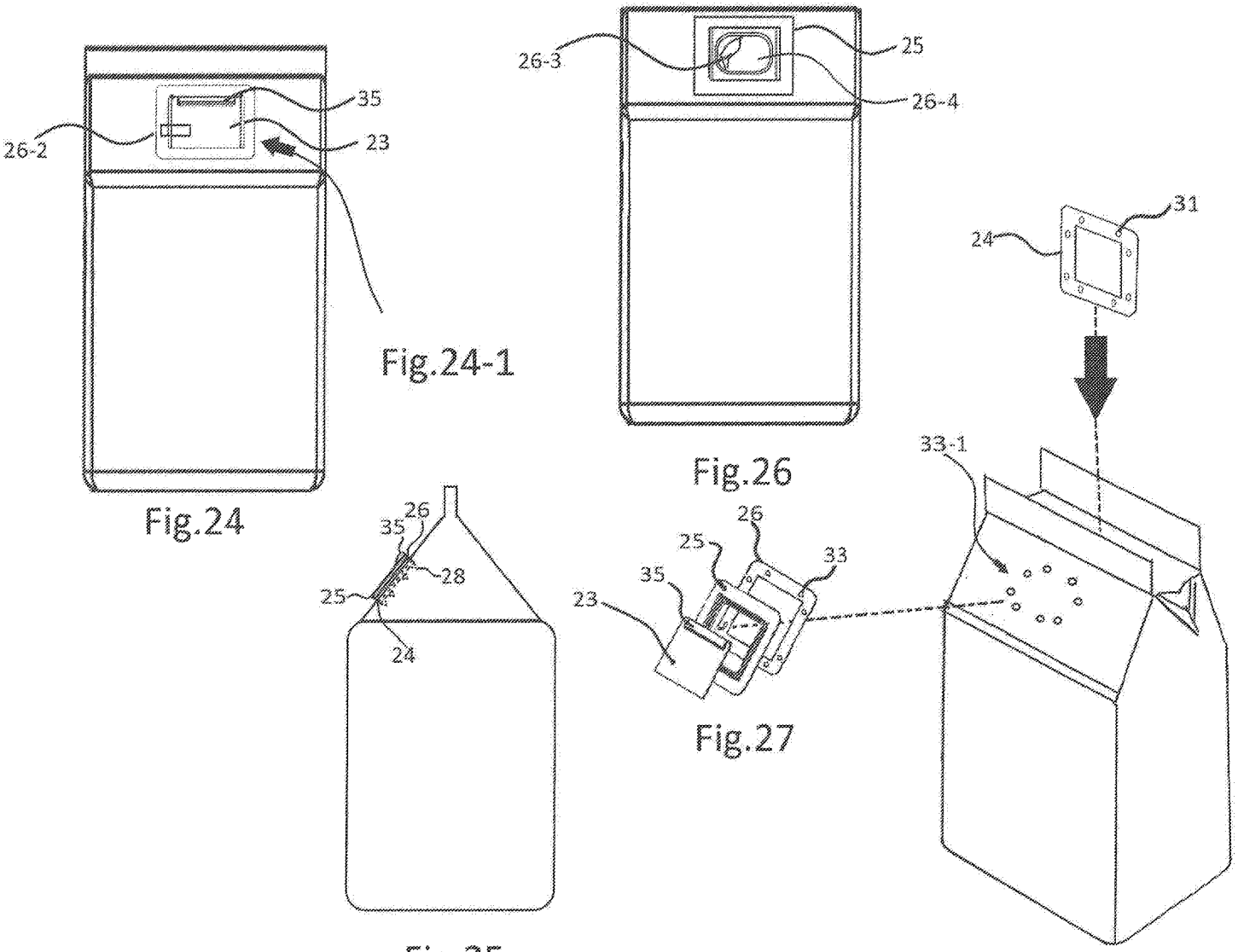
Figure 32:
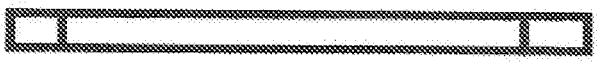
Figure 31:
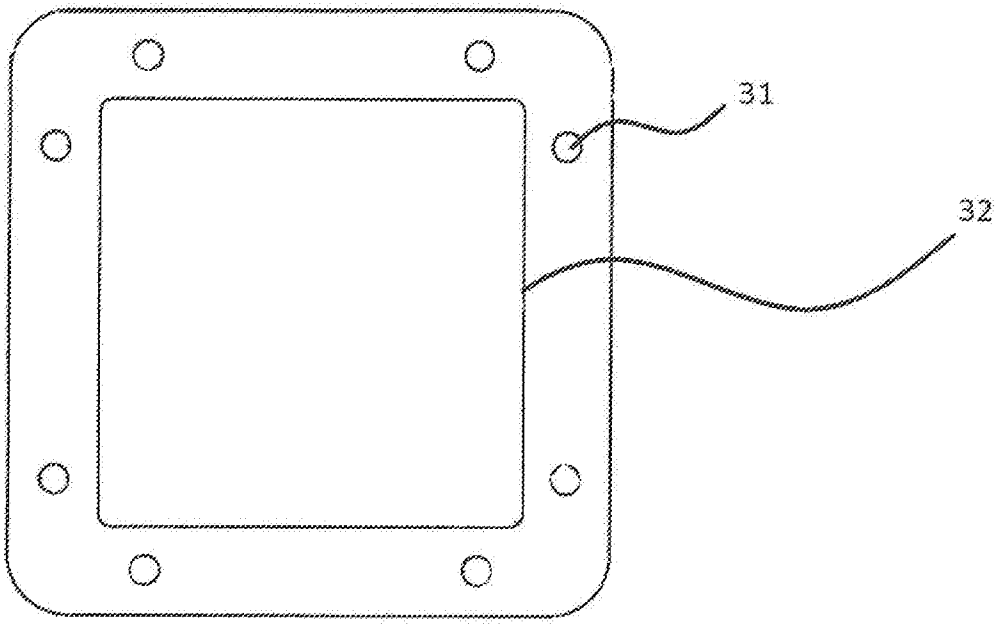
Figure 34:
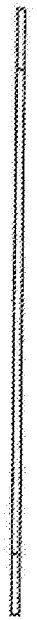
Figure 33:
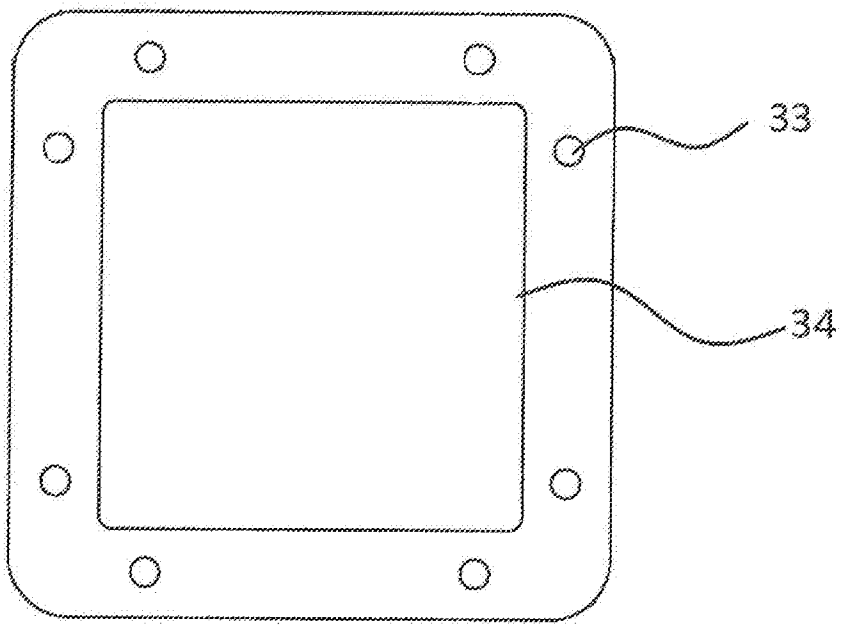
Figure 36:
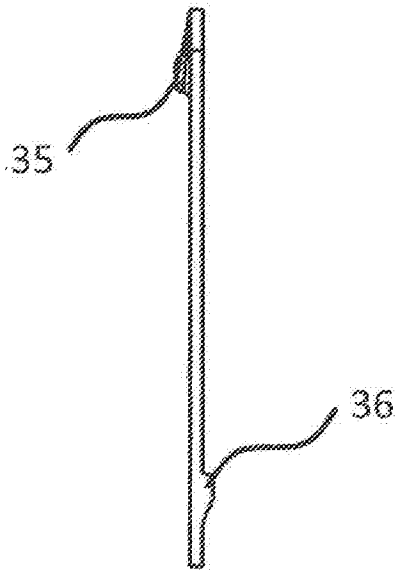
Figure 35:
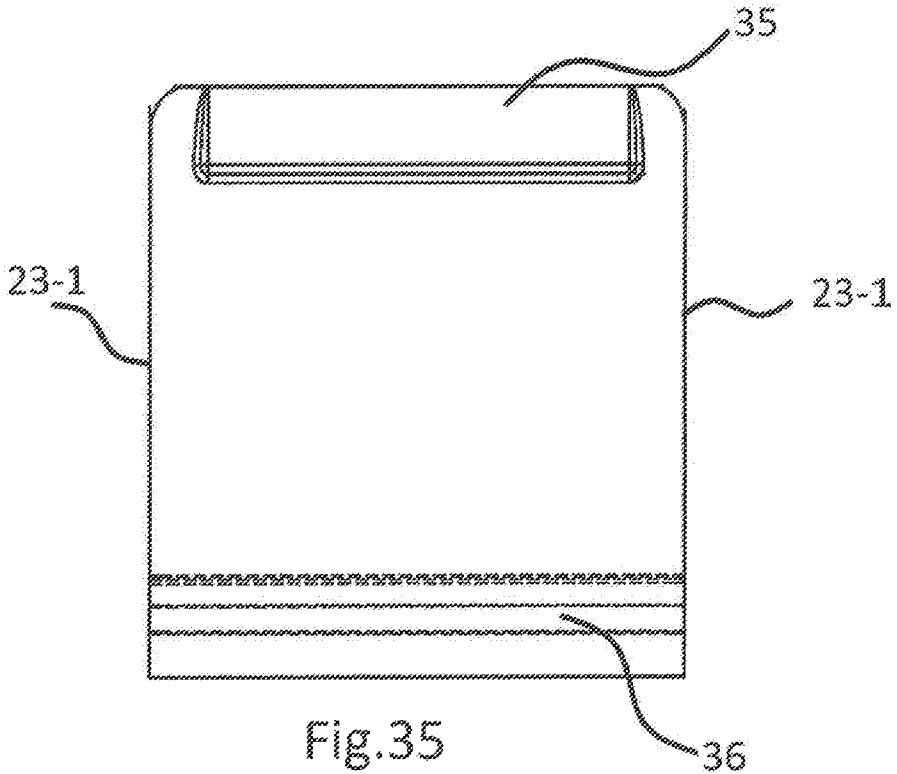

The assembly of version 2 seal spout will be assembled using some of the same principle parts as Version 1 seal spout, however; version 2, spout will be mainly used for manufacturing but could also be used by consumer as a universal seal spout for bags, containers or flat surfaces to pour products. The bag (FIG. 27-1), container or flat surface will be prepare with template holes 33-1 so the sliding door seal spout (FIG. 30) outer frame with male snap fasteners 28 can be pressed through material of container, bag (FIG. 27-1) or flat surface template holes 33-1. The sliding door seal spout outer frame (FIG. 28) can be place inside or outside bag and the male fastener could be on either side. The sliding door seal spout outer frame (FIG. 28) will be placed outside or inside the bag, container or flat surface by a human or machine. When the sliding door seal spout outer frame (FIG. 28) is placed outside of bag (FIG. 26), container or flat surface. The sliding door (FIG. 35) will be already assemble with tamper seal 26-2 in sliding door seal spout outer frame (FIG. 24-1). The sliding door (FIG. 35) right edge 23-1 and left edge 23-2 will mate with female right track 27 and left track 27-1 on sliding door seal spout outer frame (FIG. 29). The sliding door seal spout outer frame (FIG. 29) may have a door seal to seal door. The worker will put the sliding door seal spout outer frame (FIG. 30) male snap fasteners 28 through seal (FIG. 33) holes 33 and then the male snap fasteners 28 will go through corresponding template holes 33-1 on bag (FIG. 27-1), container or flat surface material. The worker will then put inner frame flange 24 inside bag (FIG. 27-1) container or flat surface. The inner frame flange 24 holes 31 line up with male snap fasteners 28 on outer frame (FIG. 30). The worker will use a press to push sliding door seal spout outer frame (FIG. 30) with male snap fasteners 28 through inner frame flange (FIG. 31) holes 31. This process will sandwich the bag, container or flat surface material between the sliding door seal spout outer frame 25, seal 26 and inner frame flange 24 looking at (FIG. 25) The version 2 seal spout is now assembled on bag (FIG. 24), container or flat surface. The human or machine will then seal bag. The bag or container will be ready for product to be poured or accessed once. Once the bag, container or flat surface reaches end user with product inside. Then the end user will break tamper seal 26-2 on outer frame with sliding door install (FIG. 24-1) by opening sliding door 23. The end user will cut and remove enough bag material 26-3 to allow for product to pour out of bag (FIG. 26) hole 26-4. The end user will close sliding door 23 to seal bag (FIG. 24), container or flat surface to keep product fresh once end user is done pouring product. Note version 2 seal spout can also be assemble using a machine/computer with same process.

Also note the end user can cut bag (FIG. 27-1) template holes 33-1 by using inner frame flange 24 as template to place outer frame 25 an a container, bag (FIG. 27-1) or flat surface. The end user will be able to releasable attach the outer frame, seal to bag and then place the inner frame inside of bag. The end user will press against the inner frame while the outer frame with seal installed on bag is lying flat against table. The ender user will have sliding seal spout attached to bag. Note this will work on bags that can be opened and closed with an existing resealable access point. The end user can detach the outer frame from inner frame by squeezing the male fastener so it can be released from each hole of inner frame. The inner frame holes will mate with outer frame male snap fasteners. Once the outer frame male snap fasteners are secured into inner frame holes the sliding door seal spout is now assembled. Looking at FIG. 27-1 depicts how the components interact with other. The siding door will go into outer frame 25, then the seal 26 will be place onto outer frame 25 and then onto bag (FIG. 27-1). The inner frame flange 24 go inside of bag and be press together with outer frame 25. The outer frame 25 male snap fasteners will mate with inner frame flange 24 holes 31 and securely attach sliding door seal spout to bag (FIG. 25) Note the sliding door seal spout can be releasable attachable to bag like version 3 seal spout with male or female snap faster being on reverse side of sliding door outer frame (FIG. 30) The only difference will be the sliding door opening vs having an protruding spout.

Version 3 Seal Spout

Figures 1, 40:
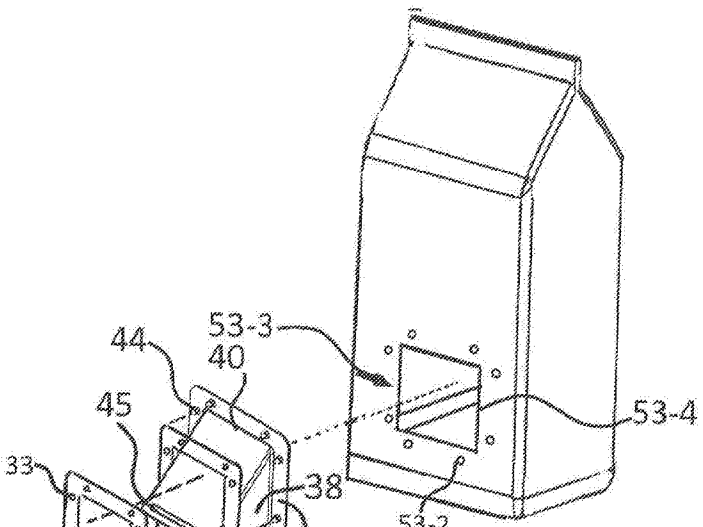
Figure 40:
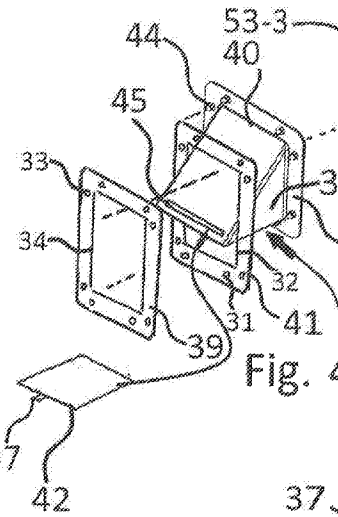
Figure 41:
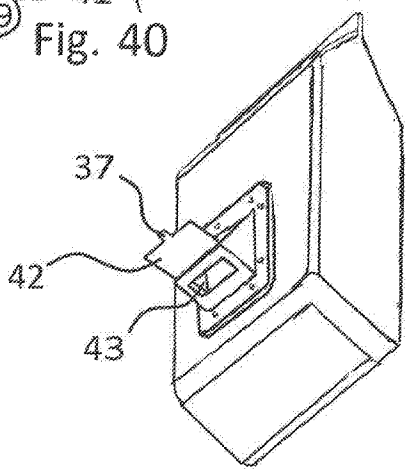
Figure 39:
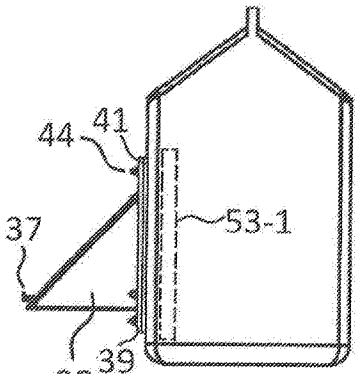
Figure 37:
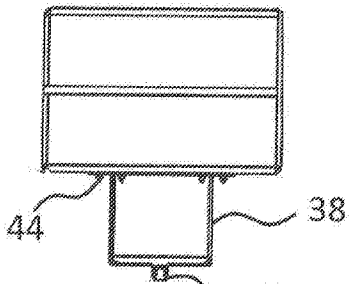
Figure 38:
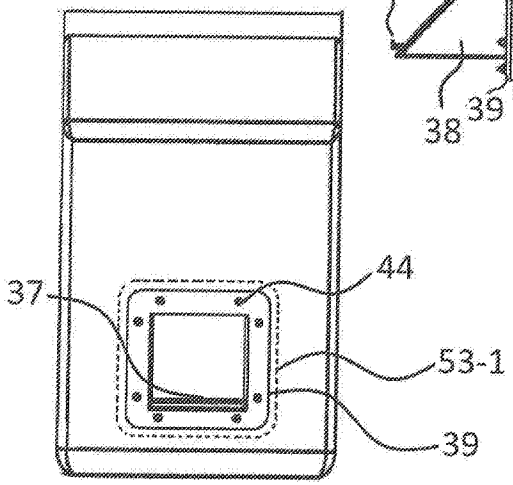
Figure 42:
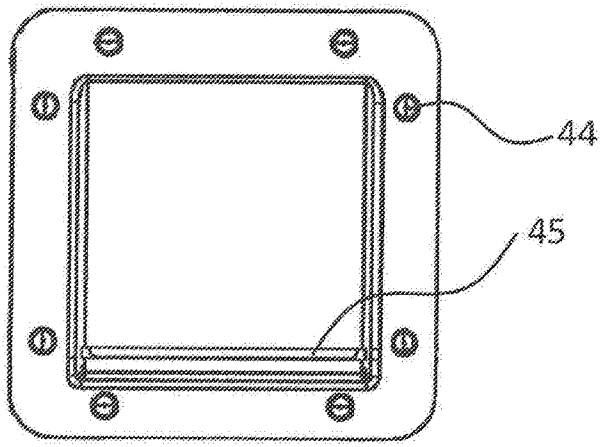
Figure 47:
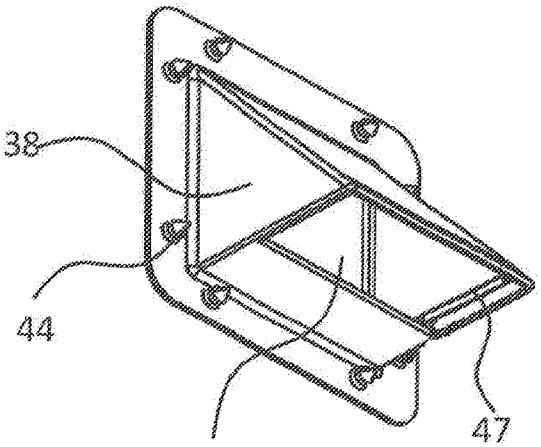
Figure 50:
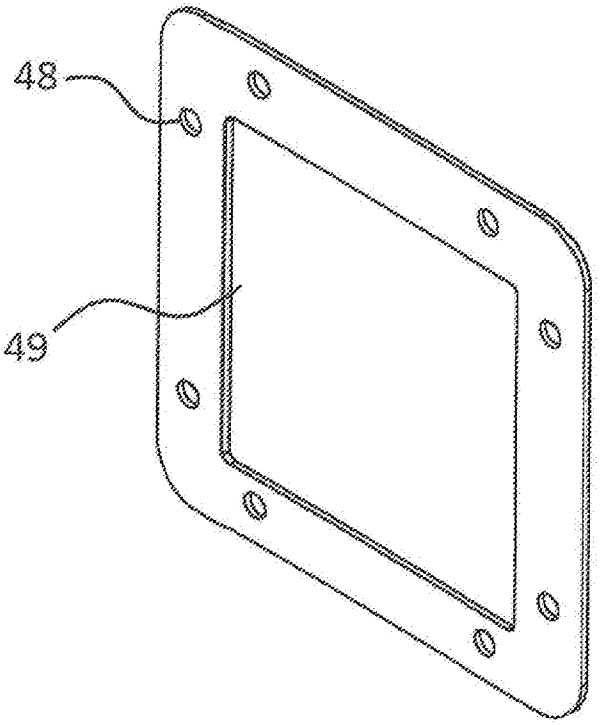
Figure 49:
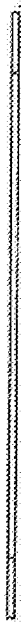
Figure 51:
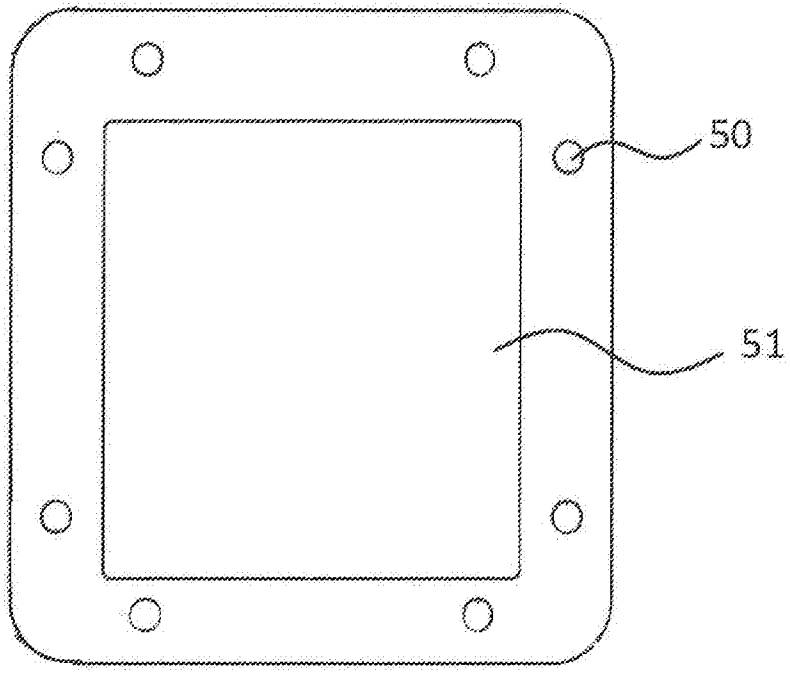
Figure 56:
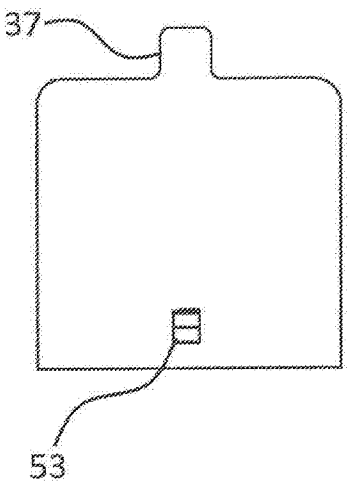
Figure 57:
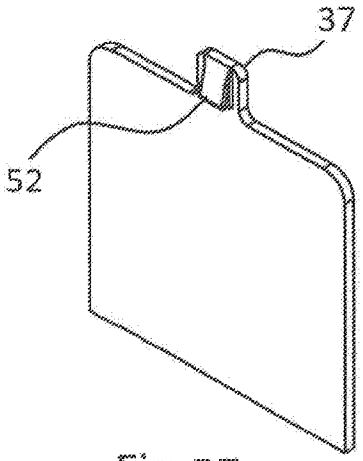
Figure 54:
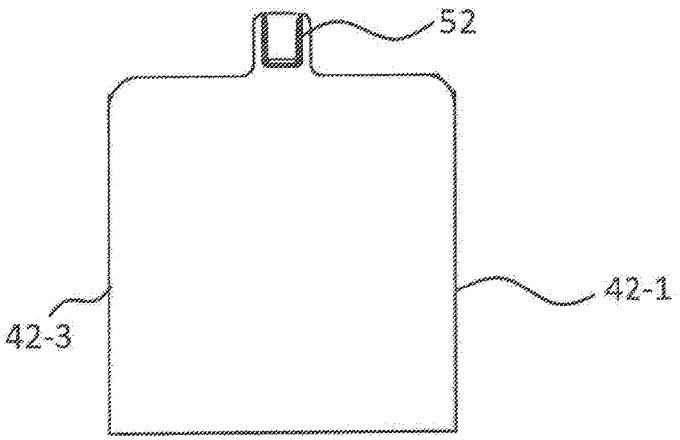
Figure 55:
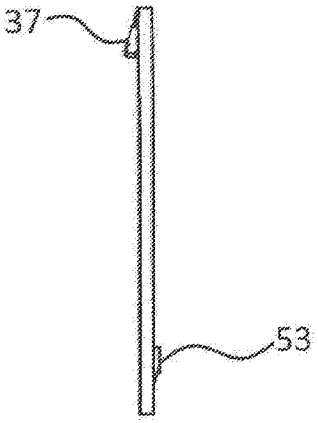

The version 3 seal spout will use same interworking principals as version 1 seal spout and have some of the same part as the previous version seal spouts presented. The version 3 seal spout will be used mainly in a consumer setting allowing for end user to piece this seal spout on bag, container or flat surfaces. Version 3 seal spout can also be manufactured by human or machine/computers using the same method as version 1, 2 and other versions presented. This version will be releasable attachable like previous versions. The template/seal (FIG. 51) will be the first step on tracing template holes 53-3 on bag (FIG. 40-1) container or flat surface to attach outer frame protruding seal spout (FIG. 40) with attached threaded studs 44 to bag (FIG. 40-1) or container. Once the template holes 53-3 are marked the end user can use a box cutter or something of the nature to cut along lines and remove bag, container or flat surface material for bag spout cut out holes 53-4. The end user will place the protruding seal spout outer frame (FIG. 40) with male snap fasteners 44 in bag spout cut-out hole 53-4, by squeezing the flexible protruding seal spout outer frame (FIG. 40) with male snap fasteners 44 and placing it through bag spout cut out hole 53-4. The end user will then un-squeeze protruding seal spout outer frame (FIG. 40) with attached male snap fasteners 44 and it will return back to its original form in bag (FIG. 40-1). The end user will then manipulate the protruding seal spout outer frame (FIG. 40) with attached male snap fasteners 44, to make sure there is not any product around outer flange 53-1. The end user will then make sure the bag spout cut out hole 53-4 is disposed evenly around protruding seal spout outer frame (FIG. 40) with attached male snap fasteners 44 spout 38. The end will then begin mating the attached male snap fasteners 44 on outer flange 53-1 of the protruding seal spout outer frame (FIG. 40) until the bag material is flush around male snap fasteners 44 base and spout 38. Now that the beg material is laying flush against the outer flange 53-1 the end user will then place template/seal 41 which may double as a seal or template over the spout 38 and attached male snap fasteners 44. The holes 31 on the template/seal 41 will mate with attached male snap fastener 44 on outer flange 53-1 and center hole 32 of template/seal 41 and will dispose flush around spout 38. The template/seal 41 is now laying flush against bag material. The end user will now place the inner frame flange 39 over the spout 38. The inner frame flange 39 center hole will dispose around the spout 38 of protruding seal spout outer frame (FIG. 40) with attached male snap fasteners 44 and then the holes 33 on inner frame flange 39 will mate with attached male snap fasteners 44 on outer flange 53-1 of protruding seal spout outer frame (FIG. 40). The end user will press around each hole 33 of inner frame 39 holes to make the attached male snap fastener 44 snap into hole of inner frame 39 The inner frame flange 39 is now lay flush against the seal/template 41. The inner frame 39, seal/template 41, bag material or container material is being sandwiched between the outer flange 53-1 with attached male snap fasteners 44 on protruding outer frame (FIG. 40) making a tight seal. The end will install the sliding door 42 last by sliding it into the protruding seal spout outer frame (FIG. 40) with attached male snap fasteners 44 slot 45. As the sliding door (FIG. 54) mate with slot 45 on protruding seal spout outer frame (FIG. 40), the left 42-3 and right edges 42-1 of sliding door (FIG. 54) will mate with right and left tracks 47 within protruding seal spout outer frame spout (FIG. 47). The end user can now turn bag (FIG. 41) right side up and pull the sliding door 42 open to dispense food or push sliding door inward 42 to close and stop dispensing. Looking at (FIG. 174) the bag 190 with attached protruding seal spout 194 can be placed on a table 218 or looking at (FIG. 173) the bag 190 can be seated into u/j seal spout bag holder 192 to dispense product 222 into bowl 215 or any container. Looking at (FIG. 176), the ender user can also pour product out by simply turning the bag in reverse, once the level of the product is low in bag and can't be no long dispensed or if it is the end user preference. The sliding door (FIG. 56) may have a door stop 53 to help prevent the sliding door (FIG. 56) from sliding out completely of slot when ender user opens sliding door (FIG. 56). The door (FIG. 54) may also have a raised handle 52 to help the end user open door ergonomically.

Version 4 Seal Spout

Figures 1, 61:
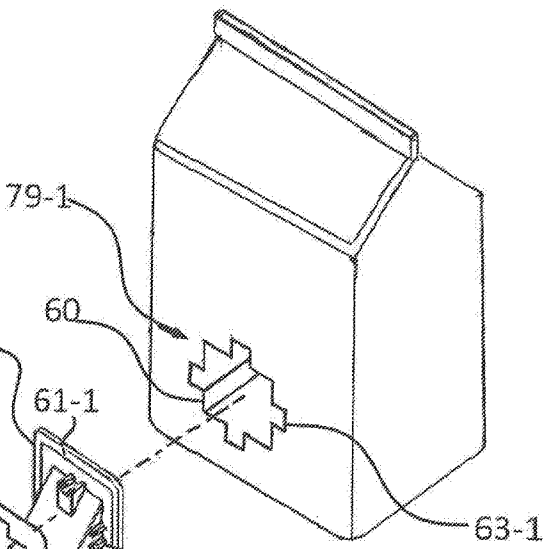
Figure 62:
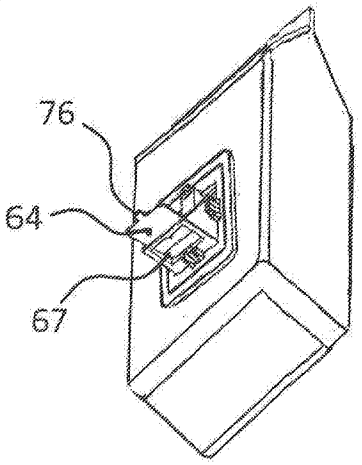
Figure 61:
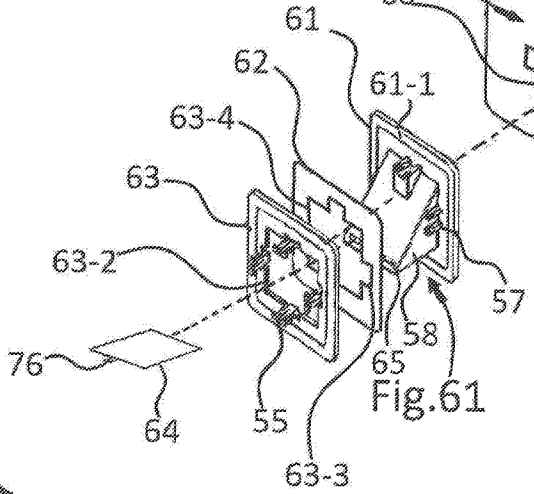
Figure 60:
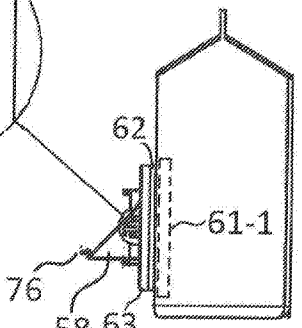
Figure 58:
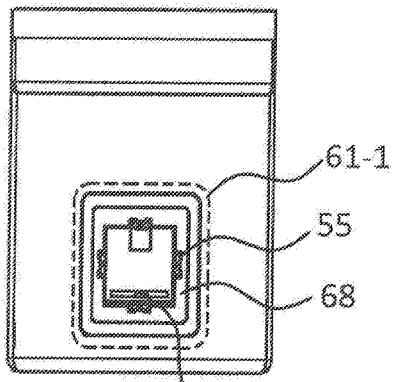
Figure 66:
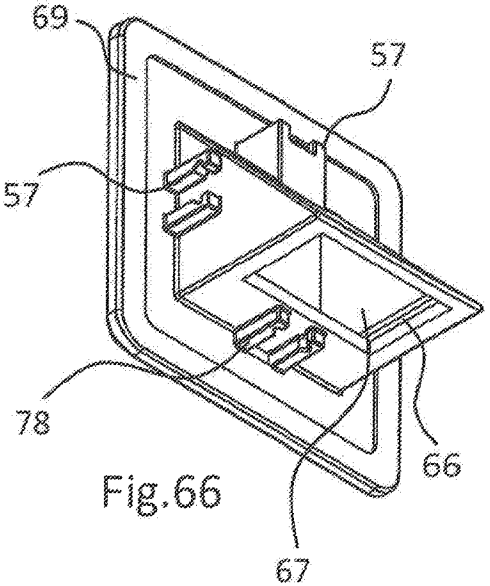
Figure 65:
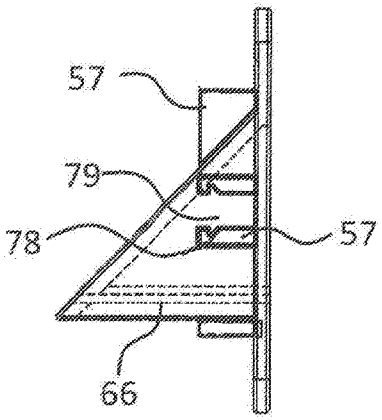
Figure 77:
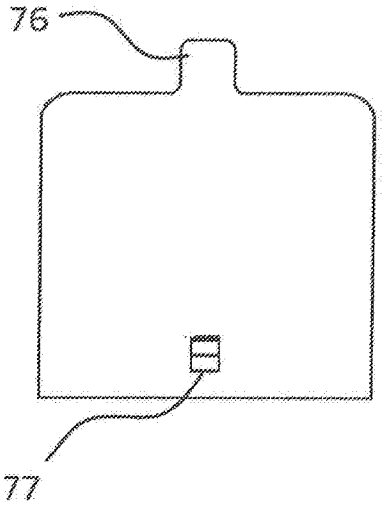
Figure 78:
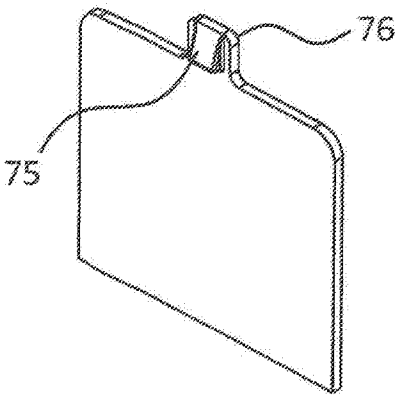
Figure 75:
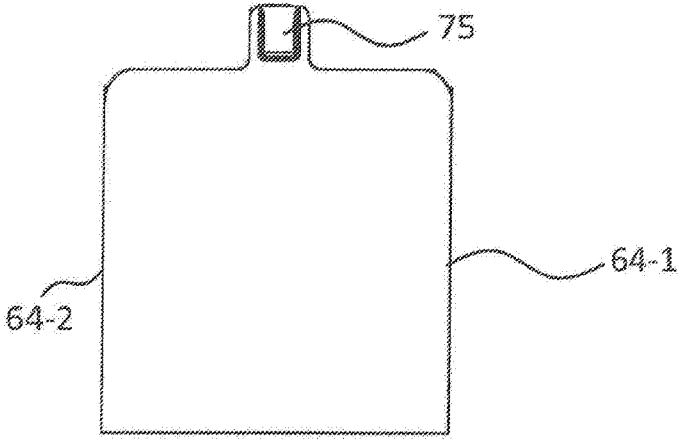
Figure 76:
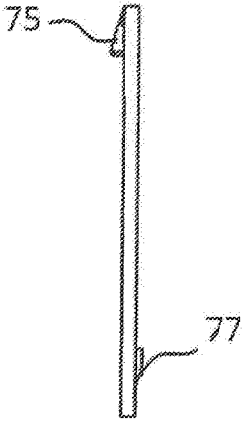

The version 4 seal spout will use the same interworking principles and use some of the same parts as the other seal spout version presented. The version 4 seal spout will mainly be used by the consumer to add to an existing bag, container or flat surface to dispense, pour product and keep fresh. This version 4 seal spout will be used on bags, containers or flat surfaces that don't have resealable access point mainly but could also be used on bag with reseal-able access points. The version 4 seal spout can also be manufacture like version 2 and other version seal spout using the same process. This seal spout will be releasable attachable to an bag, container or flat surface that contain product. The template/seal (FIG. 73) will be the used first to trace template hole 79-1 on bag (FIG. 61-1), container or flat surface to attach outer frame protruding seal spout (FIG. 61) with attached female clips 57 inside bag (FIG. 61-1) or container. Once the template holes 79-1 are marked the end user can use a box cutter or something of the nature to cut along lines and remove bag, container or flat surface material for bag spout cut out hole 60 and female clips cut out hole 63-1. The end user will place the protruding seal spout outer frame (FIG. 61) with attached female clips 57 inside of bag spout cut out hole 60 and/female clip cut out hole 63-1, by squeezing the flexible protruding seal spout outer frame (FIG. 61) with attached female clips 57 and placing it through bag spout cut out hole 60 and female clip cut out hole 63-1. The end user will then un-squeeze protruding seal spout outer frame (FIG. 61) with attached female clips 57 and it will return back to its original form in bag (FIG. 61-1). The end user will then manipulate the protruding seal spout outer frame (FIG. 61) with attached female clips 57, to make sure there is not any product around outer flange 61-1. The end user will then make sure the bag spout cut out hole 60 and female clips cut out holes 63-1 are disposed evenly around protruding seal spout outer frame (FIG. 61) with attached female clips 57 spout 58. The end user will also make sure the bag, container or flat surface material is flushed around attached female clips 57 that are around spout 58. Now that the bag material is laying flush against the outer flange 61-1 the end user will then place template/seal 62 which may double as a seal and template over the spout 58 and then the attached female clip 57 that are around the spout 58. The female clip cut out 63-3 areas on the template/seal will mate around female clips 57 and the center hole 63-4 of template/seal 62 dispose flush around spout 58. The template/seal 62 is now laying flush against bag material. The end user will now place the inner frame flange 63 with invert male clips 55 over the spout 58. The inner frame flange 63 with male inverted clips 55 and center hole 63-2 will dispose around the spout 58 of the protruding seal spout outer frame (FIG. 40) with attached female clips 57 and then the inverted male clips 55 on inner frame flange 63 will mate with attached female clips 57 that are around the spout 68. The end user will press each inverted male clip 55 that are on inner frame flange 63 into the corresponding female clips 57. The inner frame flange 63 with male inverted clips 55 are lock into female clips that around spout 58 protruding seal spout (FIG. 61). The inner frame flange 63 is now laying flush against the seal/template 62. The inner frame 63 with attached inverted male clips 55, seal/template 62, bag material or container material is being sandwiched between the outer flange 61-1 on protruding outer frame (FIG. 61) making a tight seal. The end will install the sliding door 64 last by sliding it into the protruding seal spout outer frame (FIG. 61) with attached female clips 57 slot 65. As the sliding door (FIG. 75) mate with slot 65 on protruding seal spout outer frame (FIG. 61), the left 64-2 and right edges 64-1 of sliding door (FIG. 75) will mate with right and left tracks 66 within protruding seal spout outer frame (FIG. 66) spout 58. The end user can now turn bag upside right and pull the sliding door 64 open to dispense product or push sliding door 64 inward to close and stop dispensing. Looking at (FIG. 174) the bag 190 with attached protruding seal spout 194 can be placed on a table 218 or looking at (FIG. 173) the bag 190 can be seated into seal spout bag holder 192 to disperse product 222 into bowl 216 or any container. Looking at (FIG. 176) the end user can also pour product out by simply turning the bag in reverse, once the level of the product is low in bag and can't be no long dispensed or if it is the end user preference. The sliding door (FIG. 77) may have a door stop 77 to help prevent the sliding door (FIG. 75) from sliding completely out of slot when the end user pulls opens sliding door (FIG. 75). The sliding door (FIG. 75) may also have a raised handle 75 to help the ender open door ergonomically.

Version 5 Seal Spout

Figure 87:
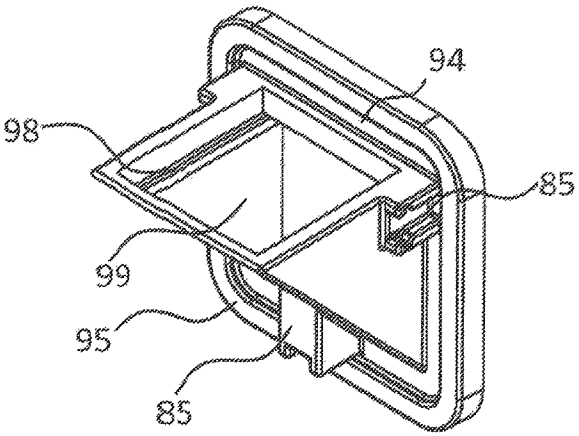
Figure 88:
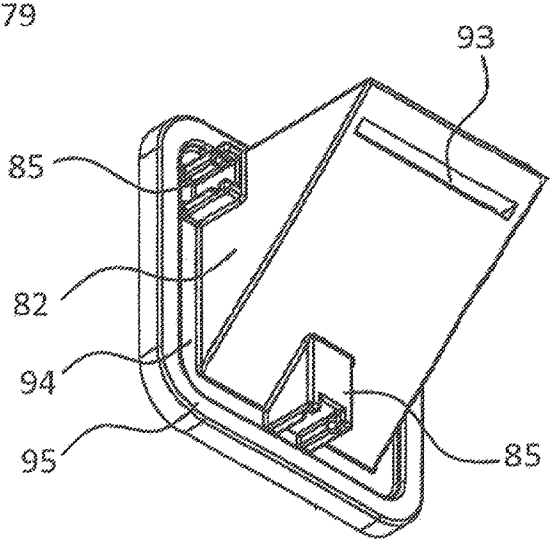
Figure 86:
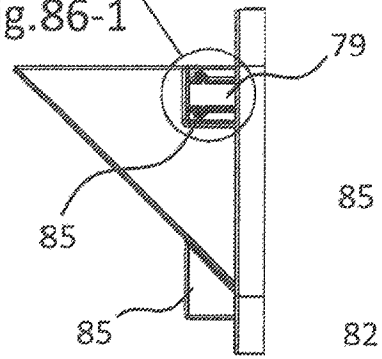
Figures 1, 86:
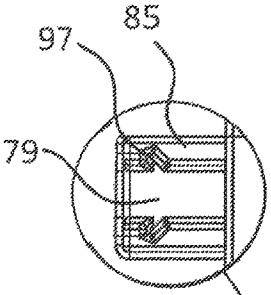
Figure 84:
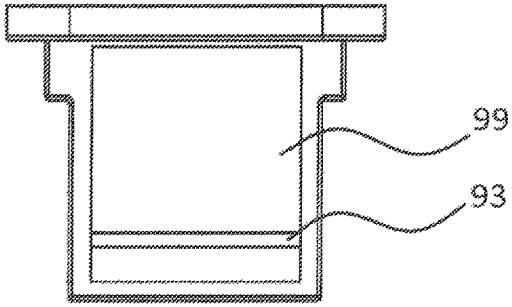
Figure 85:
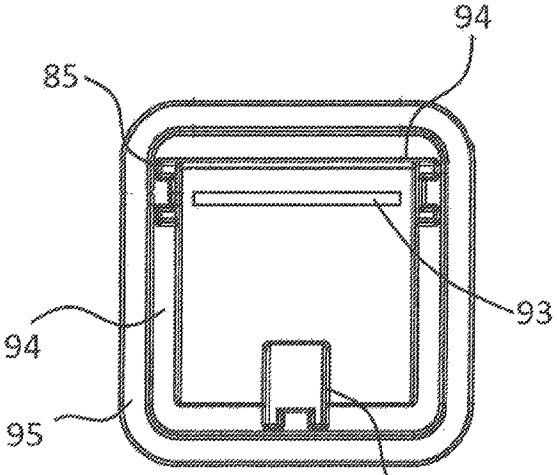
Figure 91:
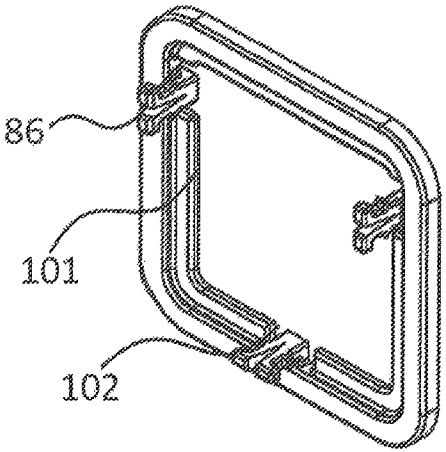
Figure 92:
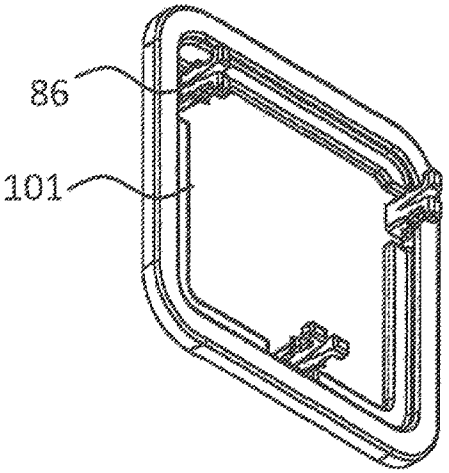
Figure 89:
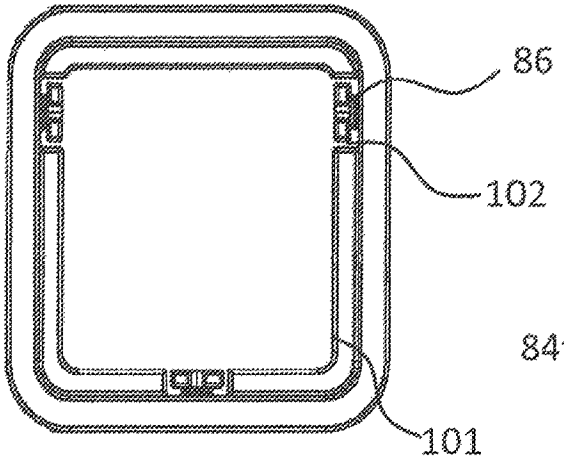
Figure 90:
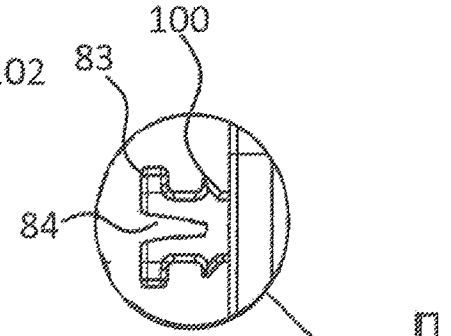
Figures 1, 90:
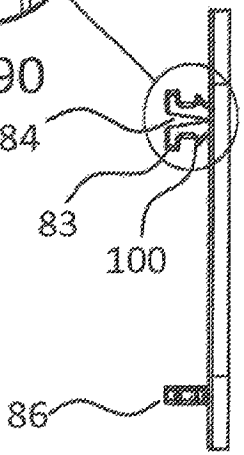
Figure 94:
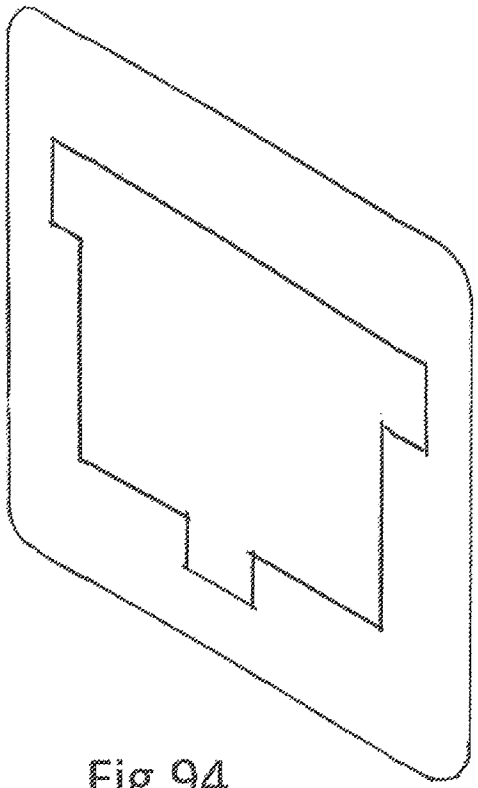
Figures 1, 93:
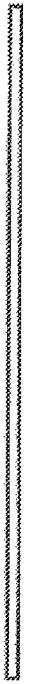
Figure 93:
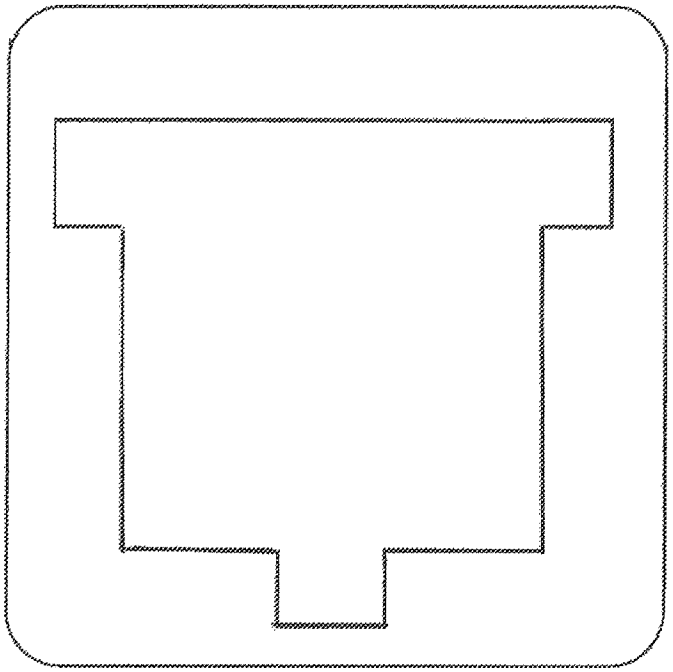
Figure 97:
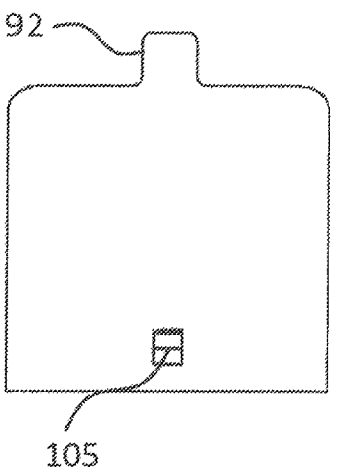
Figure 98:
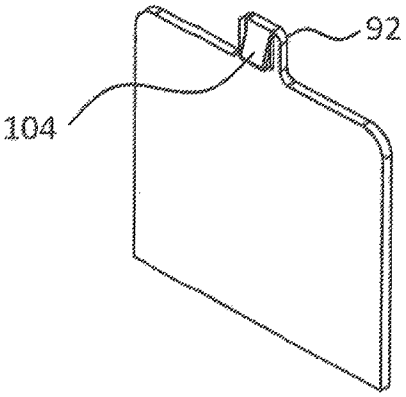
Figure 95:
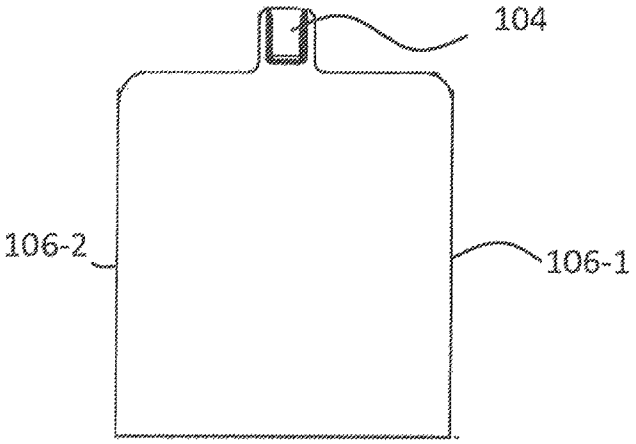
Figure 96:
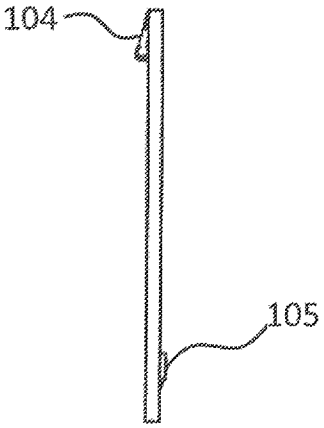

The version 5 seal spout will use the same interworking principles and use some of the same parts as the other seals out version's presented. The version 5 seal can be manufactured by humans and machines like version 2 seal spout and other version that are presented. The version 5 seal spout will be mainly used by the consumer by attaching it to existing bag, container or flat surface that contain product. The version spout 5 will be like version 1, 3, 4 but in reverse and be mainly used for pouring product. The template/seal (FIG. 93) will be used to trace template hole 91 on bag (FIG. 82-1), container or flat surface to install outer frame protruding seal spout (FIG. 82) with attached female clips 85 to bag (FIG. 82-1) or container. Once the template holes 91 are marked the end user can use a box cutter or something of the nature to cut along lines and remove bag, container or flat surface material for bag spout cut out hole 91-3 and female clip cut out holes 91-1. The end user will place the protruding seal spout outer frame (FIG. 82) with attached female clips 85 inside bag spout cut out hole 91-3 female clip cut-out hole 91-1, by squeezing the flexible protruding seal spout outer frame (FIG. 82) with attached female clips 85 and placing it through bag (FIG. 82-1) bag spout cut out hole 91-3 female clip cut-out hole 91-1. The end user will then un-squeeze protruding seal spout outer frame (FIG. 82) with attached female clips 85 and it will return back to its original form inside bag (FIG. 82-1). The end user will then manipulate the protruding seal spout outer frame (FIG. 82) with attached female clips 85, to make sure there is no product around the outer flange 88-1. The end user will then make sure the bag spout cut out hole 91-3 female clip cut-out hole 91-1 are disposed evenly around protruding seal spout outer frame (FIG. 82) with attached female clips 85 spout 82. The end user will also make sure the bag, container or flat surface material is flushed around attached female clips 85 that are around spout 82. Now that the bag material is laying flush against the outer flange 88-1 the end user will then place template/seal 87 which may double as a seal and template over the spout 82 and then the attached female clips 85 that are around the spout 82. The female clip cut out 91-2 areas on the template/seal 87 will mate around female clips 85 and center hole 91-4 of template/seal 87 will dispose flush around spout 82. The template/seal 87 is now laying flush against bag material. The end user will now place the inner frame flange 89 with inverted male clips 86 over the spout 82. The inner frame flange 89 with male inverted clips 86 and center hole will dispose around the spout 82 on the protruding seal spout outer frame (FIG. 82) with attached female clips 85 and then the inverted male clips on inner frame flange 89 will mate with attached female clips 85 that around spout 82. The end user will press each inverted male clip 86 on inner frame flange 89 into the corresponding female clips 85 that around spout 82. The inner frame flange 89 with male inverted clips 86 are lock into the female clips 85 that around spout 82 protruding seal spout outer frame (FIG. 82) The inner frame flange 89 is now lay flush against the seal/template 87. The inner frame 89 with attached inverted male clips 86, seal/template 87, bag material or container material is being sandwiched between the outer flange 88-1 on protruding outer frame (FIG. 82) making a tight seal. The end user will install the sliding door 80 last by sliding it into the protruding seal spout outer frame (FIG. 82) with attached female clips 85 slot 93. As the sliding door (FIG. 95) mate with slot 93 on protruding seal spout outer frame (FIG. 82), the left 106-2 and right edges 106-1 of sliding door (FIG. 95) will mate with right and left tracks 98 within protruding seal spout outer frame (FIG. 87) spout 82. The end user can now turn bag (FIG. 83) upside right and pull the sliding door 80 to open and pour product or push sliding door 80 inward to close and stop pouring to seal. Looking at (FIG. 176) the ender user may pour product out of bag but may still have the option to turn bag upside down and dispense product. Looking at (FIG. 174) the bag 190 with attached protruding seal spout 194 can be placed on a table 218 or looking at (FIG. 173) the bag 190 can be seated into seal spout bag holder 192 to dispense product 222 into bowl 216 or any container. The sliding door (FIG. 97) may have a door stop 105 to help prevent the sliding door (FIG. 97) from sliding out completely when end user pulls opens sliding door (FIG. 95). The sliding door (FIG. 95) may also have a raised handle 104 to help the end user open door ergonomically.

Version 6 Seal Spout

Figures 1, 99, 100, 101, 102:
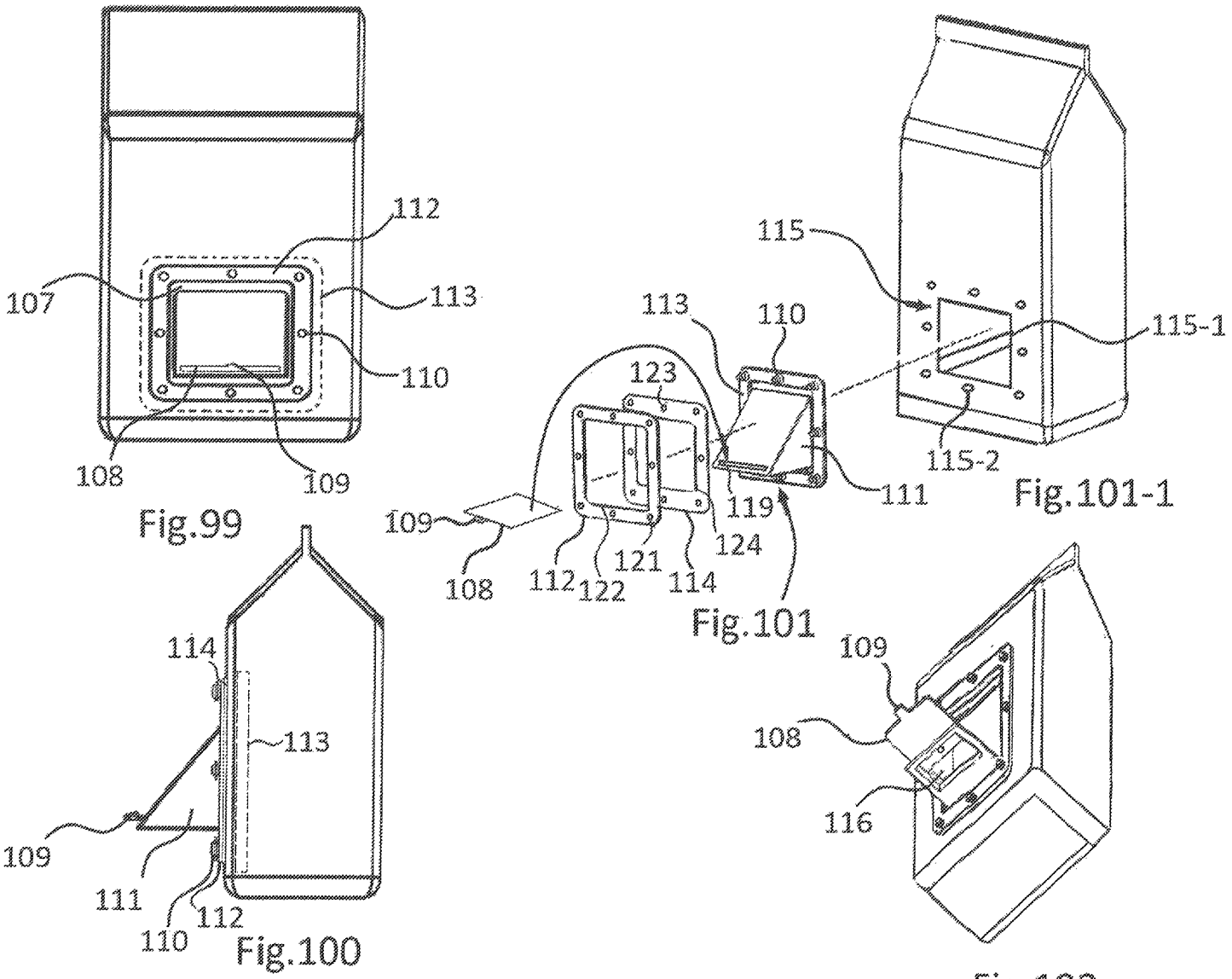
Figure 111:
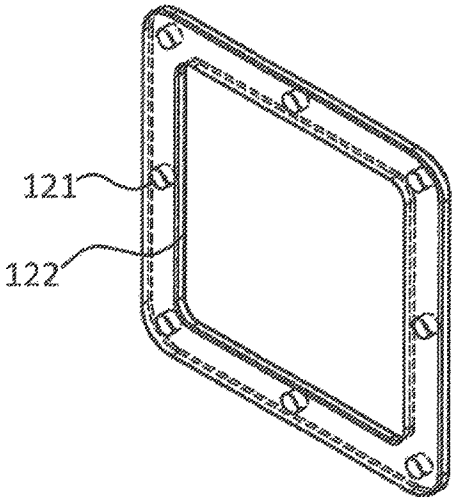
Figure 112:
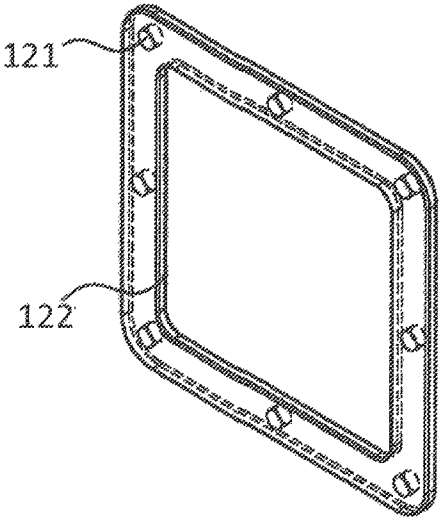
Figure 110:
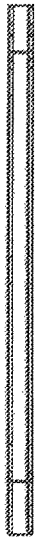
Figure 109:
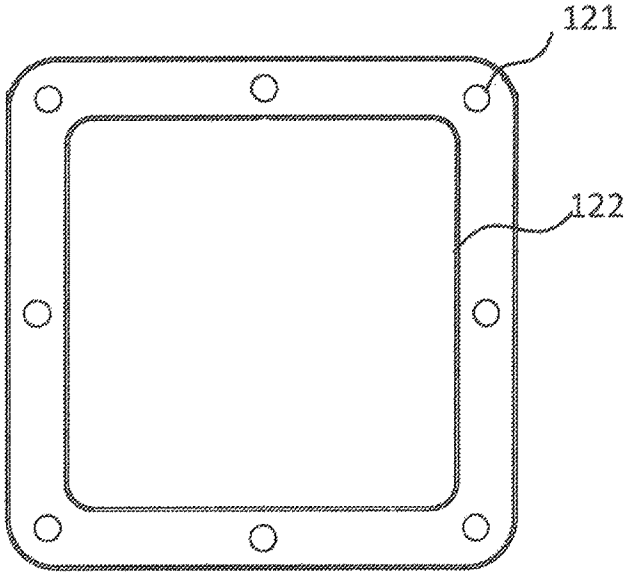
Figure 113:
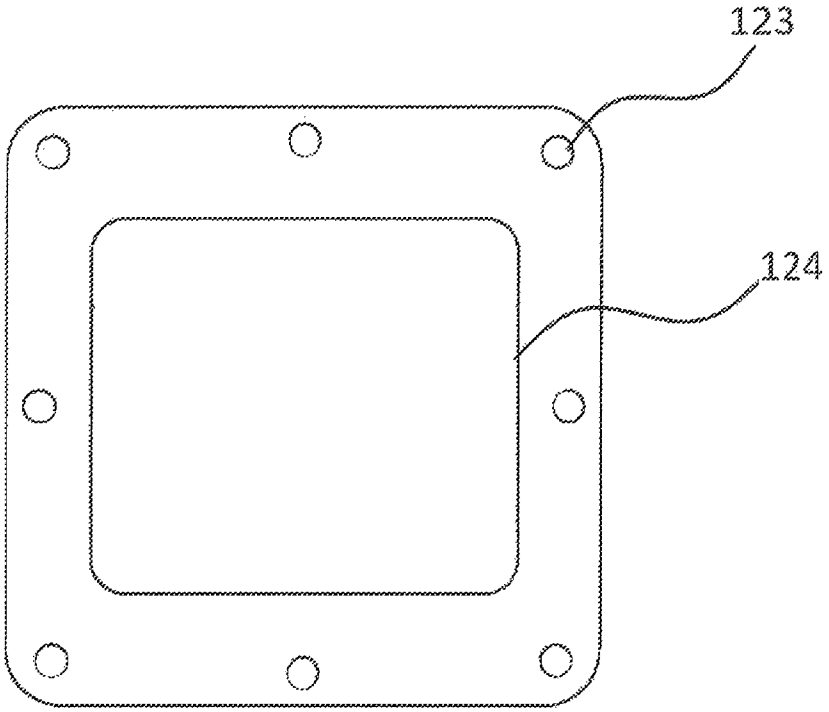
Figure 116:
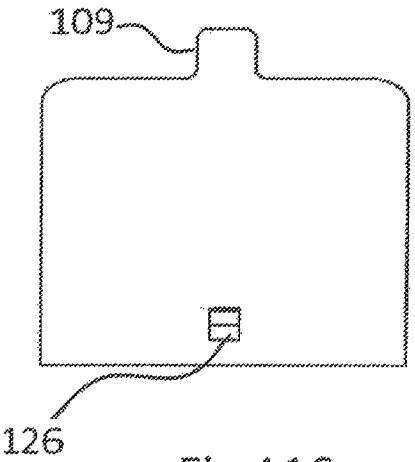
Figure 117:
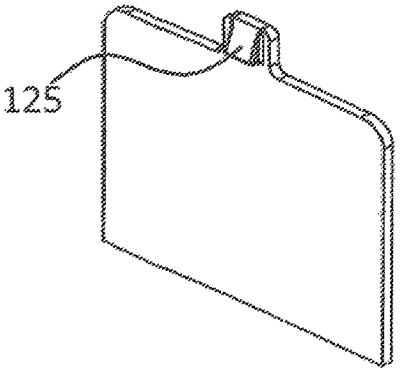
Figure 114:
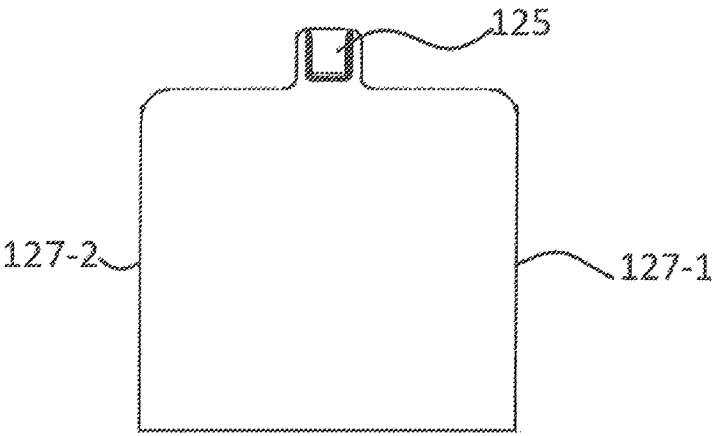
Figure 115:
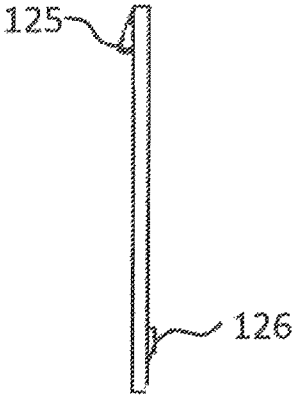

The version 6 seal spout will use same interworking principals as version 1, 3, 4 seal spout and have some of the same part as the previous version seal spouts presented. The version 6 seal spout will be used mainly in a consumer setting allowing for end user to release attach seal spout on bag, container or flat surfaces. Version 6 seal spout can also be manufactured by human or machine/computers using the same method as version 1, 2 and other versions presented. This version will be releasable attachable like previous version. The template/seal (FIG. 113) will be used to trace template holes 115 on bag (FIG. 101-1) container or flat surface to attach outer frame protruding seal spout (FIG. 101) with attached studded flanges 110 onto bag (FIG. 101-1) or container. Once the template holes 115 are marked the end user can use a box cutter or something of the nature to cut along lines and remove bag, container or flat surface material for bag spout cut out holes 115-1. The end user will place the protruding seal spout outer frame (FIG. 101) with attach studded flanges 110 inside bag spout cut-out hole 115-1, by squeezing the flexible protruding seal spout outer frame (FIG. 101) with attached studded flanges 110 and placing it through bag spout cut out hole 115-1. The end user will then un-squeeze protruding seal spout outer frame (FIG. 101) with attached studded flanges 110 and it will return back to its original form inside bag (FIG. 101-1). The end user will then manipulate the protruding seal spout outer frame (FIG. 101) with attached studded flanges 110, to make sure there is not any product around outer flange 113. The end user will then make sure the bag spout cut out hole 115-1 is disposed evenly around protruding seal spout outer frame (FIG. 101) with attached studded flanges 110 spout 111. The end will then begin mating the attached studded flanges 110 on outer flange 113 of the protruding seal spout outer frame (FIG. 101) until the bag material is flush around studded flanges 110 base and spout 111. Now that the bag material is laying flush against the outer flange 113 the end user will then place template/seal 114 which may double as a seal over the attached studded flanges 110. The holes 123 on the template/seal 112 will mate with attached studded 110 flanges on outer flange 113 and center hole 124 of template/seal 114 and will dispose flush around spout 111. The template/seal 114 is now laying flush against bag material. The end user will now place the inner frame flange 112 over the spout 111. The inner frame flange 112 center hole 122 will dispose around the spout 111 on protruding seal spout outer frame (FIG. 101) with attached studded flanges 110 and then the holes 121 on inner frame flange 112 will mate with attached studded flanges 110 on outer flange 113 of protruding seal spout outer frame (FIG. 101). The end user will press around each hole 121 on inner frame to make the attached studded flange catch the inner circumference of inner frame 112 holes 121. The inner frame flange 112 is now laying flush against the seal/template 114 and is pressing firmly against seal/template 114. The inner frame 112, seal/template 114, bag (FIG. 101-1) material or container material is being sandwiched between the outer flanges 113 with attached studded flanges 110 on protruding outer frame (FIG. 101) making a tight seal. The end user will install the sliding door 108 last by sliding it into the protruding seal spout outer frame (FIG. 101) with attached studded flanges 110 slot 119. As the sliding door (FIG. 114) mate with slot 119 on protruding seal spout outer frame (FIG. 101), the left 127-2 and right edges 127-1 on sliding door (FIG. 114) will mate with right and left tracks 120 within protruding seal spout outer frame spout (FIG. 108) spout 111. The end user can now turn bag (FIG. 102) upside right and pull the sliding door 108 to open and dispense food or push sliding door (FIG. 54) inward to close and stop dispensing. Looking at (FIG. 174) the bag 190 with attached protruding seal spout 194 can be placed on a table 218 or looking at (FIG. 173) the bag 190 can be seated into seal spout bag holder 192 to dispense product 222 into bowl 216 or any container. Looking at (FIG. 176), the ender user can also pour product out by simply turning the bag in reverse, once the level of the product is low in bag and can't be no long dispensed or if it is the end user preference. The sliding door (FIG. 116) may have a door stop 126 to help prevent the sliding door (FIG. 116) from sliding out completely when ender user opens sliding door (FIG. 116). The sliding door (FIG. 114) may also have a raised handle 125 to help the ender open door ergonomically.

Version 7 Seal Spout

Figure 125:
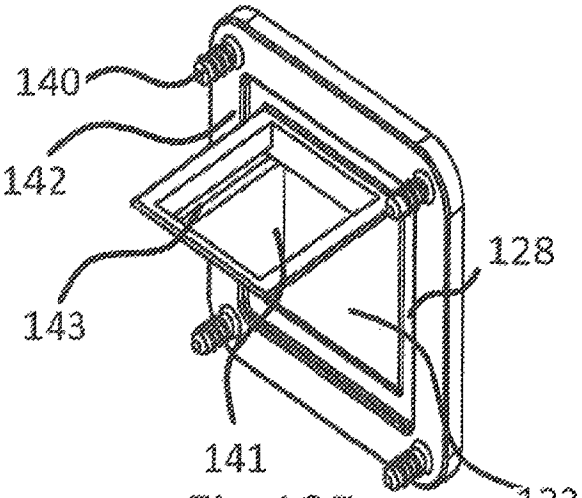
Figure 126:
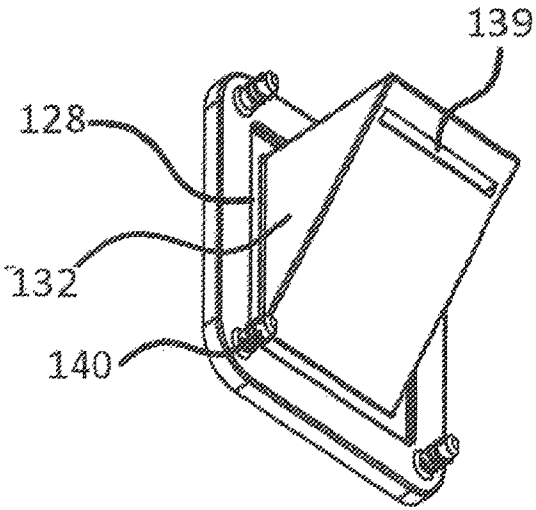
Figure 124:
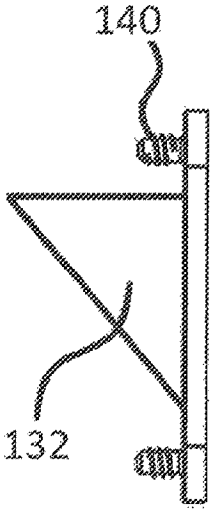
Figure 122:
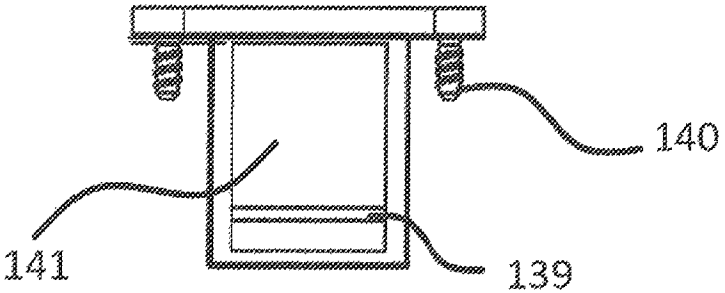
Figure 123:
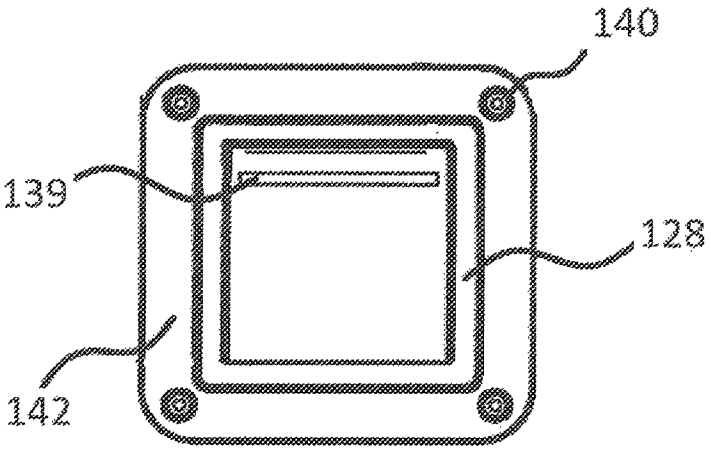
Figure 129:
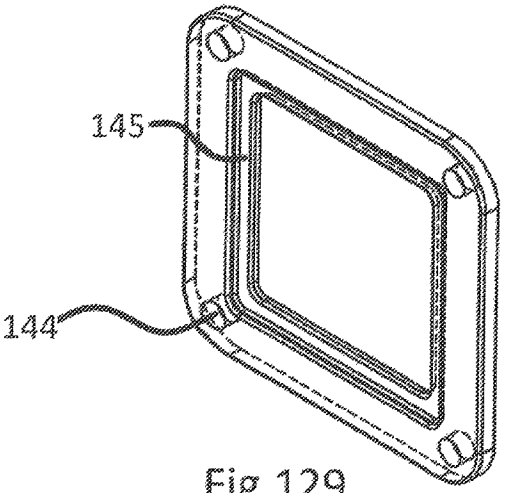
Figure 130:
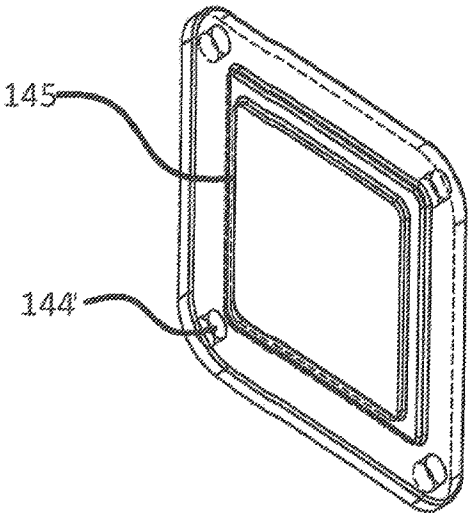
Figure 127:
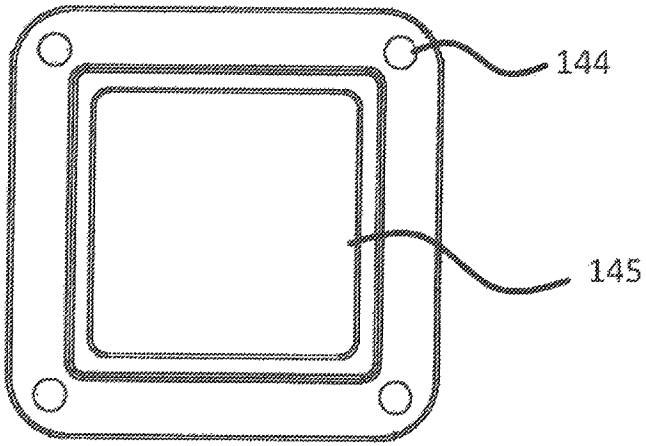
Figure 128:
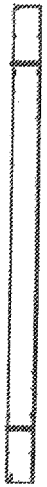
Figure 133:
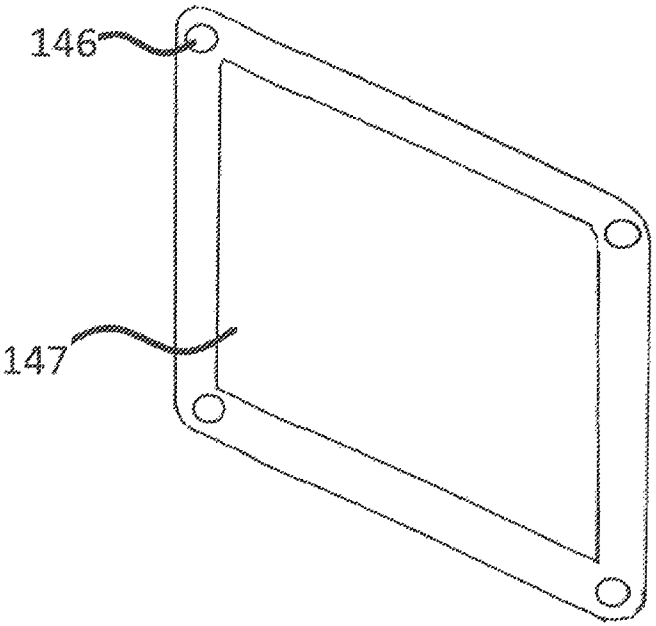
Figure 132:
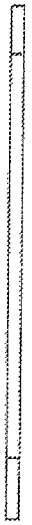
Figure 131:
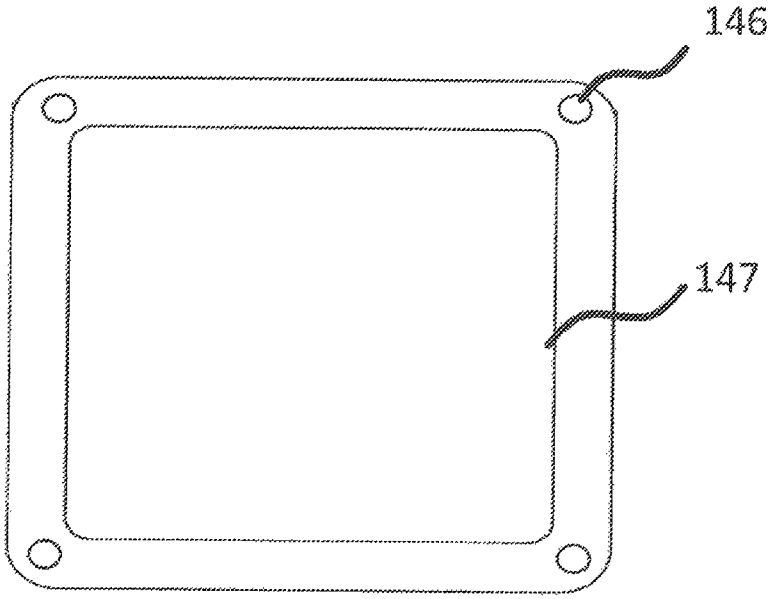
Figure 136:
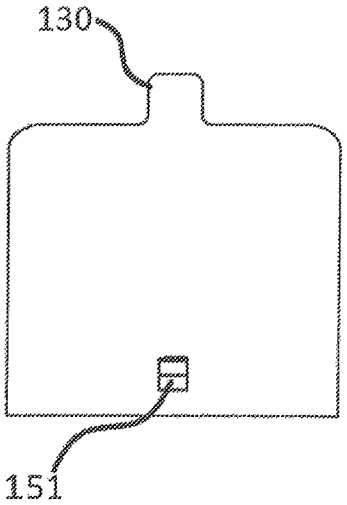
Figure 137:
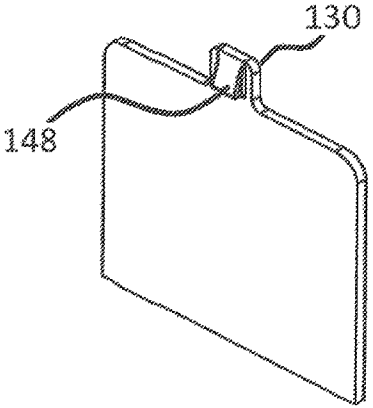
Figure 134:
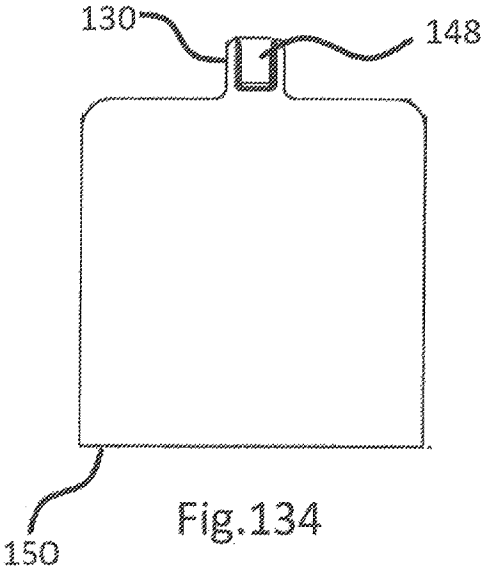
Figure 135:
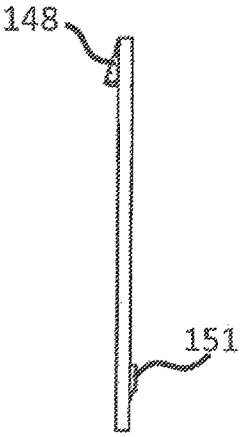
Figure 140:
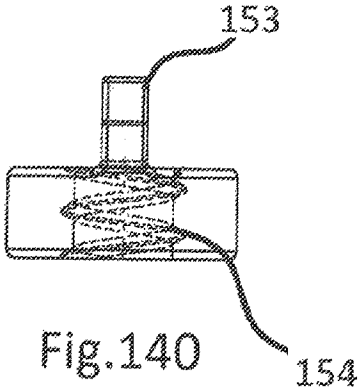
Figure 141:
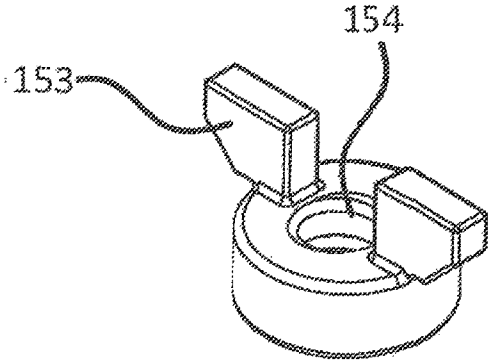
Figure 138:
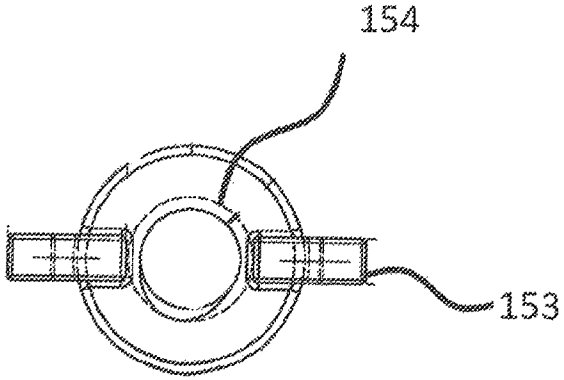
Figure 139:
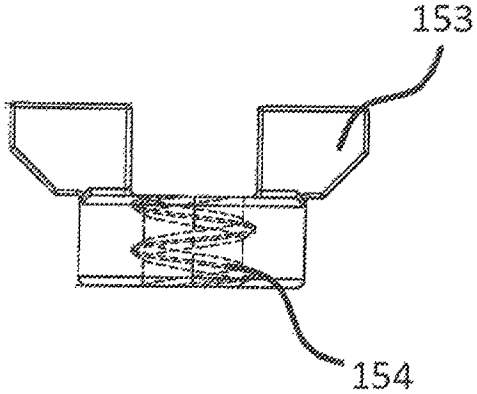

The version 7 seal spout will use the same interworking principles and use some of the same parts as the other seal spout version's presented. The version seal spout can be manufactured by humans and machines like version 2 seal spout and other versions that are presented. The version 7 seal spout will be mainly used by the consumer by attaching it to existing bag, container or flat surface that contain product. Version will be like versions 1, 3, 4, in reverse and 2, 6. The template/seal (FIG. 131) will be used to trace template holes 138-1 on bag (FIG. 120-1) container or flat surface to attach outer frame protruding seal spout (FIG. 120) with attached threaded studs 129-1 onto bag (FIG. 120-1) or container. Once the template holes 138 are marked the end user can use a box cutter or something of the nature to cut along fines and remove bag, container or flat surface material for spout cut out holes 138-1. The end user will place the protruding seal spout outer frame (FIG. 120) with attach threaded studs 129-1 inside bag spout cut-out hole 138-1, by squeezing the flexible protruding seal spout outer frame (FIG. 120) with attached threaded studs 129-1 and placing it through bag spout cut out hole 138-1. The end user will then un-squeeze protruding seal spout outer frame (FIG. 120) with attached threaded studs 129-1 and it will return back to its original form inside the bag (FIG. 120-1). The end user will then manipulate the protruding seal spout outer frame (FIG. 120) with attached threaded studs 129-1, to make sure there is not any product around outer flange 135-1. The end user will then make sure the bag spout cut out hole 138-1 is disposed evenly around protruding seal spout outer frame (FIG. 120) with attached threaded studs 129-1 spout 132. The end user will then begin mating the attached threaded studs 129-1 on outer flange 135-1 that are on the protruding seal spout outer frame (FIG. 120) with bag threaded stud hole. The end user will make sure bag material is flush around threaded stud 129-1 and spout 132. Now that the bag material is laying flush against the outer flange 135-1 the end use will then place template/seal 136 which may double as a seal or template over the spout 132 and attached threaded studs 129-1. The holes 146 on the template/seal 136 will mate with attached threaded studs 129-1 on outer flange 135-1 and center hole 147 of template/seal 136 and will dispose flush around spout 132. The template/seal 135 is now laying flush against bag material. The end user will now place the inner frame flange 134 over the spout 132. The inner frame flange 134 center hole will dispose around the spout 132 on protruding seal spout outer frame (FIG. 120) with attached threaded studs 129-1 and then the holes on inner frame flange 134 will mate with attached threaded studs 129-1 on outer flange 135-1 of protruding seal spout outer frame (FIG. 120). The end user will press around each holes 144 on inner frame flange 134 to make sure the inner frame flange 134 is flushed against seal/template 129-1 with all threads stud 129-1 pushed through inner frame flange 134 evenly. The inner frame flange 134 is now lay flush against the seal/template 135. Now the seal/template 136 bag (FIG. 120-1) material or container material is between the outer flange 135-1 with threaded studs 129-1 and inner frame flange 134, the end user will now screw wing nuts 133 onto threaded studs 129-1. The end user may loosely screw the wing nuts 133 onto all of the threaded studs 129-1. The end user will then tighten up the wing nuts 133 diametrically applying pressure to the inner frame flange 134 that will cause the bag material template/seal 136 to be sandwich together tightly between the outer flange 135-1 with threaded studs 129-1 and inner frame flange 134 to make a tight seal. The end user will install the sliding door 131 last by sliding it into the protruding seal spout outer frame (FIG. 120) with attached threaded studs 129-1 slot 139. As the sliding door (FIG. 134) mate with slot 139 on protruding seal spout outer frame (FIG. 120), the left 150 and right edges 149 on sliding door (FIG. 134) will mate with right and left tracks 143 within protruding seal spout outer frame spout (FIG. 125) spout 132. The end user can now turn the bag 121 right side up and pull the sliding door 131 to open and pour product or push sliding door 131 inward to close and seal. Looking at (FIG. 176) the end user may pour product out of bag but may still have the option to turn bag upside down and dispense product. Looking at (FIG. 174) the bag 190 with attached protruding seal spout 194 can be placed on a table 218 or looking at (FIG. 173) the bag 190 can be seated into seal spout bag holder 192 to dispense product 222 into bowl 215 or any container. Looking at (FIG. 176), the end user can also pour product out by simply turn the bag in reverse, once the level of the product is low in bag and can't be no long dispensed or if it is the end user preference. The sliding door (FIG. 136) may have a door stop 151 to help prevent the sliding door (FIG. 136) from sliding out completely when ender user opens sliding door (FIG. 134). The sliding door (FIG. 134) may also have a handle 130 with raised area 148 to help the end user open door ergonomically.

Version 8 Seal Spout

The version 8 seal spout will use the same interworking principles and use some of the same parts as the other seal spout version's presented. The version 8 seal can be manufactured by humans and machines like version 2 seal spout and other version that are presented. The version 8 seal spout will be mainly used by the consumer by attaching it to existing bag, container or flat surface that contain product. The version spout 8 will be like version 1, 3, 4, 6 but in reverse and 5 7.

Figure 7:
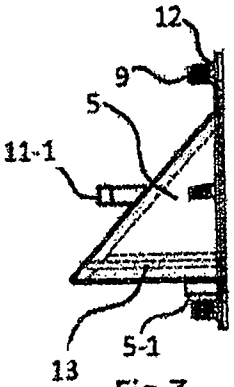
Figure 5:
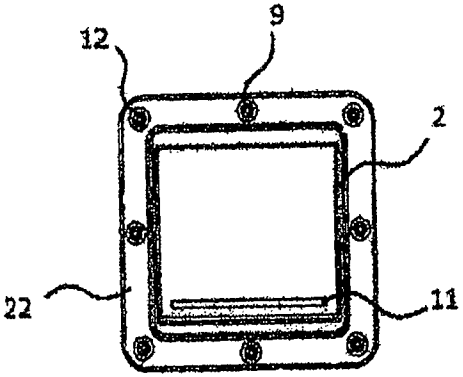
Figure 6:
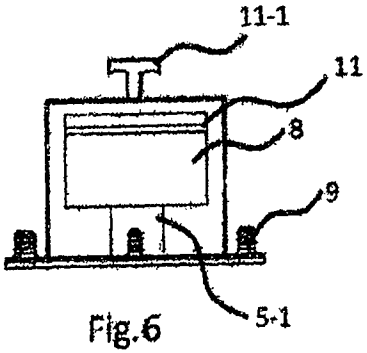
Figure 12:
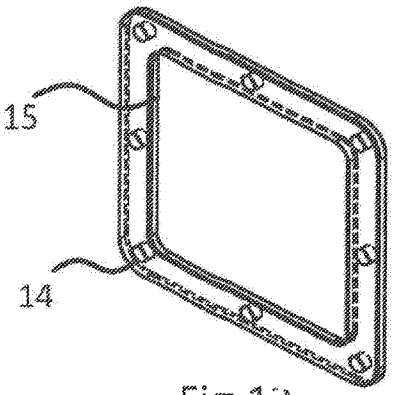
Figure 13:
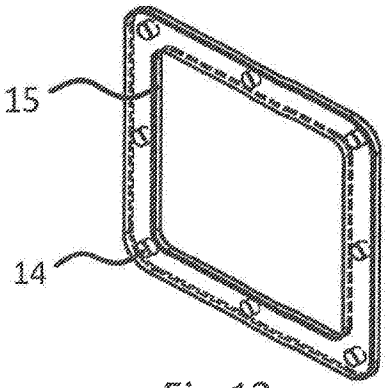
Figure 10:
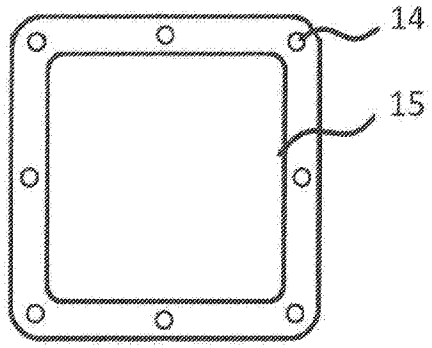
Figure 11:
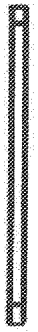
Figure 15:
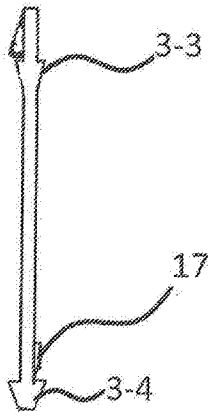
Figure 21:
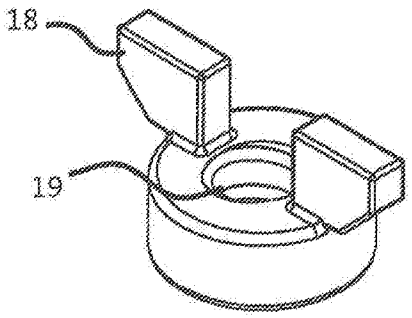
Figure 22:
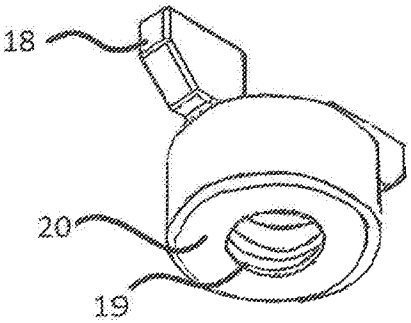
Figure 20:
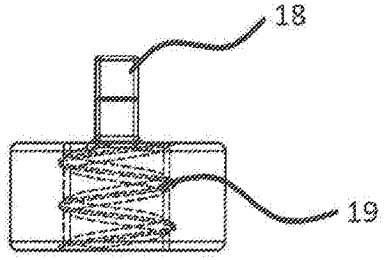
Figure 18:
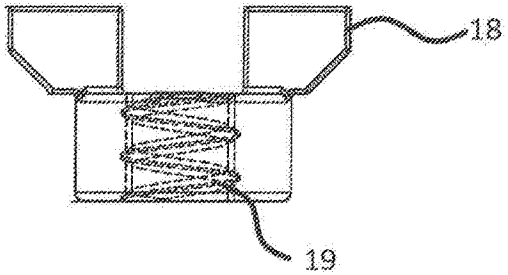
Figure 19:
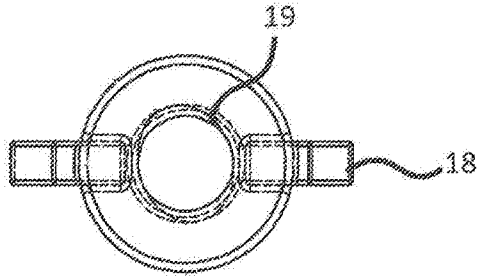
Figure 45:
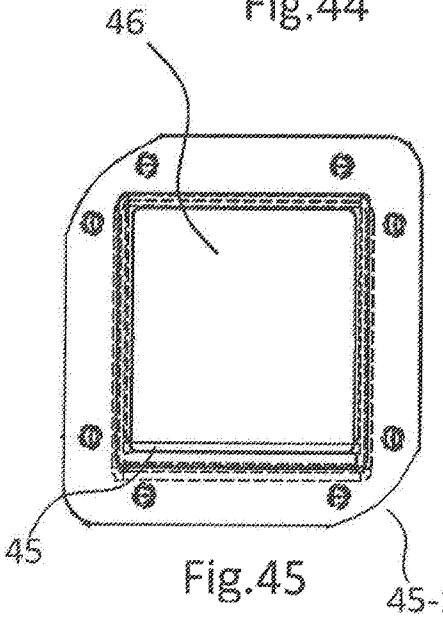
Figure 46:
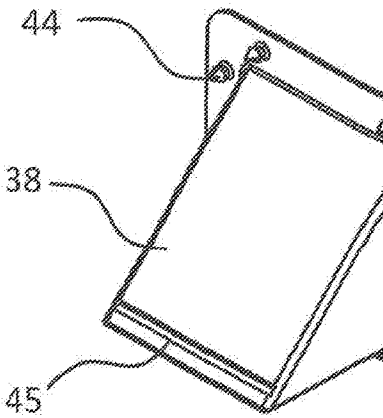
Figure 63:
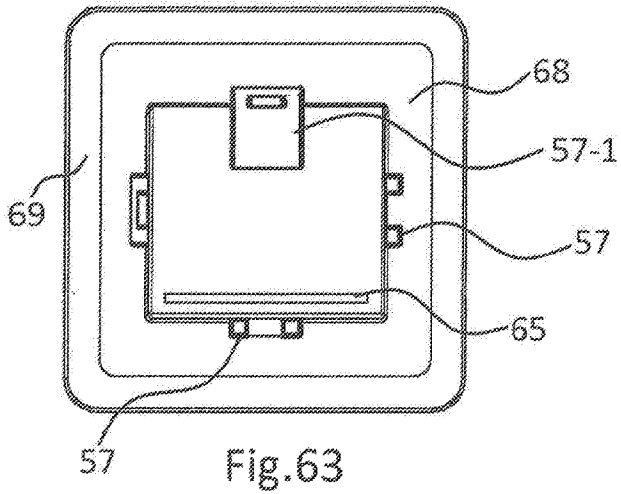
Figure 64:
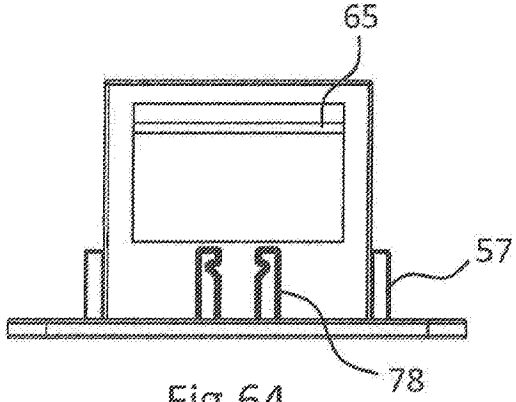
Figure 71:
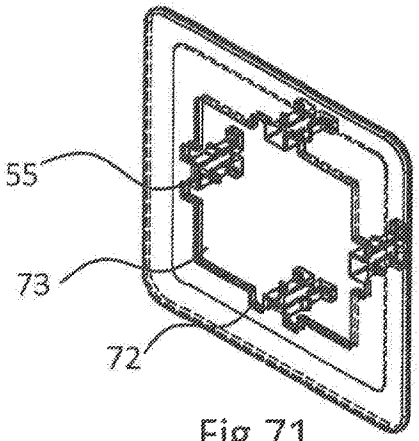
Figure 72:
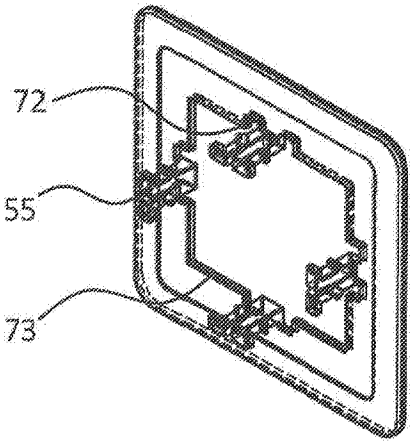
Figure 68:
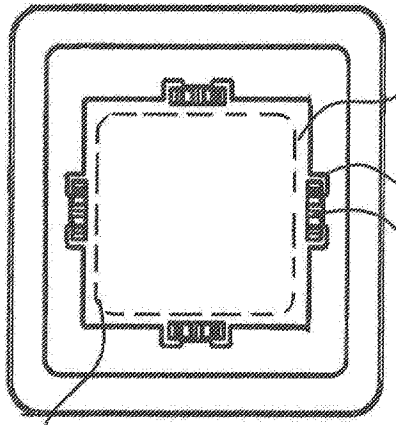
Figure 70:
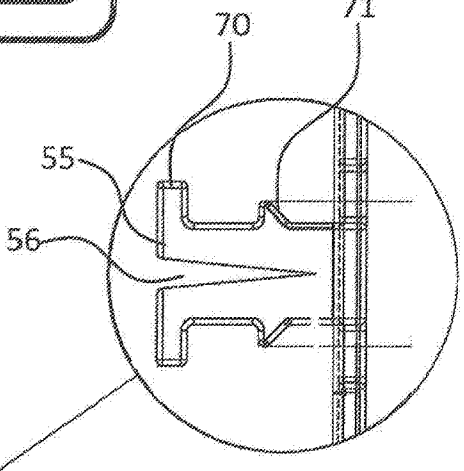
Figure 69:
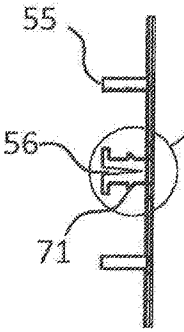
Figure 149:
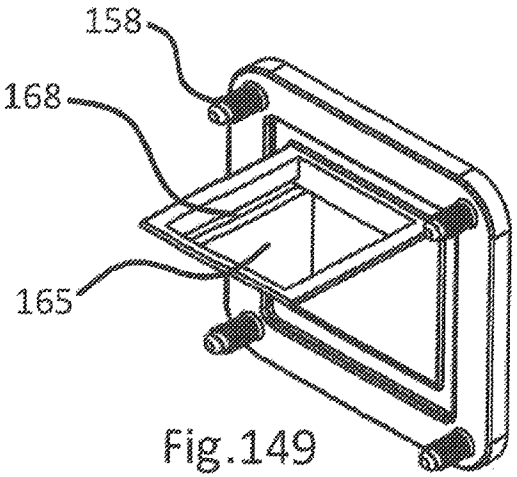
Figure 150:
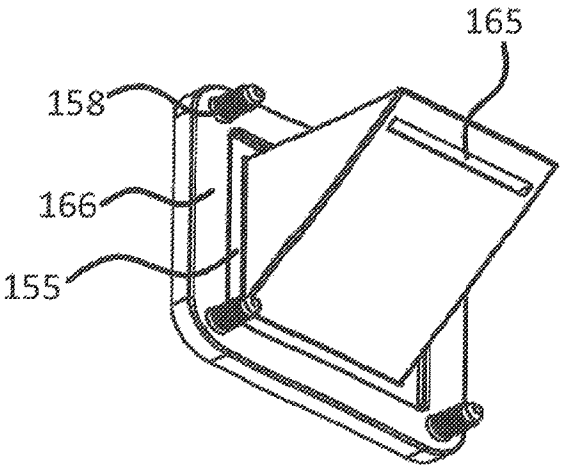
Figure 148:
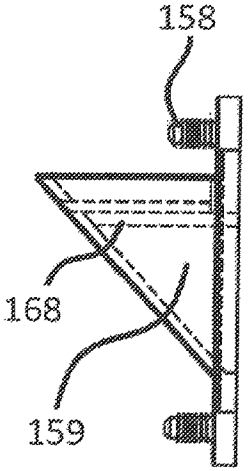
Figure 146:
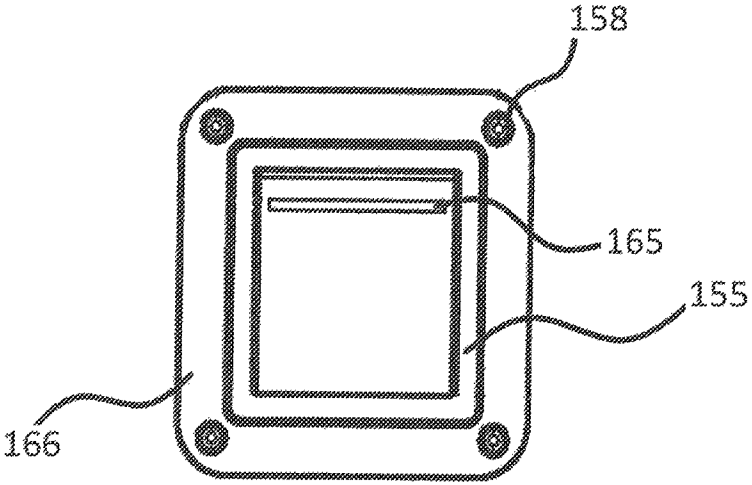
Figure 147:
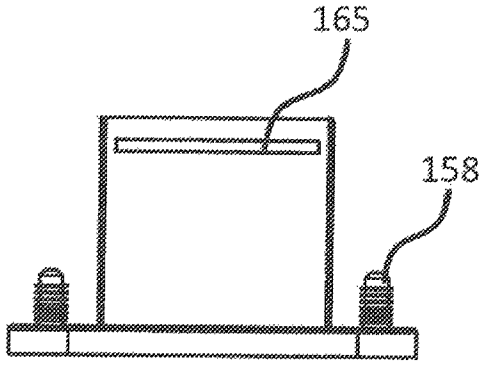
Figure 153:
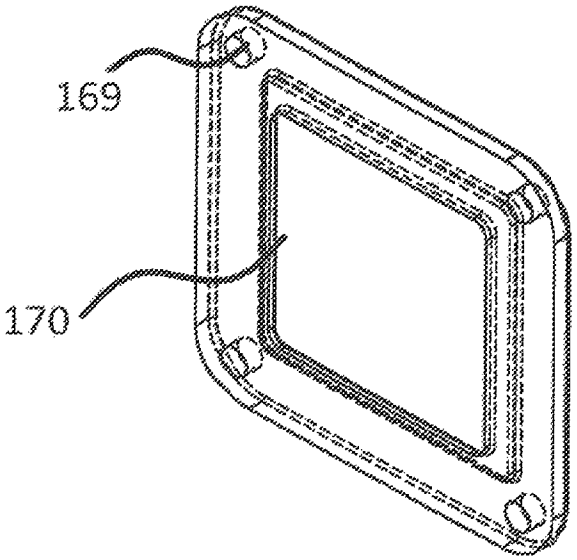
Figure 152:
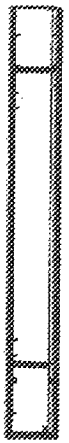
Figure 151:
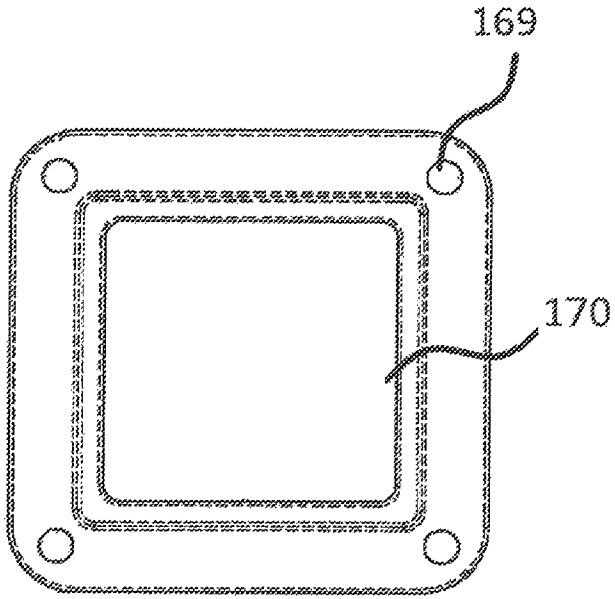
Figure 154:
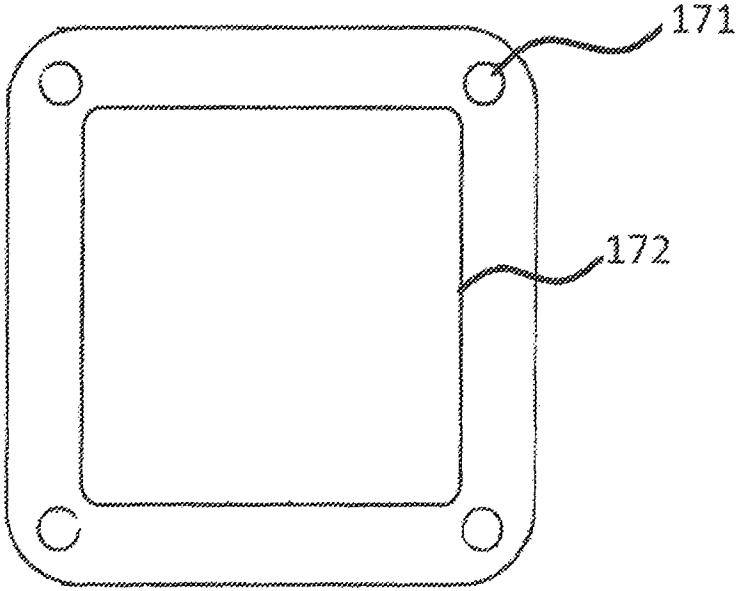
Figures 1, 156:
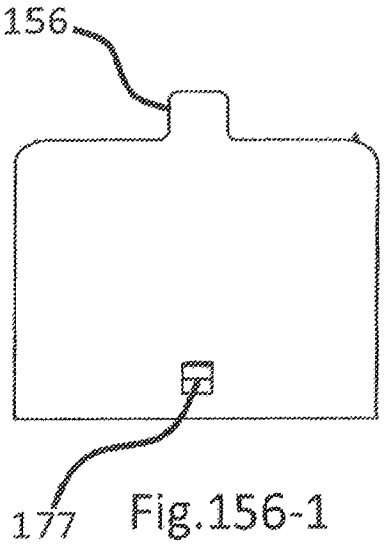
Figure 157:
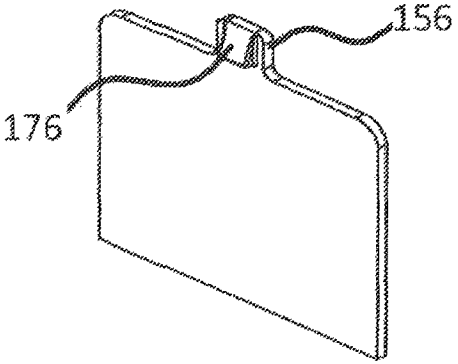
Figure 155:
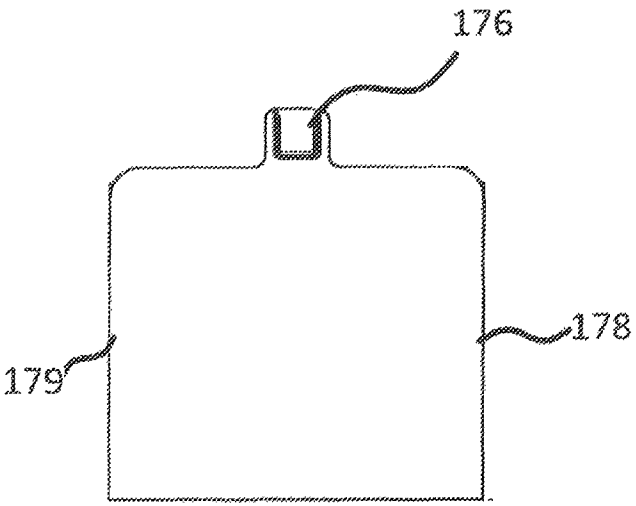
Figure 156:
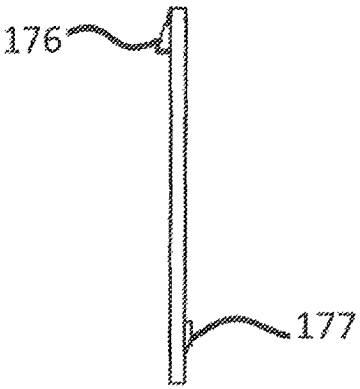
Figures 1, 2, 3, 158, 159, 160, 161, 162:
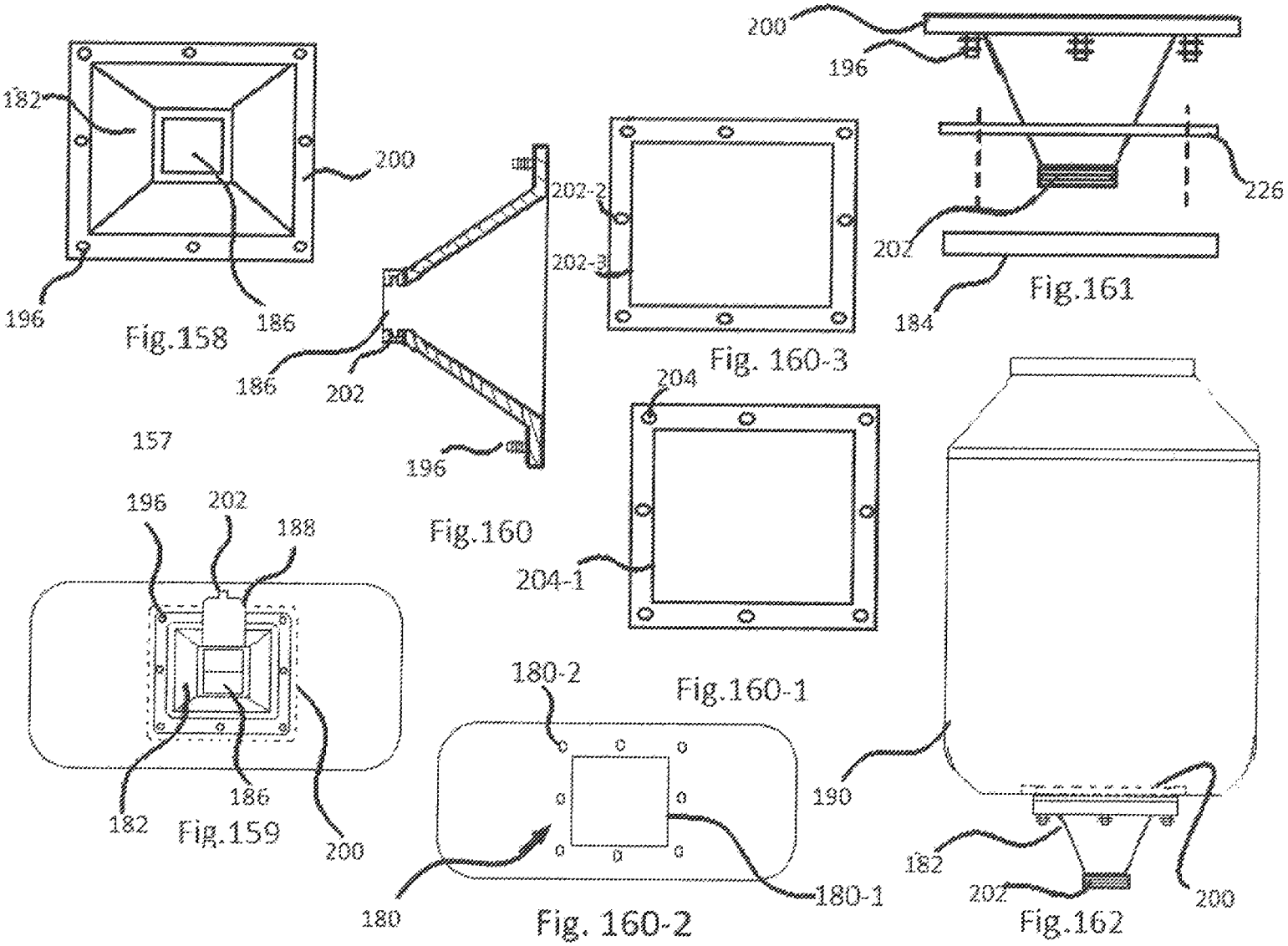
Figure 166:
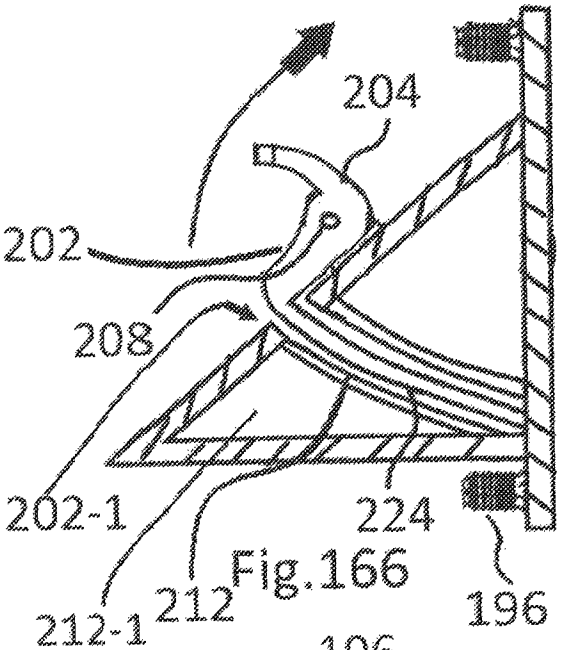
Figure 167:
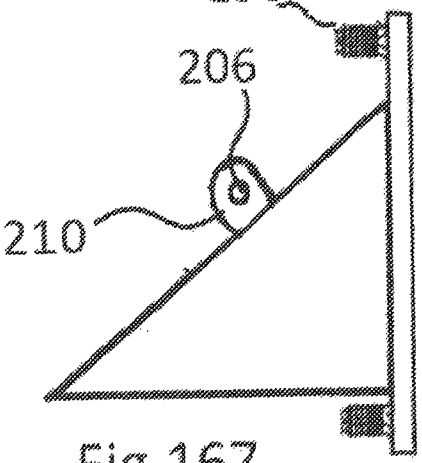
Figure 165:
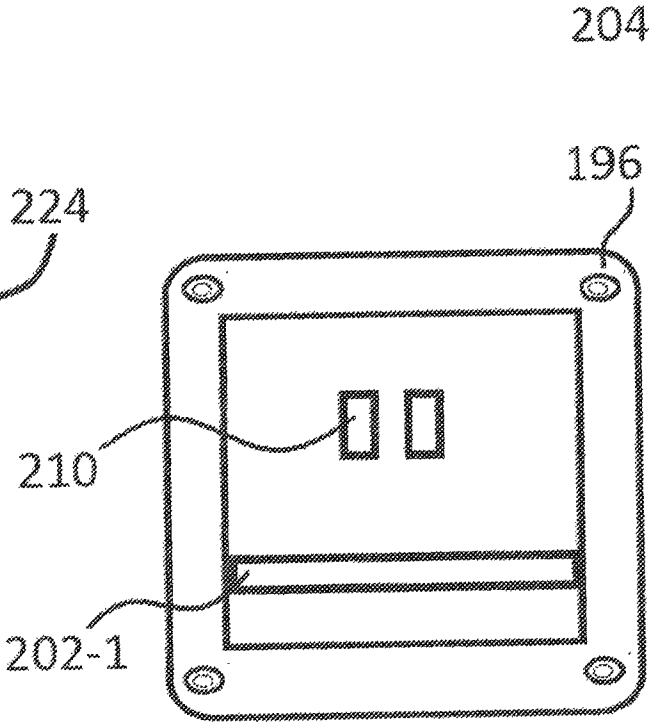
Figure 163:
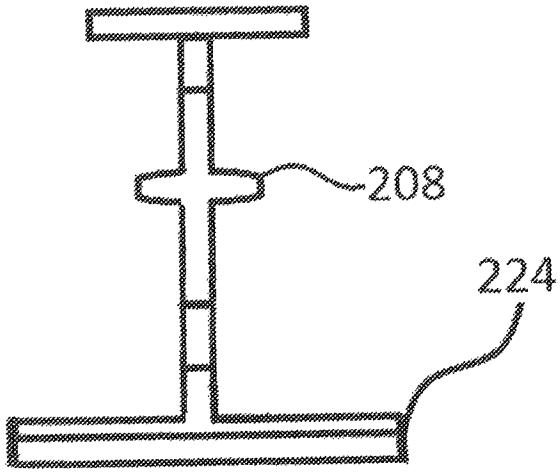
Figure 164:
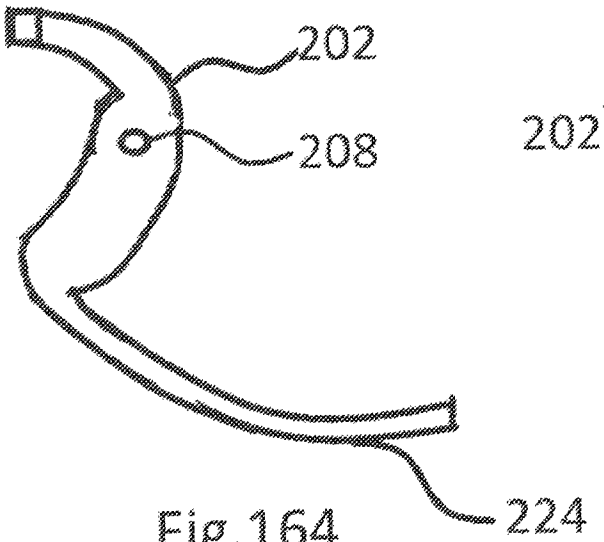
Figures 1, 2, 3, 4, 168, 169, 170, 171, 172:
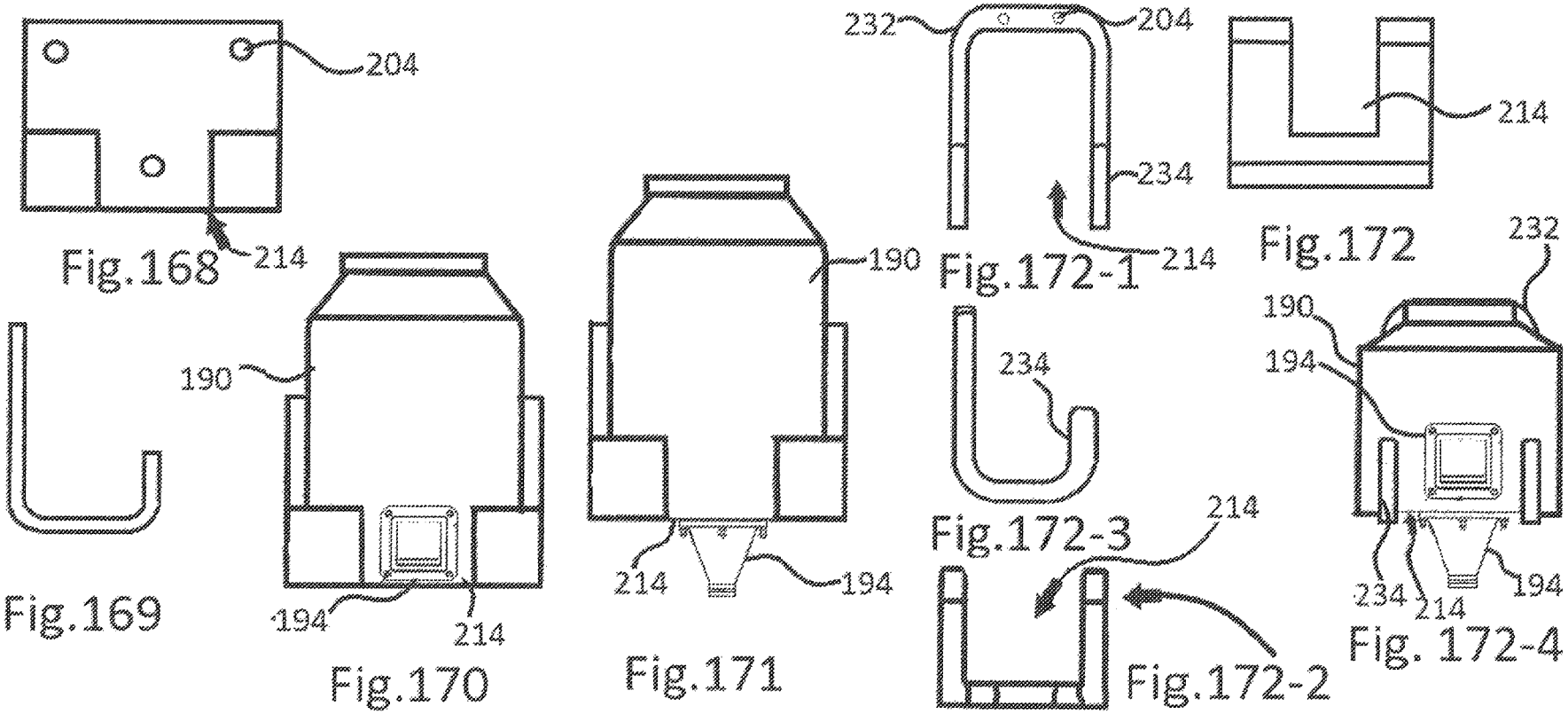
Figure 174:
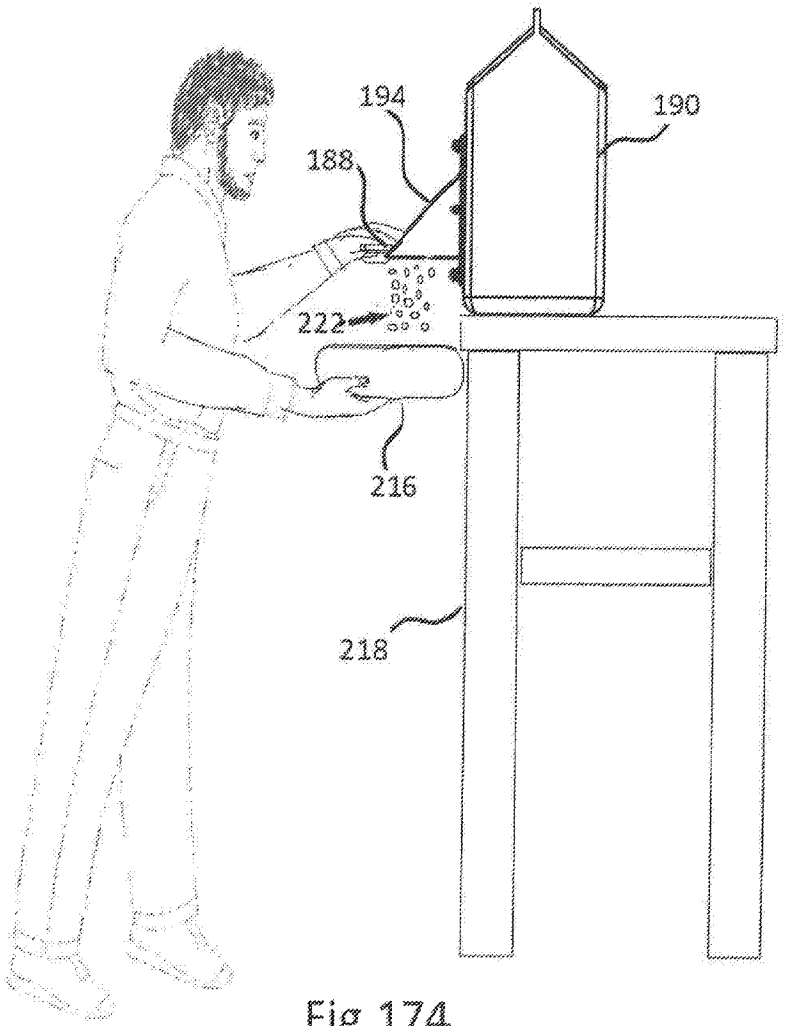
Figure 173:
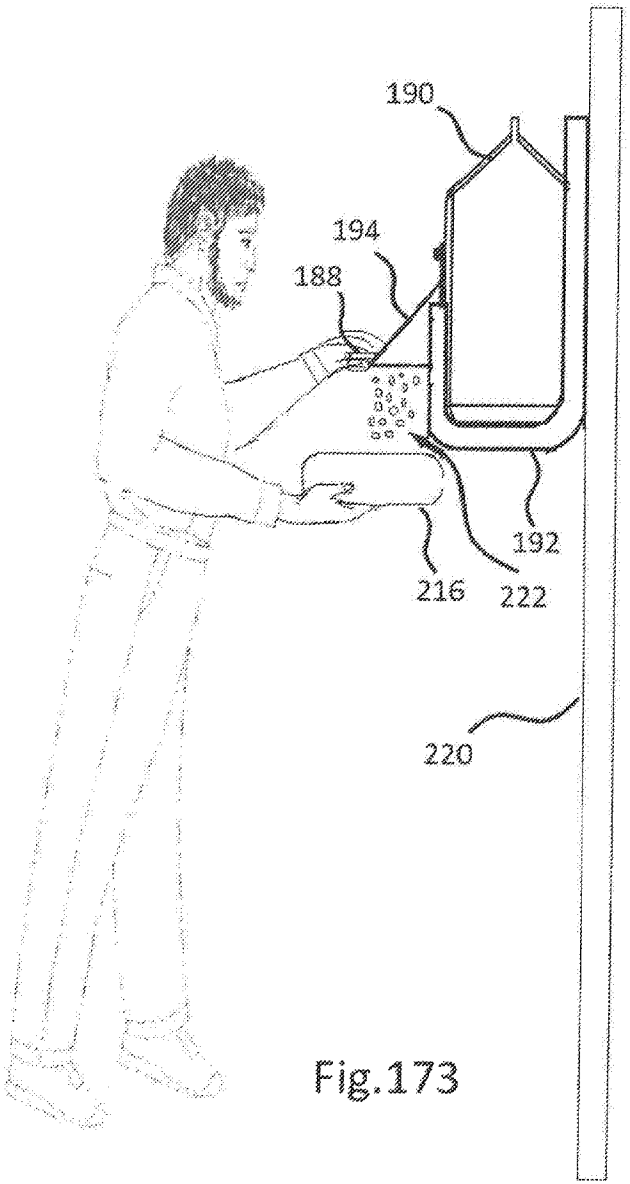
Figure 176:
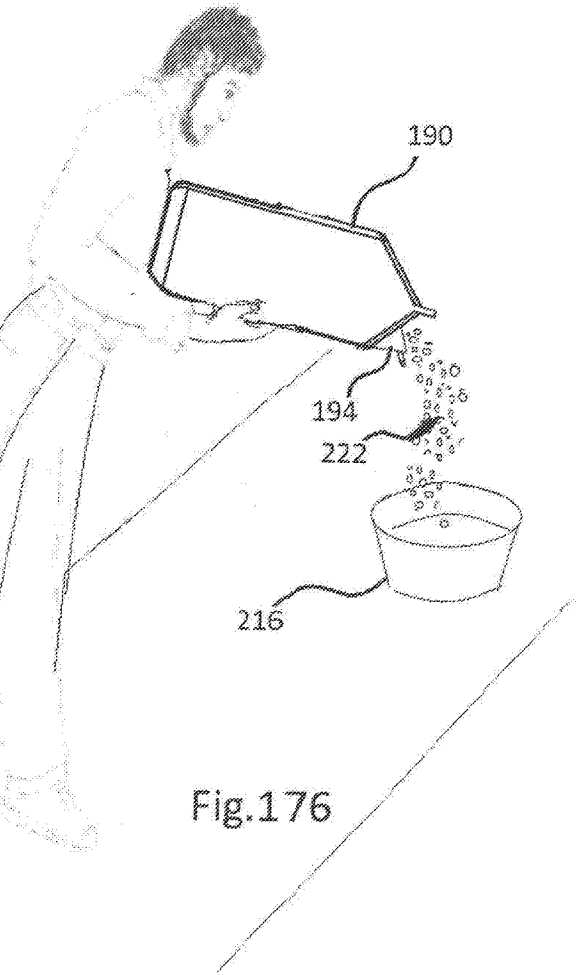
Figure 175:
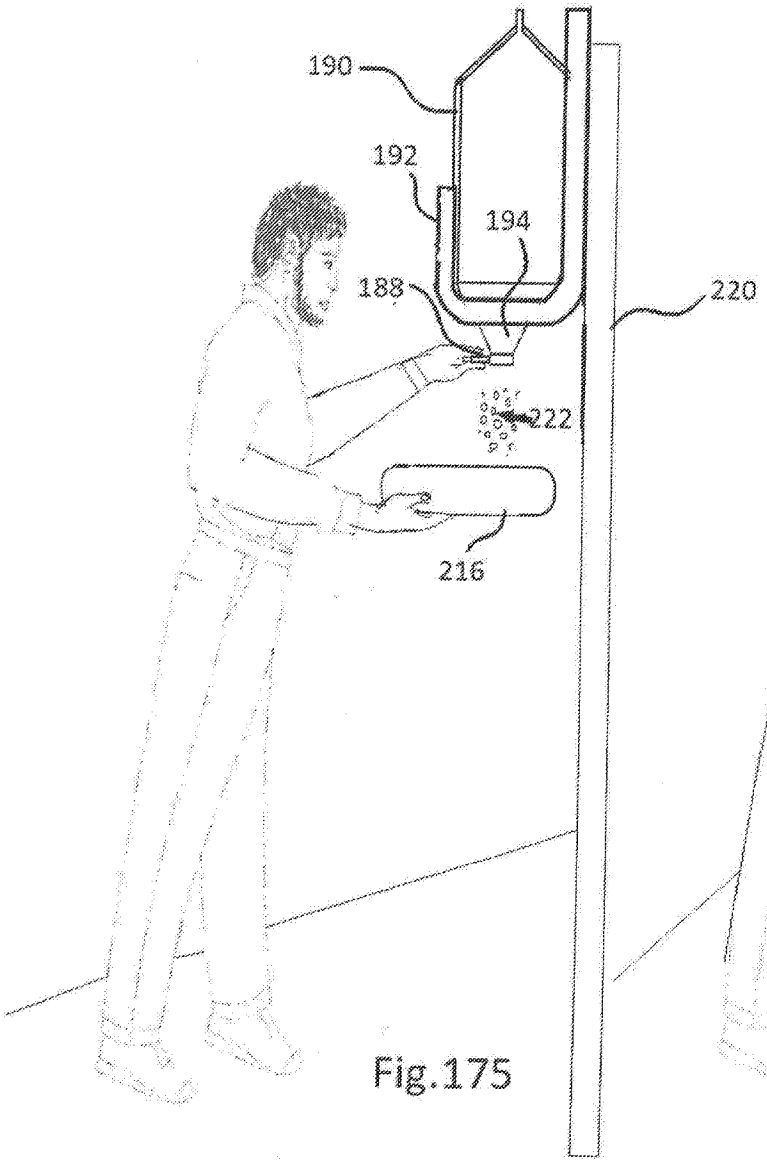
Figure 177:
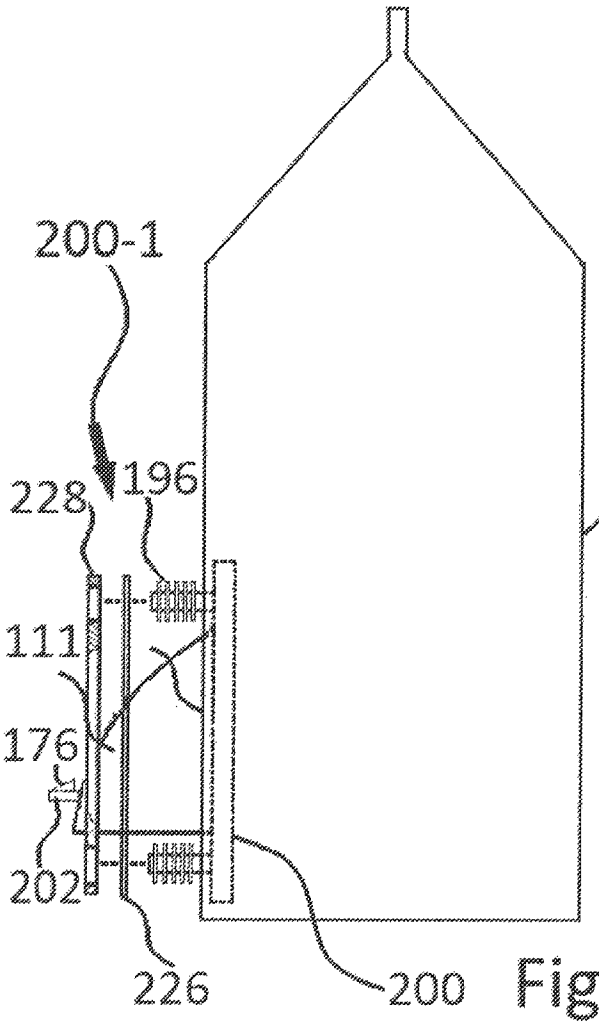

The template/seal (FIG. 154) will be use first to trace template holes 163 on bag (FIG. 144-1) container or flat surface to attach outer frame protruding seal spout (FIG. 144) with attached studded flanges 158 onto bag (FIG. 144-1) or container. Once the template holes 163 are marked the end user can use a box cutter or something of the nature to cut along lines and remove bag, container or flat surface material for spout cut out holes 163-1. The end user will place the protruding seal spout outer frame (FIG. 144) with attached studded flanges 158 inside bag spout cut-out hole 163-1, by squeezing the flexible protruding seal spout outer frame (FIG. 144) with attached studded flanges 158 and placing it through bag spout cut out hole 163-1. The end user will then un-squeeze protruding seal spout outer frame (FIG. 144 with attached studded flanges 158 and it will return back to its original form inside bag (FIG. 144-1). The end user will then manipulate the protruding seal spout outer frame (FIG. 144) with attached studded flanges 158, to make sure there is not any product around outer flange 180. The end user will then make sure the bag spout cut out hole 163-1 is disposed evenly around protruding seal spout outer frame (FIG. 144) with attached studded flanges 158 spout 159. The end user will then begin mating the attached studded flanges 158 that are on the outer flange 180 with the bag studded flange holes 163-2 until the bag material is flush around studded flanges 158 and spent 159. Now that the bag material is laying flush against the outer flange 180 the end user will then place template/seal 162 which may double as template and seal over spout 159 and attached studded flanges 158. The template/seal 162 holes 171 will mate with attached studded flanges 158 on outer flange 180 and center hole 172 of the template/seal 162 and will dispose flush around spout 159. The template/seal 162 is now laying flush against bag material. The end user will now place the inner frame flange 160 over the spout 159 and studded flanges 158. The inner frame flange 160 center hole 170 will dispose around the spout 159 of protruding seal spout outer frame (FIG. 144) with attached studded flanges 158 and then the holes 169 on inner frame flange 160 will mate with attached studded flanges 158 on outer flange 180 of protruding seal spout outer frame (FIG. 144). The end user will press around each hole 169 on inner frame 160 to make the attach studded flanges 158 grab the inner circumference of hole 169 on inner frame 160. The inner frame flange 160 is now lay flush against the seal/template 162 and is pressing firmly secured against seal/template 162. The inner frame flange 160, seal/template 162, bag (FIG. 101-1) material or container material is being sandwiched firmly between the outer flange 180 with attached studded flanges 159 of protruding outer frame (FIG. 101) making a tight seal. The end user will install the sliding door 157 last by sliding it into the protruding seal spout outer frame (FIG. 144) with attached studded flanges 159 slot 165. As the sliding door (FIG. 154) mate with slot 165 on protruding seal spout outer frame (FIG. 144), the left edge 179 and right edge 178 on sliding door (FIG. 154) will mate with right and left tracks 168 within protruding seal spout outer frame spout (FIG. 149) spout 159. The end user can now turn the bag (FIG. 145) right side up and pull the sliding door 157 to open and pour product or push sliding door 157 inward to close and seal. Looking at (FIG. 176) the end user may pour product out of bag but may still have the option to turn bag upside down and dispense product. Looking at (FIG. 174) the bag 190 with attached protruding seal spout 194 can be placed on a table 218 or looking at (FIG. 173) the bag 190 can be seated into seal spout bag holder 192 to dispense product 222 into bowl 216 or any container. Looking at (FIG. 176), the ender user can also pour product out by simply turning the bag in reverse, once the level of the product is low in bag and can't be no long dispensed or if it is the end user preference. The sliding door (FIG. 156) may have a door stop 177 to help prevent the sliding door (FIG. 156) from sliding out completely of slot when ender users opens sliding door (FIG. 156). The sliding door (FIG. 154) may also have a handle 156 with raised area 176 to help the end user open door ergonomically. There may be an alternative seal spout (FIG. 162) that will be attached to bottom of bag 190 or flat surface that will have the same interworking's as previous version seal spout. The alternative seal spout will be mainly be used on bottom of bag (FIG. 162) container or flat surface. The end user will trace template hole 180 on bag (160-2) using the seal/template (FIG. 160-3). The ender will use a box cutter or some of the nature to cut out hole on bag. The outer frame (FIG. 160) will have a tracks 202 within spout hole 186 to allow for sliding door be inserted into the tracks 202 to be dispense and seal product. Looking at (FIG. 159) the sliding door 200 is installed in slot within tracks of spout hole 186. This will provide the sliding door to slide back forth through slot and tracks to open and close spout hole 186. The alternative seal spout outer frame (FIG. 158) may be flexible so it can fit into bag outer frame cutout hole 180-1 on bag (FIG. 160-2). Once the end user puts alternative outer frame (FIG. 158) with attached studded flanges 196 inside bag outer frame cut out hole 180-1, of bag (FIG. 160-2) the end user will manipulate the alternative outer frame studded flanges 196 inside bag (FIG. 160-2) bag studded flanges hole 180-2. The end user will then sandwich the bag material or flat surface by first putting seal (FIG. 160-3) over the spout 182, and then the seal holes 202-2 will mate with bag studded flanges on outer frame (158). The seal (FIG. 160-3) will seat flat against surface of bag material or flat surface. The end user will then follow the same step with inner frame flange (160-1). Once the inner frame flange (160-1) holes 204 mate with studded flanges 196, the ender user will push around each hole on inner frame (160-1) to make studded flanges 196 catch the inner circumference of inner frame flanges (160-1) holes 204. The studded flanges 196 will be flexible but firm to allow for inner frame flange (160-1) holes 204 to snugly fit inside holes 204. This will cause the inner frame flange (160-1) to seat firmly against seal (160-3), bag material or flat surface then against alternative outer frame (FIG. 158) flange 200. This will sandwich them together causing a tight seal. Looking at (FIG. 161) depicts it shows the alternative outer frame 184, seal 226 and inner frame 184 will be in order to make a tight seal. The end user will now install sliding door 188. Looking at (FIG. 175) the end user can now put the bag 190 inside the u/j-shape seal spout bag holder bracket 194 to dispense inside product inside bowl 216. The u/j-shape bracket seal spout bag holder (FIG. 169) will have a shape of an half u-shape or j shape with at least one opening in to allow for the protruding seal spout (FIG. 170) or alternative seal (FIG. 171) to fit into opening 214. The u-shape or j-shape bag seal spout holder bracket (FIG. 168) may have at least one hole 204 to allow for it to be secured against wall or flat surface. Note there may be another option to hold bag with seal spouts attached. The horse shoe frame with u/j hook seal spout holder (FIG. 172-3) will have same working principles as the u/j shape bag seal spout holder bracket (FIG. 169). The horse shoe frame with hooks bracket (FIG. 174-2) will have an opening 214 for protruding seal spouts and the alternative seal spouts to seat directly into opening 214. There is also an alternative sliding door with attached handle that may be used in all version of seal spouts. The sliding door with attached handle has a handle with and attached door (FIG. 164). The handle 202 may have at least one pin 208 to mate with handle base 210 hole 206 on outer frame (FIG. 167). The end user will install the alternative sliding door (FIG. 164) by first sliding the door portion 224 into slot 202-1 of outer frame spout (FIG. 166) first and then mate the handle pins 208 with handle base holes 206 on outer frame spout (FIG. 167). The handle base 210 may be flexible enough to move apart so the handle pins 208 pop into handle base holes 206 right and left. The pins will allow for the alternative handle (FIG. 164) to swivel and cause the door to open when end user pushed forward and close when pull backwards. The sliding door 224 will slide within tracks 212 of outer frame (FIG. 166) spout 212-1. FIG. 173 shows a depictions of the end user dispensing product 222 into a bowl 216 using seal spout 194 attached to bag 190 seated in the u/j-shape bracket seal spout holder 192. FIG. 174 depicts the end user dispensing product 222 into bowl 216 with the seal spout attach to bag sitting on a table. FIG. 175 depicts the end user dispensing product 222 into bowl 216 using alternative seal spout 194 attached to bottom of bag 190 seated in the u/j-shape bracket seal spout holder 192. FIG. 176 depicts the end user with reverse protruding seal spout 194 attach to bag 190 pouring product 222 into bowl 216. Looking at (FIG. 178) it depicts how the end user will insert outer frame inside bag top and bottom hole on all version of the seal spout for installation. FIG. 177 depicts the outer frame with studded flanges 196 look inside bag and how each embodiment will correlate with each other. FIG. 177 also show how the outer flange 200 of the outer frame 200-1 will look when end user un-squeeze the outer frame. Looking at (FIG. 177) it is showing once the outer frame 200-1 flange 200 is in the bag 190, the end user will in the seal 226, and last to sandwich and secure it all together the inner flange frame 228. FIG. 177 depiction represent the method that will used on all seal spout version regardless of the fastener type, shape or size. The protruding seal spout outer frame (FIG. 7) can also have at least one spout support 5-1 to help sliding door seal properly in spout hole. The spout support 5-1 can be use on all version seal spout outer frames. Looking at (FIG. 7) optional ergonomic sliding door help support 11-1 that is outer frame (FIG. 7) it will help end user close sliding door. The optional ergonomic sliding support can be use on any version seal spout to help end user close sliding door. Looking at protruding seal spout outer frame (FIG. 8) the spout may have a dispose recess area 2 spout 5 for extra flexibility. The disposed recess area 2 can be use on any version seal spout outer frame. The sliding door (FIG. 15) may have a raised taper area on top 3-3 and bottom 3-4 for a tighter seal when ender close sliding door (FIG. 15). The raised taper area on top 3-3 and bottom 3-4 on sliding door (FIG. 15) may be used on all seal spout versions. Looking at (FIG. 107) the studded flanges 110 may have base support 118 to make studded flange stronger. The base may be used on all seal spout versions that have studded flanges or threaded studs. The protruding seal spout outer frame (FIG. 63) attach female clip 57 may have the option to close vs open. Looking at (FIG. 63) the closed female clip 57-1 give more support to the inner frame with inverted male clip. The closed-female clip 57-1 may be use on all version seal spout that have attached female clips. FIG. 45 outer frame flange may have recess corners to allow for the outer frame to slip inside bag hole spout hole cut out. The recess corners 45-1 can be use on all seal version outer frame or inner frame flanges. Not the seal/template are option on all seal spout versions.

Figures 1, 43:
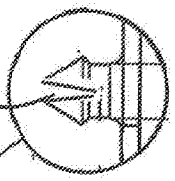
Figure 43:
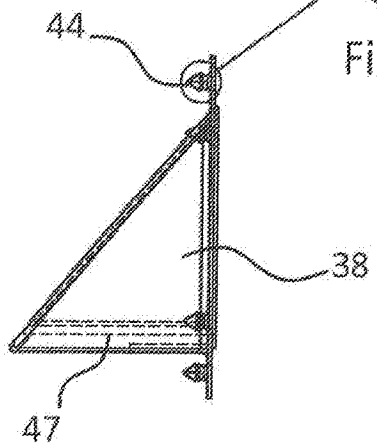
Figure 44:
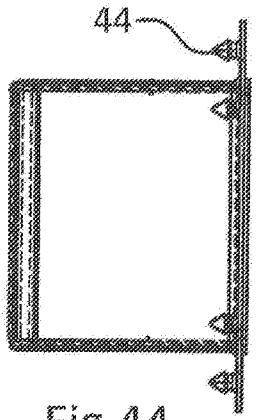
Figure 48:
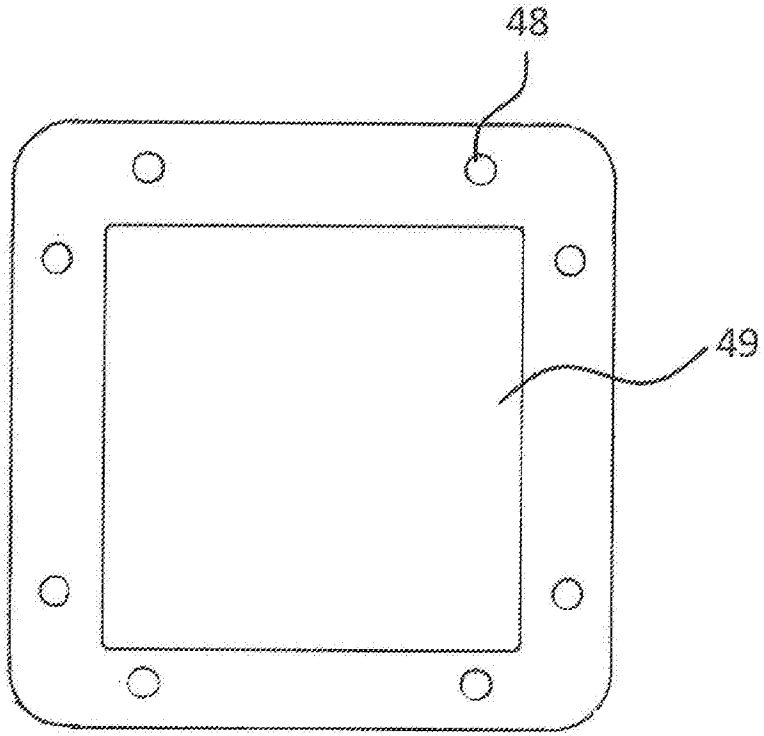
Figure 53:
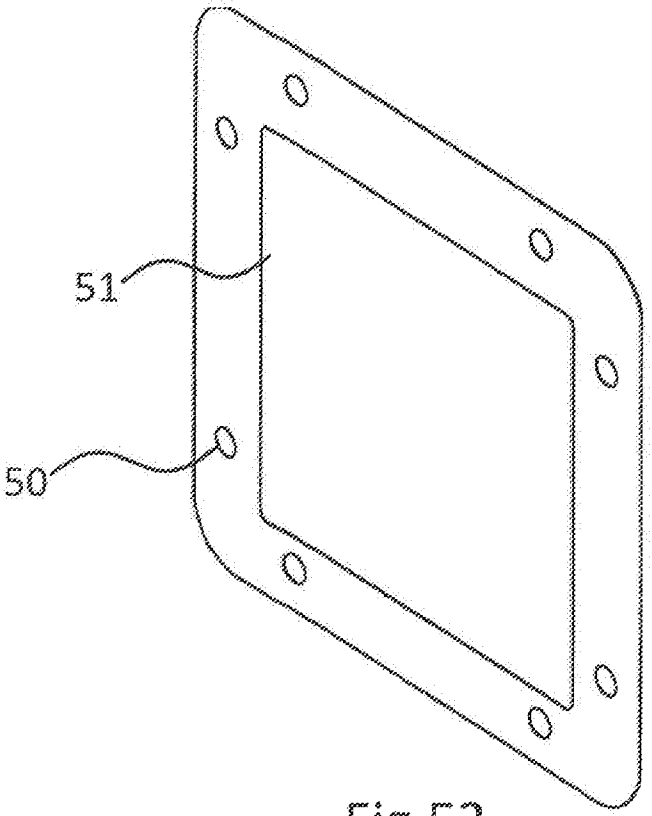
Figure 52:
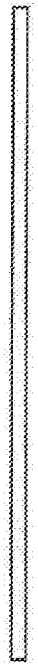
Figure 59:
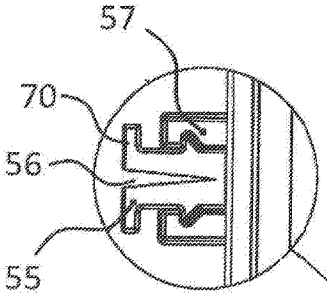
Figure 67:
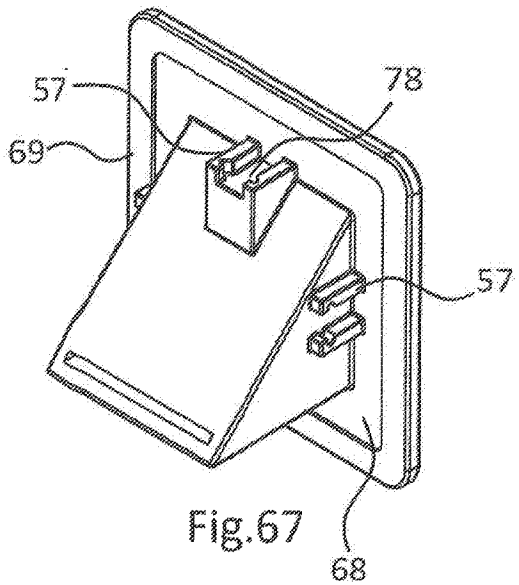

Version 1 and 3 will have an outer frame inner frame, and seal. Version 1 and 3 seal spouts can be disassembled by cutting open bag when all product is dispensed. The end user will squeeze male snap (FIG. 43) on outer frame flange to release inner frame flange from outer frame (FIG. 48) holes 48. This will allow for the end user to disassemble any version seal spout that has attach male snap fastener and will allow the end user to reattach seal spout with male snap fasteners to bag container or flat surface. Version 4 and version 5 seal spout have attached female clips and male inverted clips. Looking at (FIG. 59) the end user will squeeze grips 70 that on the male inverted clip 55 to release inverted male clip 55 from the female clip 57. When the grips 70 are squeezed together it will cause the pin 71 to move inward out of female clip slot 78. The end user can now disassemble the inner frame from the outer frame and reattach any seal spout with inverted male clip and female clips to bag, container or flat surface. Version 1 and 7 seal spout can be dissembled by unscrewing the wing nut from threaded studs on outer frame flange. Once all the wing nuts are remove the end user can the separated the inner frame flange and seal from outer frame. The version 1 and 7 seal spouts that uses attached threaded studs on inner frame flange and nut can reattach inner frame flange, seal and outer frame to any bag, container or flat surface once again. Note any seal spout version using attached threaded stud and wing nut may be disassembled using this method. The inner frame on all version can fold into 2 sections. Note all seal spout version can be configure in any combination using different parts and different fastener methods. The parts can be made with any material from rigid to flexible. The outer frame on all seal spouts can have at least one or more holes or fasteners outer flanges and inner frames flanges to make a tight seal. Also note all version outer frames and inner frame flanges can be interchangeable. The inner frame flange can be the outer frame and outer frame an be the inner frame flange on different version applications.

Alternative Screw/Nut Stud Seal Spout Version

Figures 179, 180, 181, 182, 183:
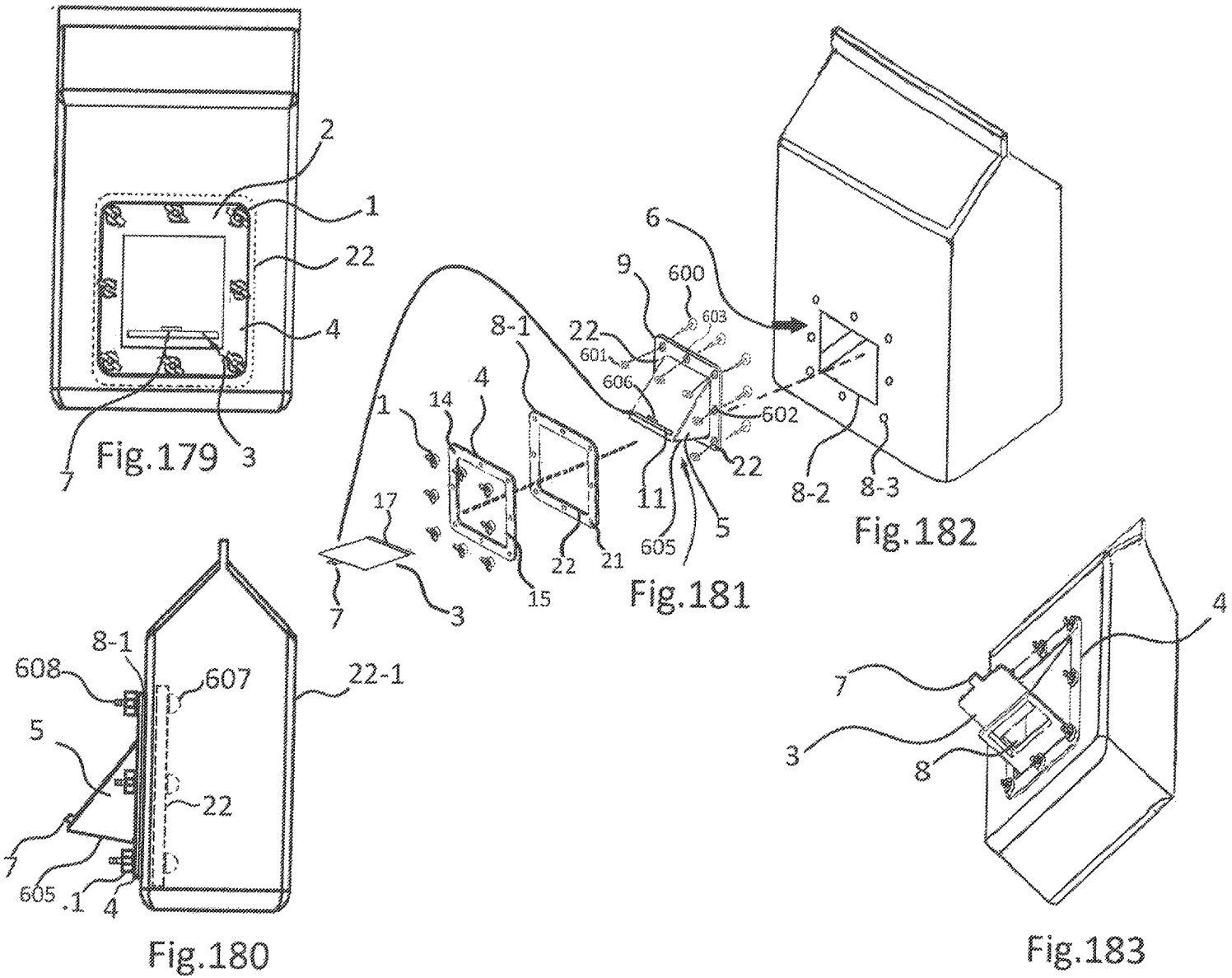
Figure 188:
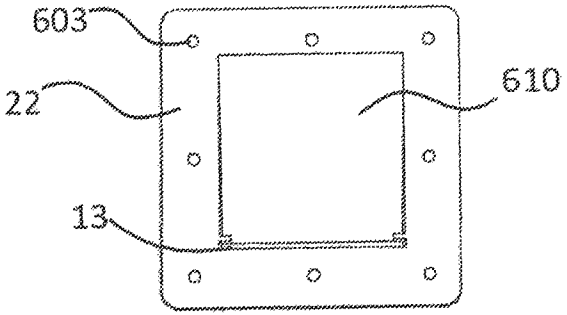
Figure 189:
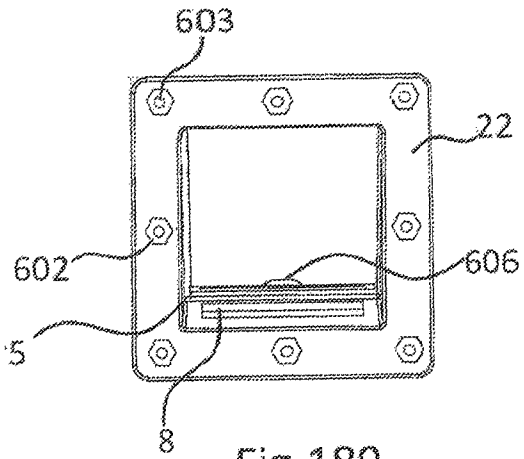
Figure 187:
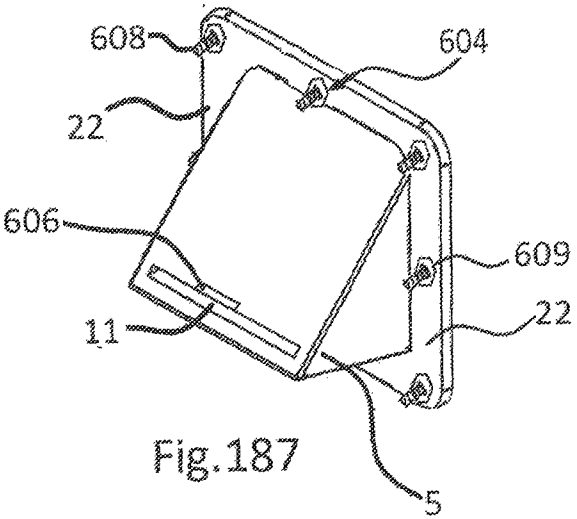
Figure 184:
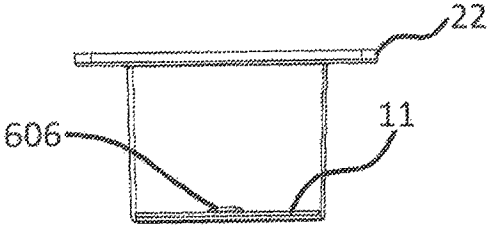
Figure 185:
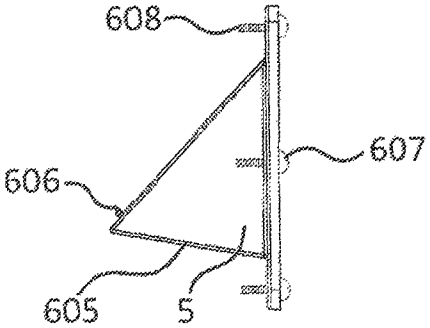
Figure 186:
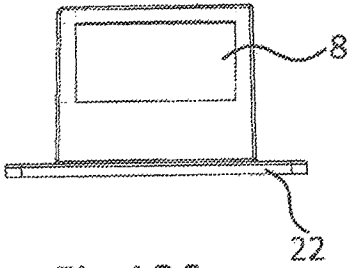
Figure 190:
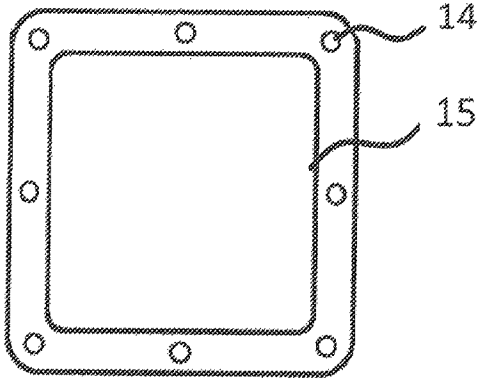
Figure 191:
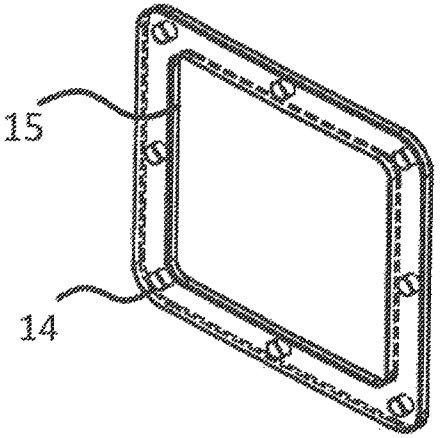
Figure 192:
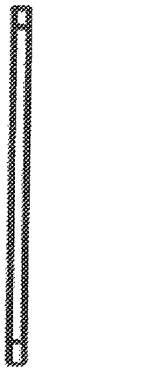
Figure 193:
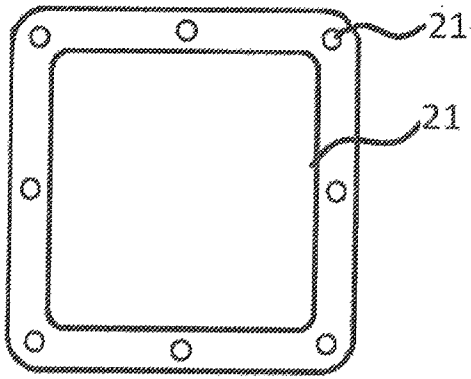
Figure 194:
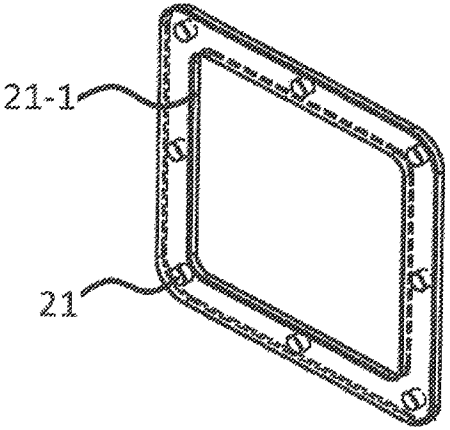
Figure 195:
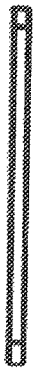
Figure 197:
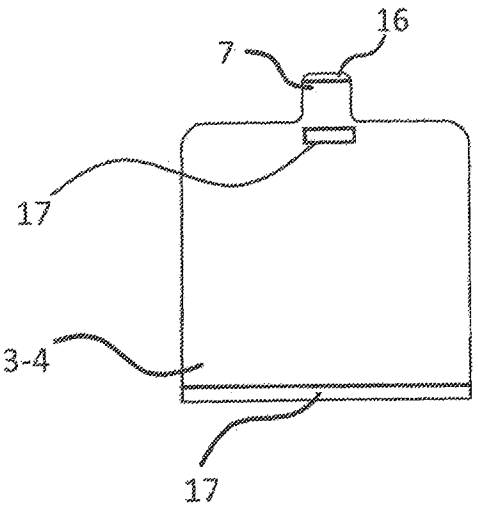
Figure 199:
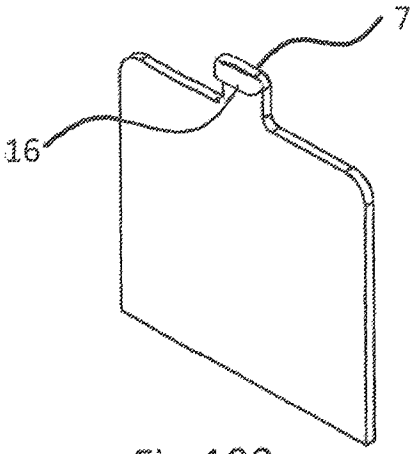
Figure 196:
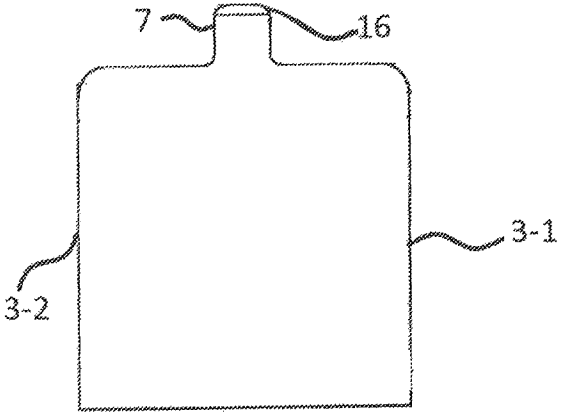
Figure 198:
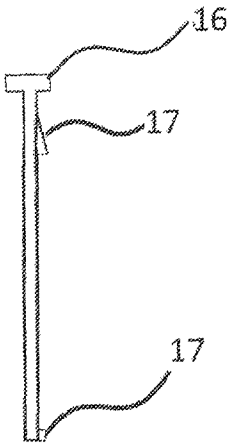
Figure 200:
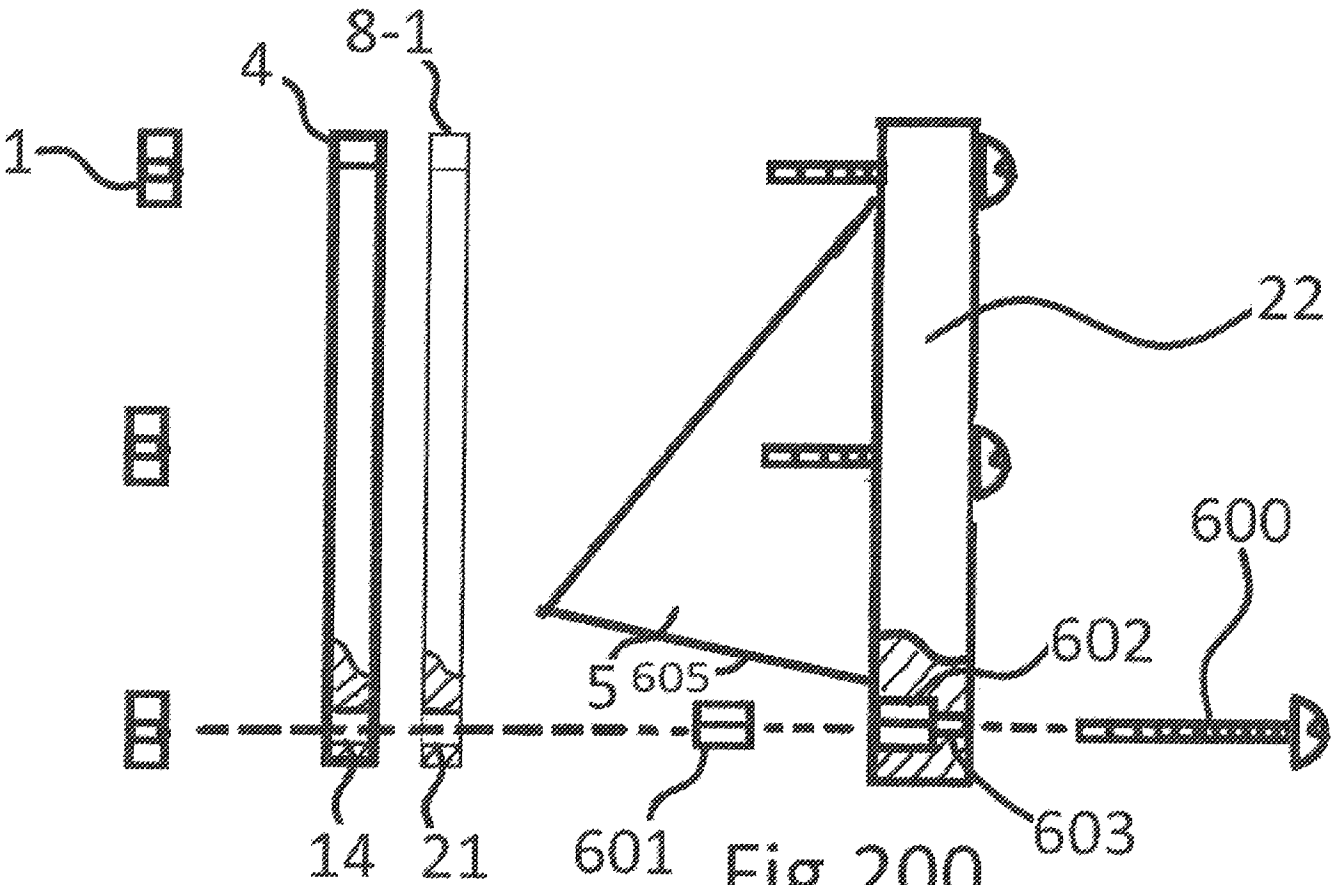
Figure 201:
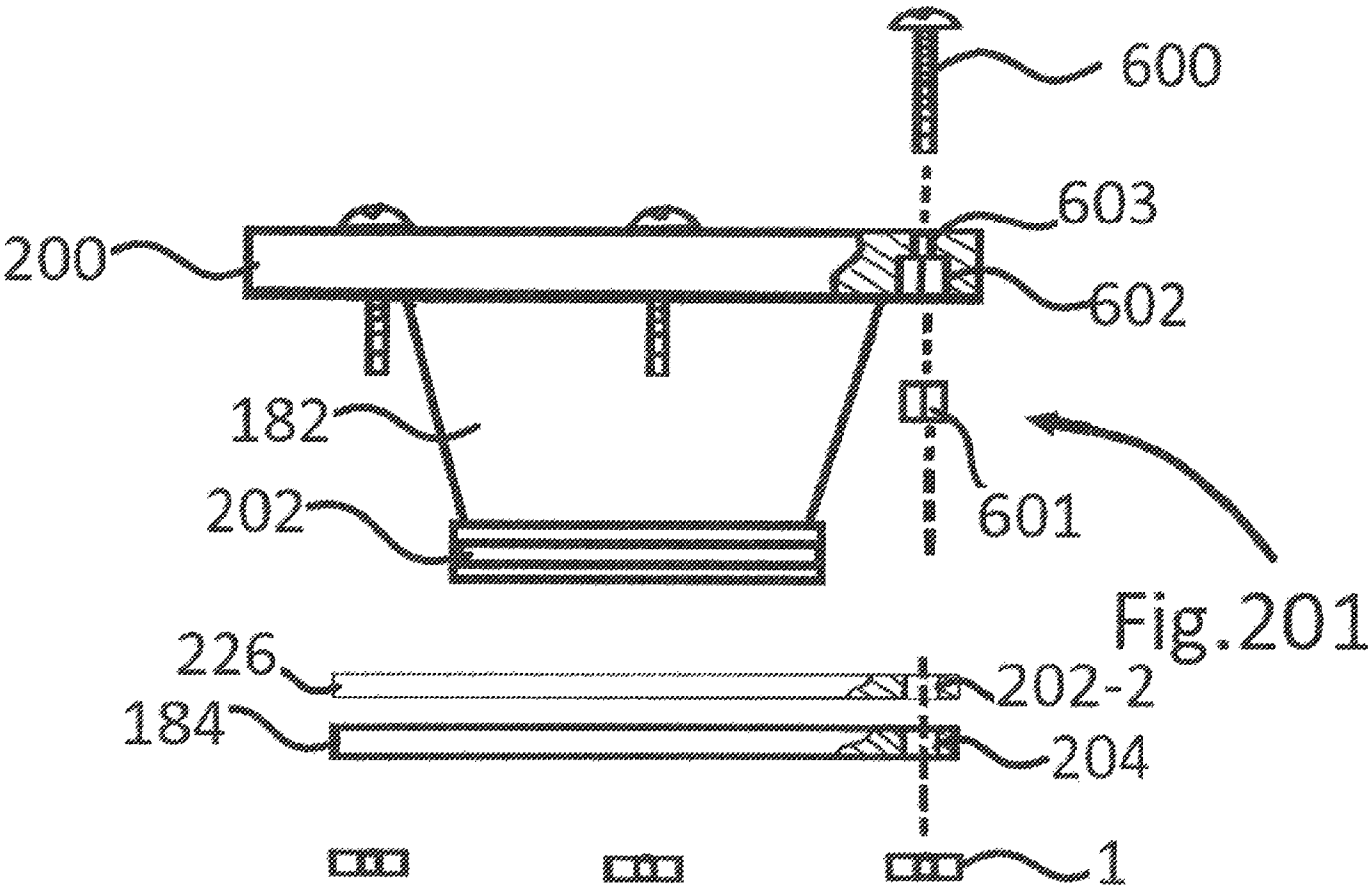
Figure 202:
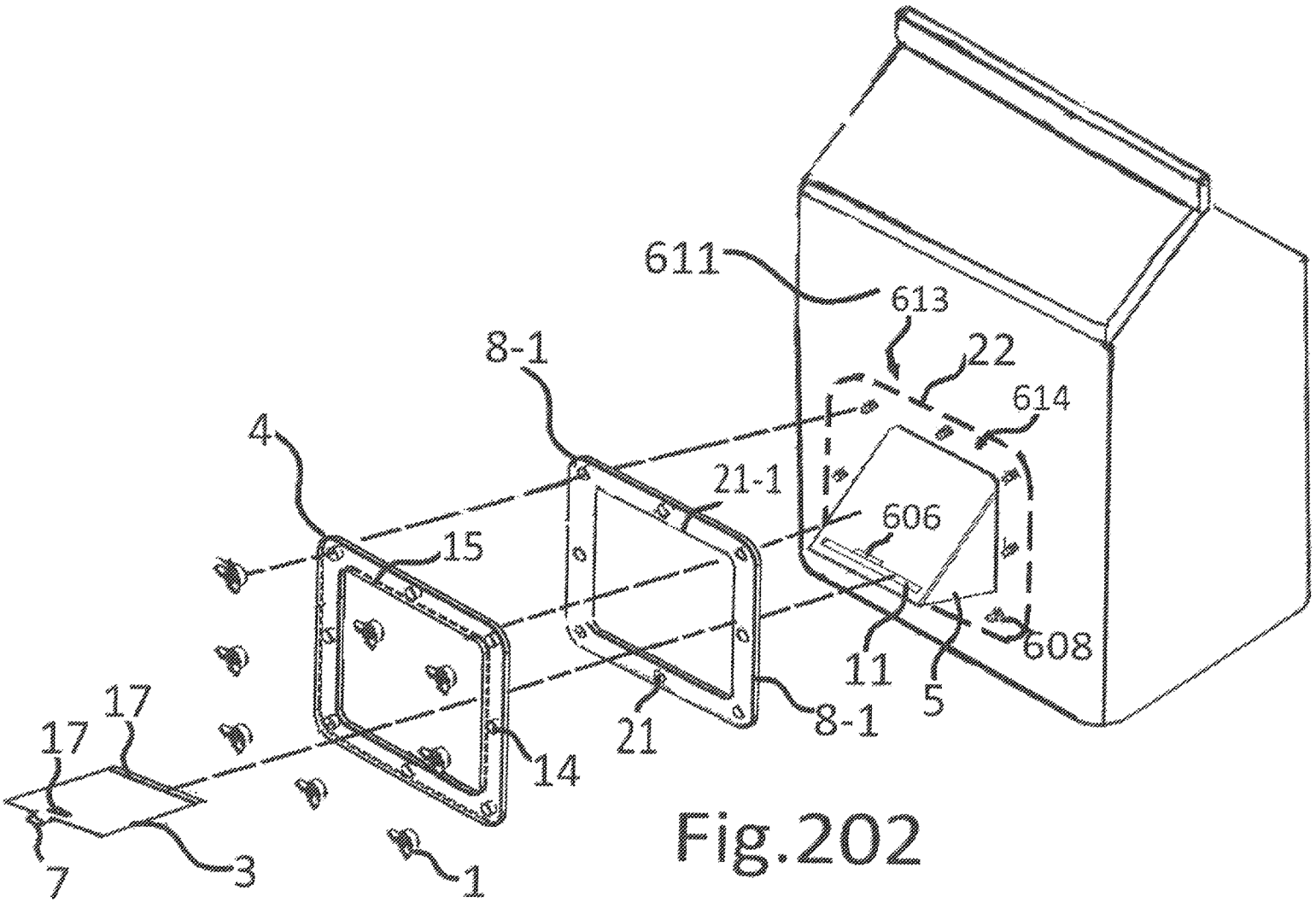

The alternative screw/nut stud seal spout version will work on the same principle as the version 1 with threaded studs and other versions. The threaded studs on the outer flange can be used in all version. The threaded stud can cover any type of studs, whether insert studs or just using regular fasteners to make studded threads in outer frame flange. The outer flange can accommodate any type of fastener method to achieve threaded studs or any type of fastener method. The screw/bolt nut stud can be used in any method on outer frame flange. If the user decides to use the alternative screw/bolt nut stud seal spout version on a bag (FIG. 182), the consumer will have two choices. The recommend choice will be to place bag on flat surface and chose an area on the lower bottom of bag and use the template/seal (FIG. 190) or inner frame flange (FIG. 193) to cut out template holes on bag if the bag has no access point. The other chose will be to open the bag if it has a re-sealable access to point to place screw/bolt nut stud seal spout outer frame (FIG. 187) inside bag after template holes are cut out. The template holes 6 may be marked and cut out on bottom of bag to dispense most of product by gravity. The end user may use the alternative screw/bolt nut stud version seal spout that will be releasable attachable to bag, container or any flat surface by using the screw/bolt nut stud seal spout seal/template (FIG. 193) to mark holes. Looking at (FIG. 187) the end user will assemble screw/nut stud 604 into outer flange 22. FIG. 200 shows how the nut 601 will recess into outer flange 22 recess hole 603. The end user will then push screw/bolt 600 through opening 603 of outer flange 22. The screw/bolt 600 will be push through opening 603 it mates screw/bolt 600 threads 612 mate with nut 601. The ender will screw the screw/bolt 600 into nut until firmly secure and tighten. Looking at (FIG. 189) the end user will repeat the same process until each recess hole 602 with opening 60 have a screw/bolt nut stud 604. FIG. 187 shows how the screw/bolt nut stud seal spout outer frame (FIG. 187) will look with screw/bolt nut studs 604 assembled in outer flange 22. Now that the screw/bolt nut stud seal spout outer frame (FIG. 187) is assemble the ender user will prepare the bag, container or flat surface. The screw/bolt nut stud seal spout seal/template (FIG. 193) will be used to trace template holes 6 on bag (FIG. 182) container or flat surface to attach screw/bolt nut stud seal spout outer frame with components (FIG. 181). Once the bag (FIG. 182) bag spout cut out holes 8-2 and bag threaded stud holes 8-3 are marked the end user can use a box cutter or something of the nature to cut along the lines of marked areas and remove bag material from cut out holes. The end user will place the screw/bolt nut stud seal spout outer frame (FIG. 187) inside the bag (FIG. 182) bag spout cut-out hole 8-2, by squeezing the flexible screw/bolt nut stud seal spout outer frame (FIG. 187) and placing it through bag (FIG. 182) bag spout cut out hole 8-2. FIG. 178 depicts the end user squeezing the seal spout being place inside of bag 190 cut out holes 180. The end user will then un-squeeze screw/bolt nut stud seal spout outer frame with components (FIG. 187) and it will return to its original form inside bag (FIG. 182). The end user will then manipulate the screw/bolt nut stud seal spout outer frame (FIG. 187) to make sure there is not any product around or on top of outer flange 22. The end user will then make sure the bag (FIG. 182) bag spout cut out hole 8-2 are disposed evenly around screw/bolt nut stud seal spout outer frame with component (FIG. 181) spout 5. Looking at (FIG. 187) the end will then begin mating the screw/bolt threaded studs 604 on screw/bolt nut stud seal spout outer frame (FIG. 187) flange 22 through the bag (FIG. 182) bag cut out stud holes 8-3 and make sure bag, container or flat surface material is flush around the screw/bolt threaded studs base and spout 5. Looking (FIG. 202) depicts how the screw/bolt nut stud seal spout outer frame (187) will look installed inside of bag 611 in (FIG. 202) Looking at (FIG. 202) again the screw/bolt threaded studs 608 are protruding out of bag 614 material. FIG. 202 depicts how the bag 614 material is laying flush against the screw/bolt nut stud seal spout outer frame 613 outer flange 22. Looking back at (FIG. 202) the end user will then place template/seal 8-1 which may double as a seal or template over spout 5 and screw/bolt thread studs 608. The holes 21 on the template/seal 8-1 will mate with screw/bolt stud 608 and the center hole 22 of template/seal 8-1 will dispose flush around spout 5. The template/seal 8-1 is now laying flush against bag material 614. The end user will now place the inner frame flange 4 over the spout 5. The inner frame flange 4 center hole 15 will dispose around spout 5 of screw/bolt nut stud seal spout outer frame 613 and then the holes 14 on inner frame flange 4 will mate with screw/bolt threaded studs 608 on outer flange 22. The inner frame flange 4 is now laying flush against the seal/template 8-1. Now the seal/template 8-1, bag material 614, container material or flat surface material is sandwiched between the screw/bolt nut stud seal spout outer frame 613 outer flange 22 and inner frame flange 4. The end use will now screw wing nuts 1 diametrically onto screw/bolt threaded studs 608 until all components form a tight seal. The end user will install the sliding door 3 last by sliding it into screw/bolt nut stud seal spout outer frame 613 spout 5 slot 11. As the sliding door (FIG. 196) mate with slot 11, the left edge 3-2 and night edge 3-1 of sliding door (FIG. 196) will mate with right and left tracks 13 within screw/bolt nut stud seal spout outer frame (FIG. 188) The end user can now turn the bag with attached seal spout (FIG. 183) right side up and pull the sliding door 3 open to dispense product or close to stop dispensing product. Looking at (FIG. 174) the bag 190 with attached protruding seal spout 194 can be placed on a table 218 or looking at (FIG. 173) the bag 190 can be seated into seal spout bag holder 92 to dispense product 222 into bowl 216 or any container. Looking at (FIG. 176), the ender user can also pour product out product by simply turning the bag 190 in reverse, once the level of the product is low in bag 190 and can't be no long dispensed or if it is the end user preference. The sliding door (FIG. 197) may have at least one door stop 17 to help prevent the sliding door (FIG. 197) from sliding out of slot completely when end user pulls open sliding door (FIG. 197) to dispense product. There may be at least one door stop 17 to prevent sliding door (FIG. 197) from being push completely inward. The sliding door (FIG. 198) may also have at least one raised handle 7 with at least one raised side 16 to help the end user open door ergonomically. The screw/bolt stud can be use on any version of seal spout. Also, note seal spout can be any size or shape. Look (FIG. 185) the spout 5 may have an angle. The screw/bolt nut stud seal spout outer frame (FIG. 187) may have a door stop 606 on spout 5. Looking (FIG. 202) shows the screw/bolt studs used on alternative seal spout with components (FIG. 161) and will use the exact same method to attach to any bag, container or flat surface.

It should be understood, of course, that the foregoing relates to exemplary embodiments of the invention and that modifications may be made without departing from the spirit and scope of the invention as set forth in the following claims.

What is claimed is:

1. A reusable seal spout assembly comprising:

a spout, said spout comprising an outer flange, two side walls spaced apart from each other and extending away from two side edges of a frontal face of said outer flange and a top wall extending away from a top edge disposed between said two side edges of said frontal face of said outer flange, said top wall and said two side walls together define a passageway extending between an inlet opening at said outer flange and an outlet opening away from said inlet;

a plurality of fasteners projecting from said frontal face of said outer flange;

an inner frame flange adapted to be coupled with said outer flange, said inner frame flange having a plurality of holes to releasably receive said plurality of fasteners and a center hole configured to receive said top wall and said two side walls; and a sliding door slidingly mounted through a slot disposed at said top wall, said sliding door being operable to slide inside said passageway to any selected position with respect to said passageway between a first position in which said sliding door completely blocks said passageway and a second position in which said sliding door completely opens said passageway;

wherein said spout enables controlled release of a product from inside a bag through said passageway when said spout is releasably attached to said bag by holding a perimeter section of a cut out hole made in said bag tightly between said frontal face of said outer flange positioned facing an inner side of said perimeter section and said inner frame flange positioned on an exterior side of said perimeter section receiving said plurality of fasteners.

2. The reusable seal spout assembly of claim 1, wherein a track is provided by said two side walls to support said sliding door.

3. The reusable seal spout assembly of claim 1, wherein said reusable seal spout assembly further comprising a seal, said seal having a seal central hole and a plurality of seal receiving holes.

4. The reusable seal spout assembly of claim 1, wherein said plurality of fasteners are studs, screws, bolts or male snap fasteners.

5. The reusable seal spout assembly of claim 1, wherein a plurality of nuts or female clips or female snap fasteners mate with said plurality of fasteners for said coupling of said inner frame flange with said outer flange.

6. The reusable seal spout assembly of claim 1, wherein said outer flange is flexible.

7. The reusable seal spout assembly of claim 1, wherein said cut out hole made in said bag is geometrically shaped to correspond to a shape of said outer flange and a size of said cut out hole is made equal to or less than an inside area of said outer flange.

8. The reusable seal spout assembly of claim 1, wherein one or more door stops having a projected portion is disposed on said sliding door to prevent said sliding door from completely coming out of said slot.

9. The reusable seal spout assembly of claim 3, wherein said seal is configured to be placed between said frontal face of said outer flange and said inner side of said perimeter section, between said inner frame flange and said exterior side of said perimeter section or on an outer face of said inner frame flange.

* * * * *